US012358600B2

(12) United States Patent
Hey et al.

(10) Patent No.: US 12,358,600 B2
(45) **Date of Patent: *Jul. 15, 2025**

(54) WATERCRAFT LIFT

(71) Applicant: Sunstream Corporation, Kent, WA (US)

(72) Inventors: Kenneth Edwards Hey, Mercer Island, WA (US); Loern Alan Halverson, Bellevue, WA (US); Dean Allen Stanford, Seattle, WA (US); Kent Bradley Van Olst, Seattle, WA (US)

(73) Assignee: Sunstream Corporation, Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/597,736

(22) Filed: Mar. 6, 2024

(65) Prior Publication Data

US 2024/0294239 A1 Sep. 5, 2024

Related U.S. Application Data

(63) Continuation of application No. 17/324,059, filed on May 18, 2021, now Pat. No. 11,932,364.
(Continued)

(51) Int. Cl.

| | |
|---|---|
| ***B63C 3/06*** | (2006.01) |
| ***B63C 3/02*** | (2006.01) |
| ***B63C 3/12*** | (2006.01) |

(52) U.S. Cl.
CPC ..... *B63C 3/06* (2013.01); *B63C 3/02* (2013.01); *B63C 3/12* (2013.01)

(58) Field of Classification Search
CPC ..... B63C 3/06; B63C 3/12
(Continued)

(56) References Cited

U.S. PATENT DOCUMENTS

| | | | |
|---|---|---|---|
| 845,827 | A | 3/1907 | Steedman |
| 2,642,845 | A | 6/1953 | Stevens |

(Continued)

FOREIGN PATENT DOCUMENTS

| | | |
|---|---|---|
| CA | 2144401 | † 9/1996 |
| CA | 2810972 | † 10/2013 |

OTHER PUBLICATIONS

Sunlift X SLX5010B4, retrieved from https://sunstreamboatlifts.com/sunlift-x/, 2024, 1 page.

(Continued)

*Primary Examiner* — Sean D Andrish
(74) *Attorney, Agent, or Firm* — George C. Rondeau, Jr.; Davis Wright Tremaine LLP

(57) ABSTRACT

A watercraft lift with rearward and forward lateral beams, left and right side longitudinal side beams, a pair of left side lifting arms, a pair of right side lifting arms supporting at their upper ends left and right side watercraft supports, and left and right side actuators pivotally attached to the left and right side rearward lifting arms. In one embodiment the left side rearward lifting arm and the left side actuator rotate about their pivotal attachments to the longitudinal left side beam in a left side plane, and the right side rearward lifting arm and the right side actuator rotate about their pivotal attachments to the longitudinal right side beam in a right side plane.

21 Claims, 46 Drawing Sheets

Related U.S. Application Data

(60) Provisional application No. 63/026,618, filed on May 18, 2020.

(58) Field of Classification Search
USPC ..... 405/1, 3
See application file for complete search history.

(56) References Cited

U.S. PATENT DOCUMENTS

| | | | |
|---|---|---|---|
| 2,719,510 | A | 10/1955 | Elder |
| D233,119 | S | 10/1974 | Johnson |
| 4,474,387 | A | 10/1984 | Maranell et al. |
| D282,241 | S | 1/1986 | Sauber |
| D304,575 | S | 11/1989 | Batzel |
| 5,890,835 | A † | 4/1999 | Basta |
| 5,908,264 | A | 6/1999 | Hey |
| 6,318,929 | B1 | 11/2001 | Basta |
| 6,575,661 | B1 | 6/2003 | Phillips et al. |
| 6,612,601 | B1 | 9/2003 | Granlind |
| D484,086 | S | 12/2003 | Davidson et al. |
| D487,423 | S | 3/2004 | Davidson et al. |
| 6,830,410 | B2 | 12/2004 | Davidson et al. |
| 6,964,540 | B1 | 11/2005 | Foxwell |
| 6,976,442 | B2 | 12/2005 | Hey et al. |
| 7,246,970 | B2 | 7/2007 | Hey |
| D582,256 | S | 12/2008 | Templeton |
| D619,325 | S | 7/2010 | Mantilla et al. |
| 8,291,810 | B2 | 10/2012 | Hey et al. |
| D686,794 | S | 7/2013 | Koberg |
| 8,696,240 | B2 | 4/2014 | Baas et al. |
| 8,911,174 | B2 | 12/2014 | Hey et al. |
| 8,979,426 | B2 † | 3/2015 | Doig |
| 9,527,552 | B2 | 12/2016 | Hey et al. |
| 10,518,852 | B2 | 12/2019 | Golden |
| 10,745,259 | B2 † | 8/2020 | Kritzer |
| 10,858,083 | B1 | 12/2020 | Basta et al. |
| D1,010,969 | S | 1/2024 | Smith et al. |
| D1,013,318 | S | 1/2024 | Smith et al. |
| 11,932,364 | B2 * | 3/2024 | Hey ..... B63C 3/12 |
| 2004/0089212 | A1 † | 5/2004 | Vinnik |
| 2005/0073130 | A1 | 4/2005 | McGlothlin |
| 2006/0147268 | A1 | 7/2006 | Hey |
| 2006/0153643 | A1 | 7/2006 | Basta |
| 2009/0179400 | A1 | 7/2009 | Van Der Plaats et al. |
| 2010/0189502 | A1 | 7/2010 | Basta et al. |
| 2013/0266377 | A1 | 10/2013 | Hey et al. |
| 2014/0017009 | A1 † | 1/2014 | Hey |
| 2017/0341561 | A1 | 11/2017 | Hess |
| 2021/0354794 | A1 | 11/2021 | Hey et al. |
| 2022/0048603 | A1 | 2/2022 | Buksowicz |
| 2023/0227134 | A1 | 7/2023 | Golden |

OTHER PUBLICATIONS https://www.facebook.com/ShoreMateLifts/photos/pb.100057287275320.-2207520000/391875932250/?type=3 Shore-Mate Waterfront Products online Facebook post May 4, 2010.† https://www.facebook.com/ShoreMateLifts/photos/pb.1000572872753.20.-2207520000/10150548229242251/?type=3 Shore-Mate Waterfront Products online Facebook post Feb. 24, 2012.†

* cited by examiner
† cited by third party

WATERCRAFT LIFT

CROSS REFERENCE TO RELATED APPLICATION(S)

This application claims the benefit of U.S. Provisional Patent Application No. 63/026,618, filed May 18, 2020, and is a continuation of U.S. utility patent application Ser. No. 17/324,059, filed May 18, 2021, the disclosures of which are incorporated herein by reference in their entirety.

BACKGROUND OF THE INVENTION

Field of the Invention

The present invention is directed to a freestanding watercraft lift, and more specifically, to a freestanding watercraft lift, such as a boat lift, which has a frame with typically four feet supported by the seabed, and translating bunks that support a watercraft and are lifted by pivoting arms.

Description of the Related Art

There are a number of advantages to storing a boat out of the water when not in use. Out-of-water storage prevents damage resulting from the boat bumping against adjacent docks, other watercraft or floating debris. It reduces the possibility of the boat breaking free from its moorage and either floating away or running aground. Out-of-water storage also lessons boat damage associated with long-term exposure to water (e.g., corrosion electrolysis, rusting, and blistering), and the attachment of barnacles and other marine growth on the bottom of the boat.

Examples of prior art hydraulic boat lifts are shown in U.S. Pat. Nos. 5,908,264, 6,976,442, 7,246,970, 6,830,410, and 8,911,174, and U.S. Patent Application Publication No. 2014/0017009. This style boat lift has the boat supported by two laterally spaced apart bunks. The bunks are attached to at least two pivotally movable H-frames, which are pivotally attached to a lower frame and connected to one end of one or more hydraulic cylinders, which provide pivotal drive to the H-frames. The other end of the hydraulic cylinders is typically connected to a hydraulic beam of the lower frame, which extends laterally between left and right lateral beams of the lower frame. Other examples of prior art of hydraulic cushioning are U.S. Pat. Nos. 845,827, 2,642,845, and 2,719,510.

Some boat lift designs allow for lateral adjustment of the bunks of boat lift. However, these designs add significant complexity, weight and cost. Other concerns are installation time, durability, maintenance and aesthetics.

BRIEF DESCRIPTION OF THE SEVERAL VIEWS OF THE DRAWING(S)

DETAILED DESCRIPTION OF THE INVENTION

The invention generally relates to a watercraft lift system generally used for lifting powerboats, however, the design could be applied to other type boat and watercraft lift systems and other type boats and watercraft. U.S. Pat. No. 8,911,174 and U.S. Patent Application Publication No. 2014/0017009 are incorporated herein by reference in their entirety.

Figure 1:
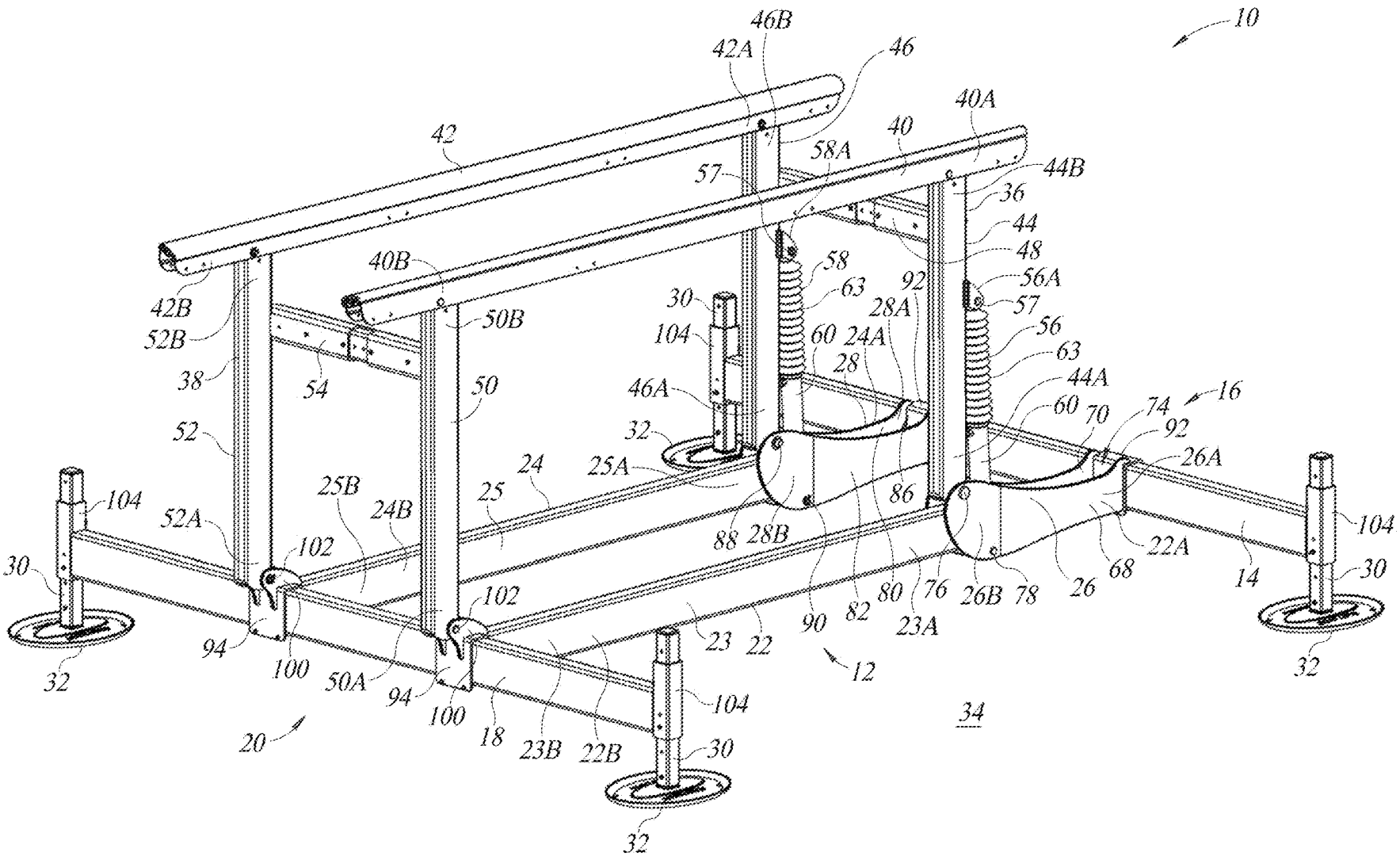
FIG. 1 is an isometric view of a watercraft lift in accordance with an embodiment of the present invention shown in a fully raised position.

A first embodiment of the watercraft lift 10 of the present invention is illustrated in FIG. 1 and in subsequent figures, with several other embodiments also being illustrated with constructions somewhat similar to the embodiment of FIG. 1. As illustrated in FIG. 1 showing the watercraft lift 10 in a fully raised position, the watercraft lift includes a substantially rectangular lower frame 12 comprised of rearward lateral beam 14 at a rearward end 16 of the watercraft lift and a forward lateral beam 18 at a forward end 20 of the watercraft lift. The lower frame 12 further includes a longitudinal left side beam 22 with a rearward end portion 22A and a forward end portion 22B, and a longitudinal right side beam 24 with a rearward end portion 24A and a forward end portion 24B.

The longitudinal left side beam 22 comprises a left side forward beam portion 23 and a left side rearward support member 26. The left side forward beam portion 23 has a rearward end portion 23A and a forward end portion 23B, and the left side rearward support member 26 has a rearward end portion 26A and a forward end portion 26B.

The longitudinal right side beam 24 comprises a right side forward beam portion 25 and a right side rearward support member 28. The right side forward beam portion 25 has a rearward end portion 25A and a forward end portion 25B, and a right side rearward support member 28 has a rearward end portion 28A and a forward end portion 28B.

The rearward end portion 26A of the left side rearward support member 26 and the rearward end portion 28A of the right side rearward support member 28 are supported by the rearward lateral beam 14. The forward end portion 23B of the left side forward beam portion 23 and the forward end portion 25B of the right side forward beam portion 25 are supported by the forward lateral beam 18. The forward end portion 26B of the left side rearward support member 26 is rigidly attached to the rearward end portion 23A of the left side forward beam portion 23, and the forward end portion 28B of the right side rearward support member 28 is rigidly attached to the rearward end portion 25A of the right side forward beam portion 25. The left side rearward support member 26 is in longitudinal alignment with the left side forward beam portion 23, and the right side rearward support member 28 is in longitudinal alignment with the right side forward beam portion 25.

The lower frame 12 is supported by four legs 30, each of which has a substantially circular or oval foot 32 positionable on the seabed 34. It is to be understood that the foot 32 may have other shapes.

An H-shaped rearward lifting frame 36 and an H-shaped forward lifting frame 38 are pivotally connected to the lower frame 12 for raising and lowering a left side bunk 40 and a right side bunk 42, or other style watercraft support members or platforms. The rearward lifting frame 36 comprises a left side rearward lifting arm 44, a right side rearward lifting arm 46, and a rearward connector member 48, and the forward lifting frame 38 comprises a left side forward lifting arm 50, a right side forward lifting arm 52, and a forward connector member 54. The rearward connector member 48 extends between and is connected to the left side rearward lifting arm 44 and a right side rearward lifting arm 46. Similarly, the forward connector member 54 extends between and is connected to the left side forward lifting arm 50 and the right side forward lifting arm 52.

In the preferred embodiment, the rearward and forward connector members are a tube, which is bolted to an open channel shape connected to the arms. In an alternate embodiment, the rearward and forward connector members are channels, connected to either channels or tubes, connected to the arms. This enables the connector member to be easily removed, verses a telescoping shape that can easily jam, especially if adjusting needs to be synchronized between multiple telescoping tubes. It is preferred to have the connector member to be a tube, since a tube is efficient in torsion, which keeps the left and right sides of the lift synchronized. In another alternate embodiment, a lateral member is connected to the inside of the right arms, and another lateral member is connected to the inside of the left arms. The left and right lateral members are bolted together in a plurality of possible positions that would provide various distances between the arms.

A lower end portion 44A of the left side rearward lifting arm 44 is pivotally connected to the left side rearward support member 26 with a pivot axis at a location toward but forward of the rearward lateral beam 14, and an upper end portion 44B is pivotally connected to a rearward portion 40A of the left side bunk 40. A lower end portion 46A of the right side rearward lifting arm 46 is pivotally connected to the right side rearward support member 28 with a pivot axis at a location toward but forward of the rearward lateral beam 14, and an upper end portion 46B is pivotally connected to a rearward portion 42A of the right side bunk 42.

Similarly, a lower end portion 50A of the left side forward lifting arm 50 is pivotally connected to the forward end portion 23B of the left side forward beam portion 23 of the longitudinal left side beam 22 with a pivot axis at a location forward of or adjacent to the forward lateral beam 18 and higher than an upper side of the longitudinal left side beam (i.e., at an elevation above the upper side), and an upper end portion 50B is pivotally connected to a forward portion 40B of the left side bunk 40. A lower end portion 52A of the right side forward lifting arm 52 is pivotally connected to the forward end portion 25B of the right side forward beam portion 25 of the longitudinal right side beam 24 with a pivot axis at a location forward of or adjacent to the forward lateral beam 18 and higher than an upper side of the longitudinal right side beam (i.e., at an elevation above the upper side), and an upper end portion 52B is pivotally connected to a forward portion 42B of the right side bunk 42. The pivotal connection of the left and right side forward lifting arms 50 and 52 to the left and right side forward beam portions 23 and 25 along a pivot axis at a location forward of the forward lateral beam 18 enables the watercraft lift 10 to be used in shallower water when facing an upward slope on the seabed 34, since moving the forward feet 32 and forward lateral beam 18 rearward enables rest of the lift to be installed further forward in shallower water. The described pivotal connections are preferably made using pivot pins.

The pivotal connections of the lifting arms 44, 46, 50 and 52 to the left and right side rearward support members 26 and 28, to the longitudinal left and right side forward beam portions 23 and 25, and to the left and right side bunks 40 and 42, are preferably accomplished using corresponding through holes in the components to be pivotally connected together sized to receive pivot pins.

Sloped Bunks and Loads

Figure 3:
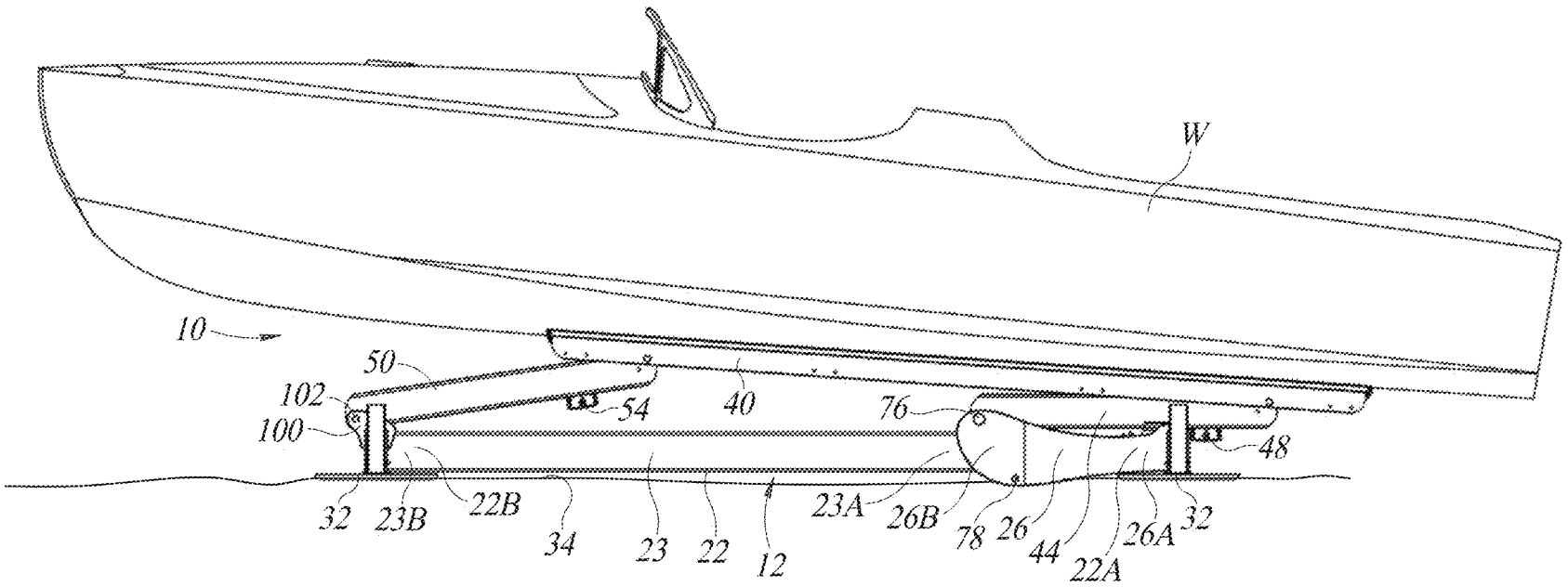
FIG. 3 is a left side elevational view of the lift of FIG. 1 shown in the fully lowered position supporting a watercraft.

FIG. 3 shows the watercraft lift 10 in a fully lowered position. The left and right side bunks 40 and 42 are sloped rearward to assist in stopping forward movement of a watercraft "W" when being loaded on the watercraft lift. The slope is also necessary when using the hydraulic actuators 56 and 58 only in the rear, since the hydraulic actuators produce load that is transferred to the left and right side rearward lifting arms 44 and 46, then along the left and right side rearward support members 26 and 28. The left and right side rearward support members 26 and 28 push on the upper pivots of the left and right side forward lifting arms 50 and 52 and create a moment centered around the lower pivots of the left and right side forward lifting arms. The loads and required cylinder pressure decrease the higher the elevation of the upper pivots of the left and right side forward lifting arms 50 and 52. In the preferred embodiment, it is desirable to have a small slope at the fully raised position to assist with drainage inside the watercraft "W," and a larger slope in the fully lowered position to assist with docking, and to minimize the loads. Too much slope in the fully lowered position can increase the minimum required water depth.

Figure 2:
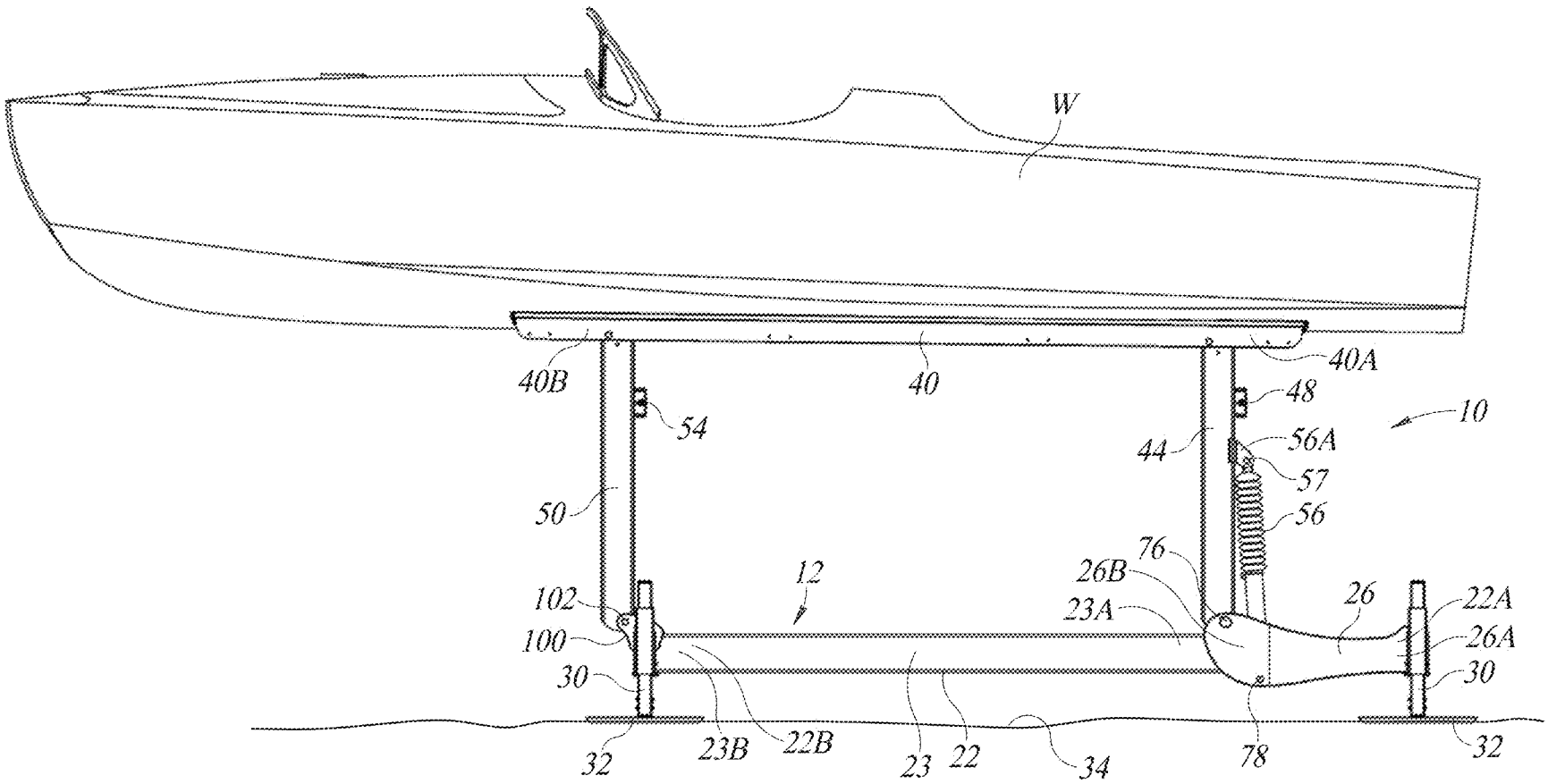
FIG. 2 is a left side elevational view of the lift of FIG. 1 shown in the fully raised position.

FIG. 2 shows the watercraft lift 10 in a fully raised position and supporting the watercraft "W" on the bunks 40 and 42, and FIG. 3 shows the watercraft lift in a fully lowered position and supporting the watercraft on the bunks. As will be explained in greater detail below, in FIG. 3 the watercraft lift 10 is shown using an alternative manner of connecting each foot 32 to the lower frame 12 that allows use of the watercraft lift in shallower water.

The right side support members 26 and 28 are best to be flexible enough to conform to most boat shapes, but stiff enough to spread the load evenly to a hull of a watercraft.

Adjustable Range

Figure 4:
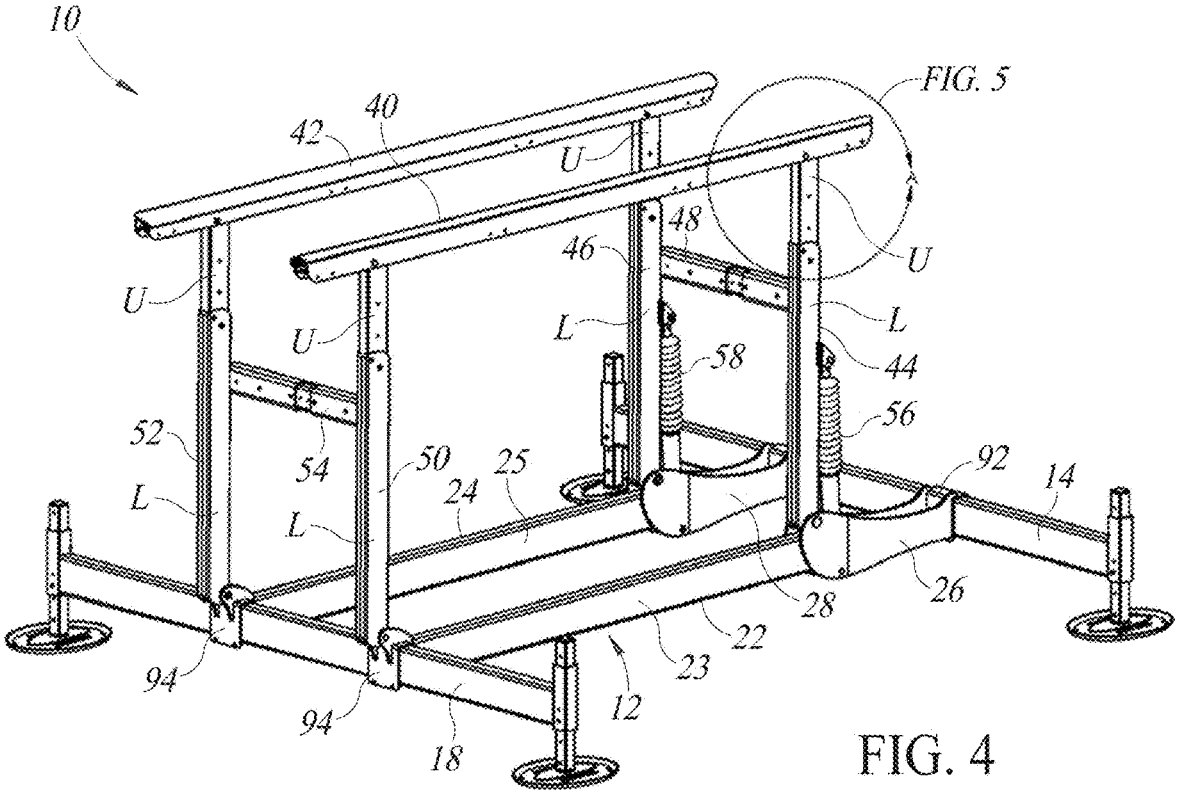
FIG. 4 is an isometric view of the lift of FIG. 1 with extendable lifting arms extended.
Figure 5:
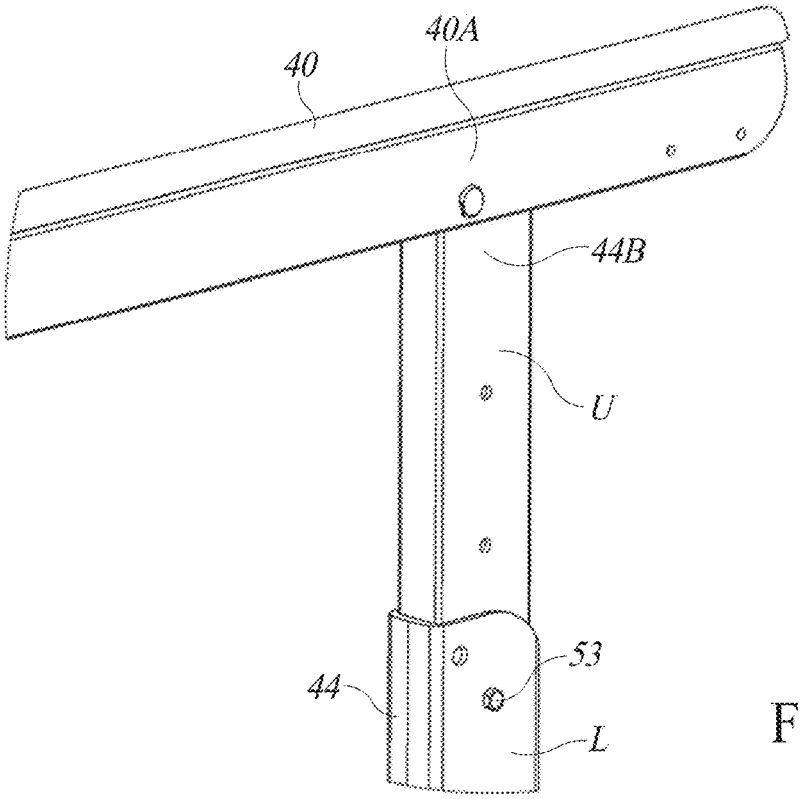
FIG. 5 is an enlarge view of an extended lifting arm of FIG. 4.

As shown in FIG. 4, each of the lifting arms 44, 46, 50, and 52 may include a lower arm member "L" with an open upper end portion sized to telescopically receive therein a lower end portion of an upwardly adjustably extendable telescoping upper arm member "U." FIG. 5 is an enlarged view of the left side rearward lifting arm 44 and illustrates that the lower arm member of each lifting arm has a through hole and the telescoping upper arm member has a plurality of longitudinally spaced apart through holes, with the through holes sized to receive a bolt or pin 53 to secure the upper arm member at an adjustable desired extension out of the lower arm member. Once an upward extension is selected for the telescoping upper arm member relative to the lower arm member in which positioned and from which it is projecting, the bolt or pin is used to hold the telescoping upper arm member relative to the lower arm member in the extended position selected during use of the watercraft lift 10.

Using telescoping lifting arms 44, 46, 50, and 52, the upper end portion of the telescoping upper arm member "U" are pivotally connected to the left and right side bunks 40 and 42. The use of telescoping lifting arms 44, 46, 50, and 52 to effectively lengthen the lifting arms permits adjustment of the lifting range of the rearward and forward lifting frames 36 and 38, and hence the vertical position of the left and right side bunks 40 and 42 relative to the lower frame 12 when in the raised position. A similar adjustable range feature is described in U.S. Pat. No. 6,976,442, which is incorporated herein by reference in its entirety. It is to be understood that while the telescoping upper arm member "U" is illustrated as extending from within the lower arm member "L," the telescoping lifting arms may be designed with the upper arm member receiving an upper end portions of the lower arm member within an open lower end portion of the upper arm member.

An alternative means of reducing the lifting range of the rearward and forward lifting frames 36 and 38 may be achieved by cutting off the same amount of an upper portion of each of the upper arm members "U" of the lifting arms 44, 46, 50, and 52 (at a location below the original through holes for their connection to the left and right bunks 40 and 42), and drilling new through holes by which the upper arm members are to be pivotally connected to the left and right bunks, or by providing a secondary set of through holes predrilled below the original upper set.

Boot

As illustrated in FIG. 1, the watercraft lift 10 includes a left side dual-directional hydraulic actuator 56 and a right side dual-directional hydraulic actuator 58. Each of the left and right side hydraulic actuators 56 and 58 has an actuator body 60 with an extendable actuator rod 62 (see FIG. 6) within a flexible corrugated boot 63. A similar boot is described in U.S. Pat. No. 8,291,810, which is incorporated herein by reference in its entirety.

Figure 6:
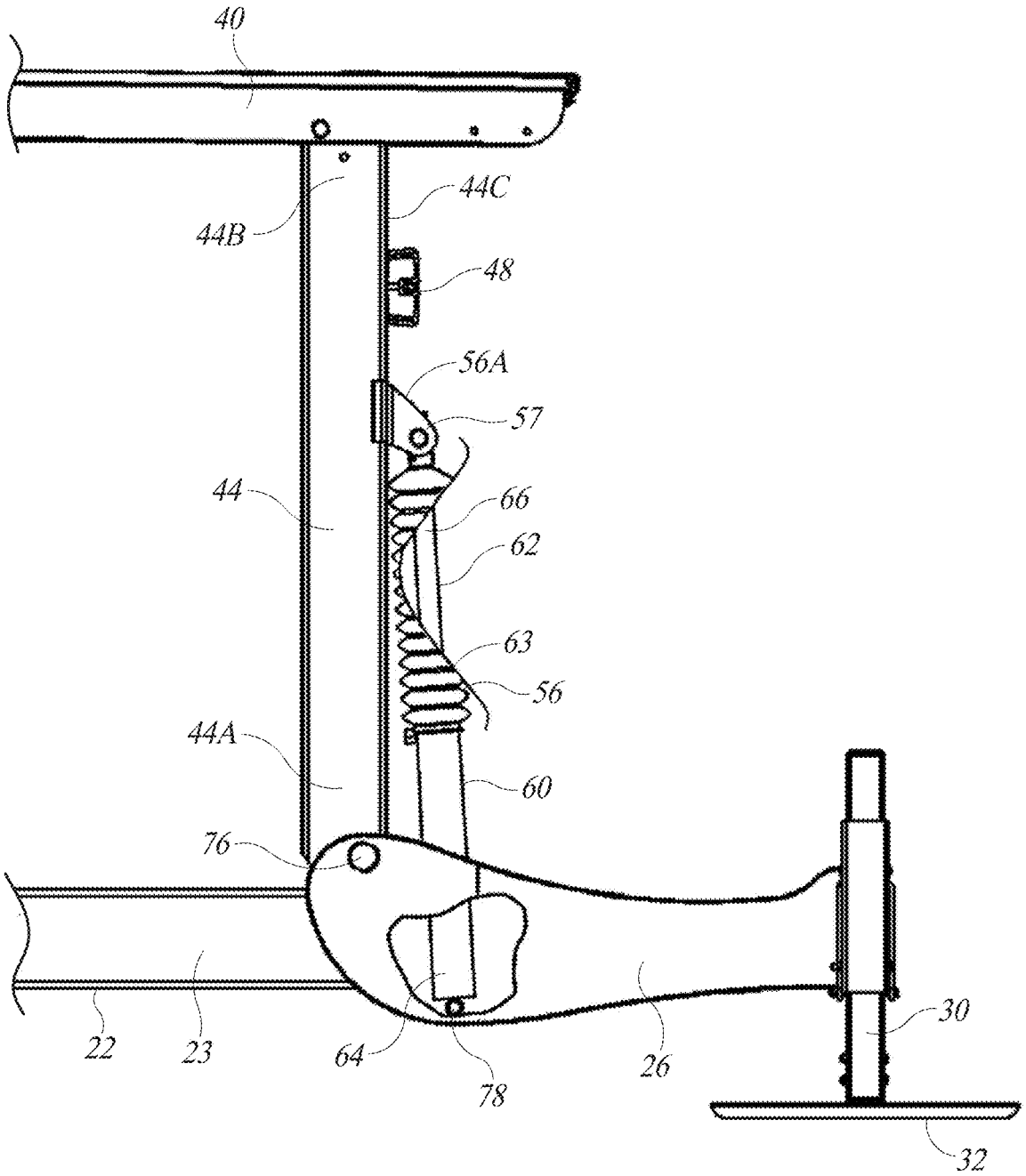
FIG. 6 is a cutaway view showing the interior of a hydraulic cylinder body of FIG. 1.

As shown in FIG. 6, the actuator body 60 has a lower end portion 64, and the actuator rod 62 has an upper end portion 66. The lower end portion 64 of the actuator body 60 of the left side hydraulic actuator 56 is pivotally connected to the left side rearward support member 26 with a pivot axis at a location toward but forward of the rearward lateral beam 14 and rearward of the pivotal connection of the lower end portion 44A of the left side rearward lifting arm 44 to the left side support member, and the upper end portion 66 of the actuator rod 62 of the left side hydraulic actuator 56 is pivotally connected to a rearward side 44C of the left side rearward lifting arm 44, and when the watercraft lift 10 is in the fully raised position, at a position above the lower end portion 44A of the left side rearward lifting arm with a pivot axis at a location rearward of the rearward side of the left side rearward lifting arm whereat pivotally connected. Similarly, the lower end portion 64 of the actuator body 60 of the right side hydraulic actuator 58 is pivotally connected to the right side rearward support member 28 with a pivot axis at a location toward but forward of the rearward lateral beam 14 and rearward of the pivotal connection of the lower end portion 46A of the right side rearward lifting arm 46 to the right side support member, and the upper end portion 66 of the actuator rod 62 of the right side hydraulic actuator 58 is pivotally connected to a rearward side 46C of the right side rearward lifting arm 46, and when the watercraft lift 10 is in the fully raised position, at a position above the lower end portion 46A of the right side rearward lifting arm with a pivot axis at a location rearward of the rearward side of the right side rearward lifting arm whereat pivotally connected. The actuator rod 62 of each of the left and right side hydraulic actuators 56 and 58 is selectively extendable from and retractable into the corresponding actuator body 60.

Figure 7:
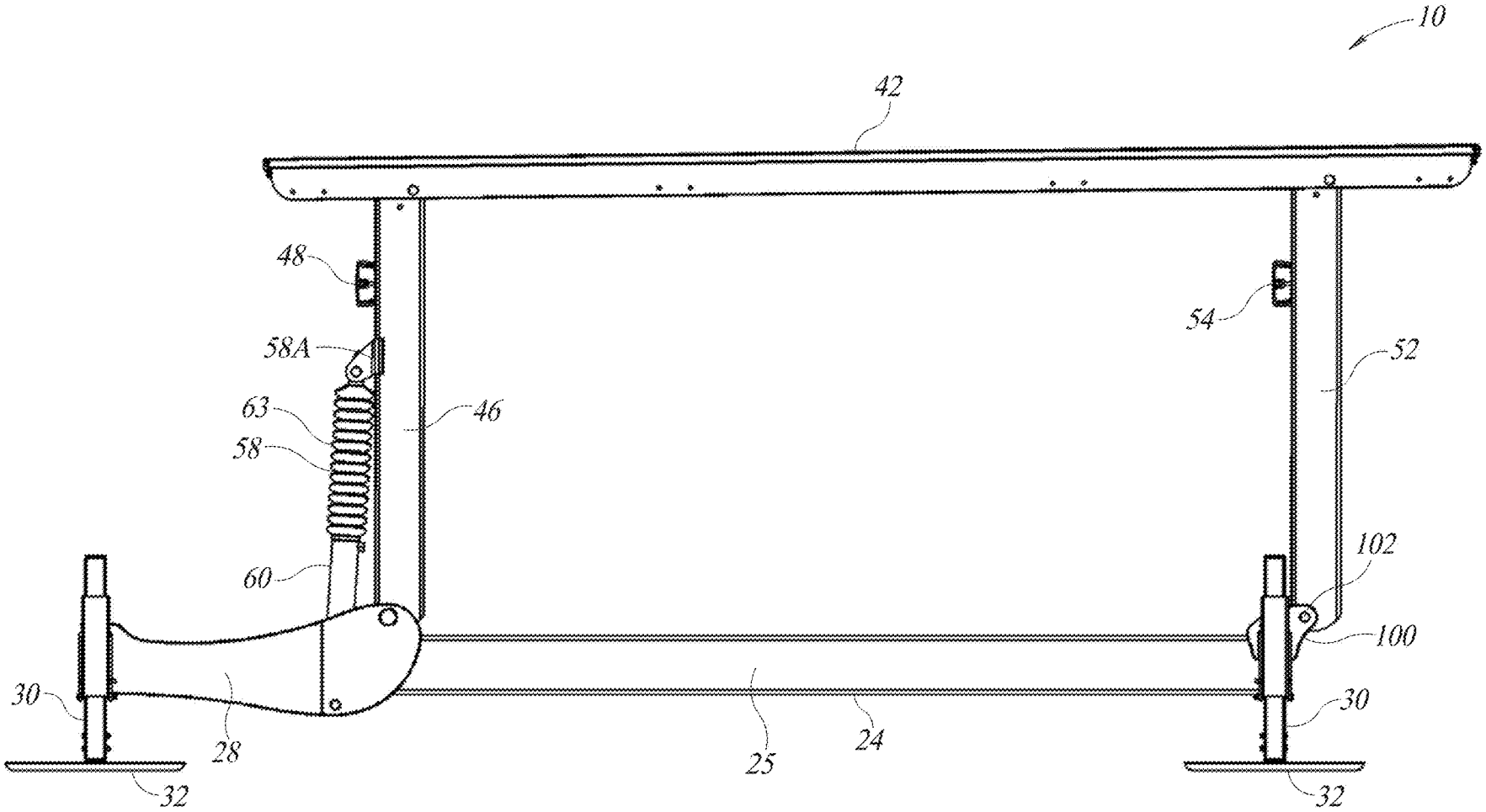
FIG. 7 is a side elevational view of the lift of FIG. 1.
Figure 8:
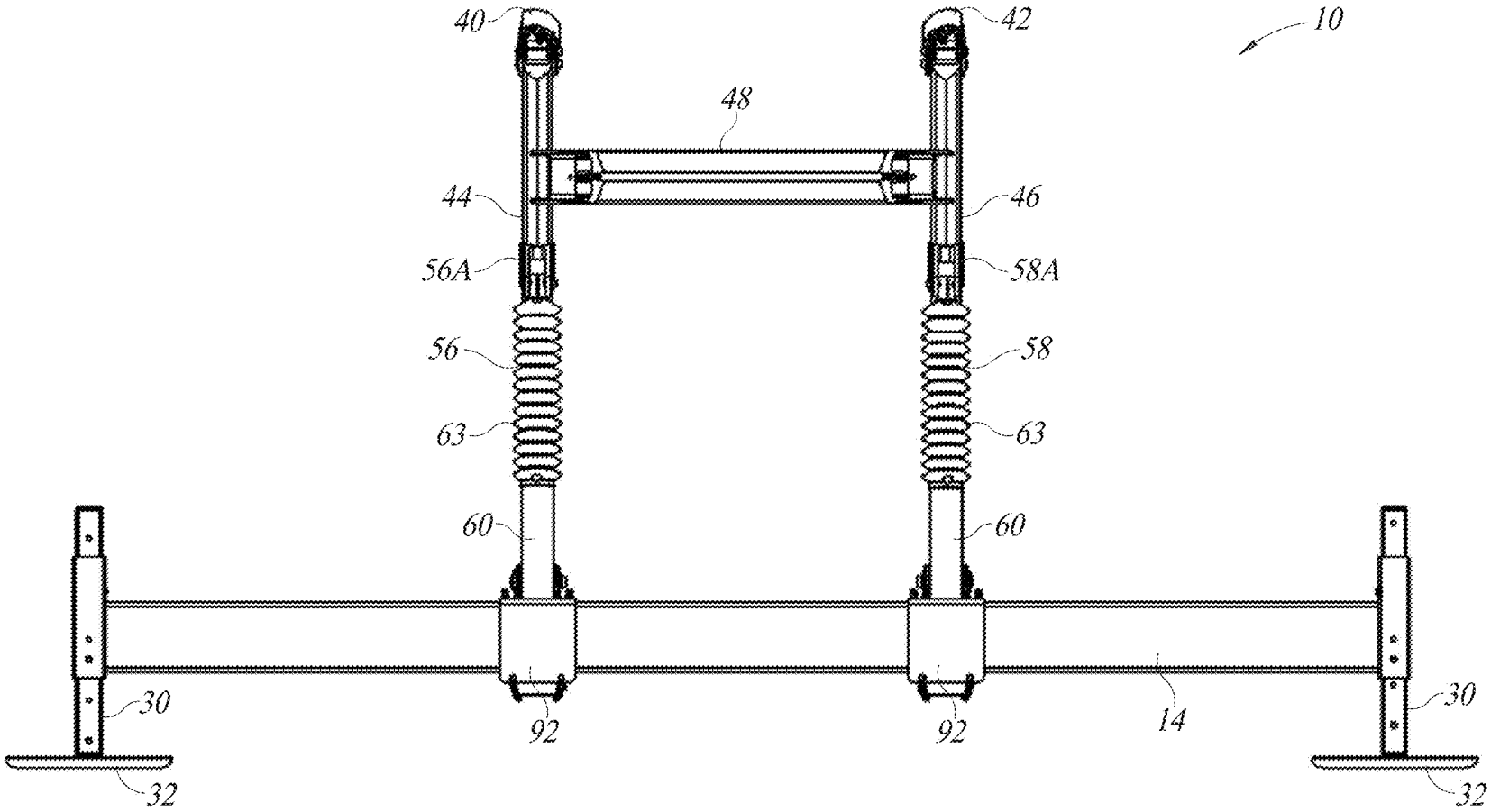
FIG. 8 is a rear elevational view of the lift of FIG. 1.
Figure 9:
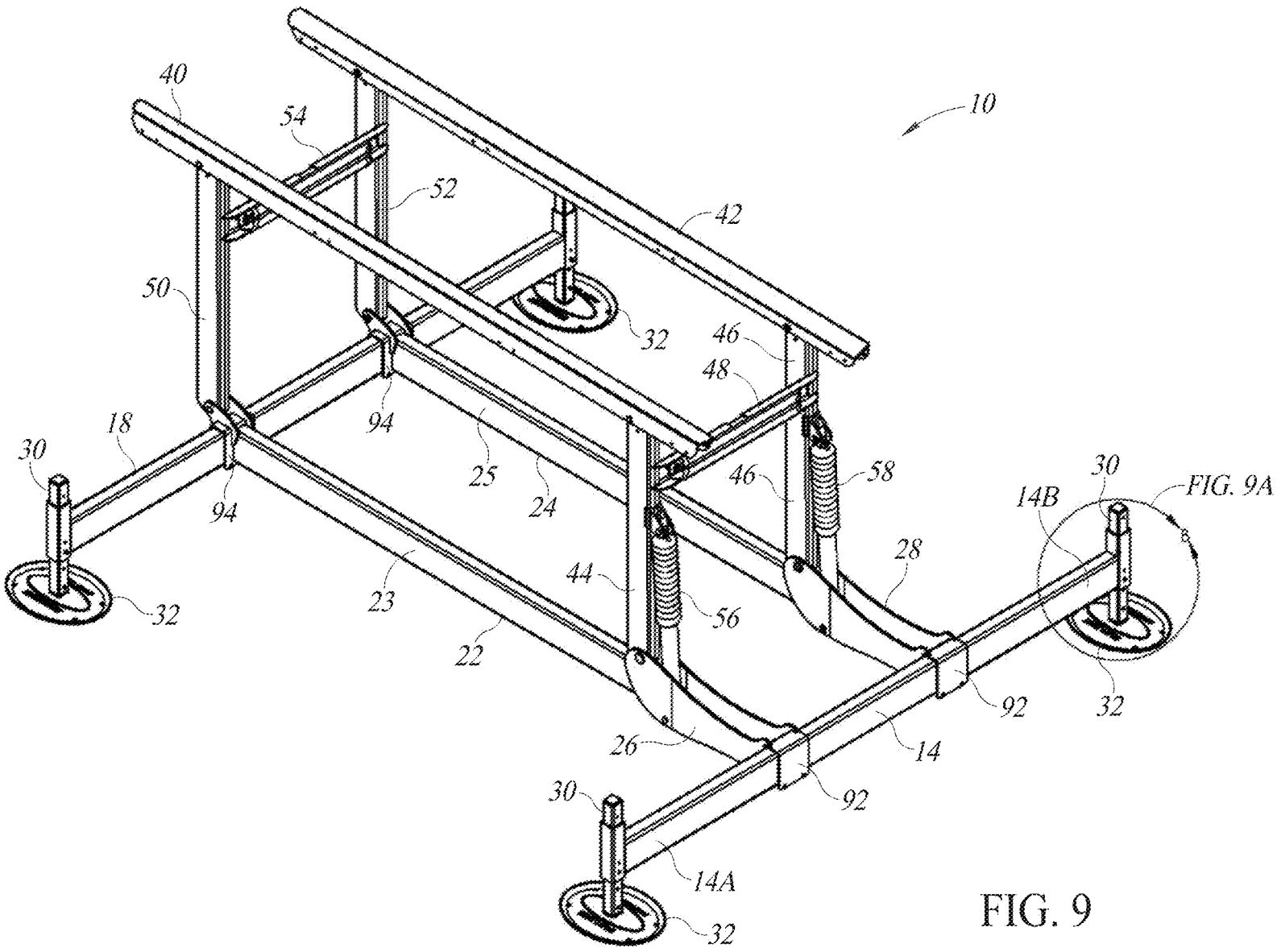
FIG. 9 is an isometric view of the lift of FIG. 1.

FIG. 7 is a right side view, FIG. 8 is rear elevational view and FIG. 9 is a rear isometric view of the watercraft lift 10 in the fully raised position.

Over-Center

Selective operation of the left and right side hydraulic actuators 56 and 58 in unison rotates the rearward and forward lifting frames 36 and 38 forward and rearward, and as a result, respectively, raises and lowers the left and right side bunks 40 and 42. The watercraft lift 10 is shown in the fully raised position in FIGS. 1 and 2, and in a fully lowered position in FIG. 3. When in the fully raised position, preferably, the rearward and forward lifting frames 36 and 38 are rotated forward to a position about 1 to 12 degrees over center to prevent accidental lowering of the left and right side bunks 40 and 42, and any watercraft thereon, should hydraulic power being applied to left and right side hydraulic actuators 56 and 58 be interrupted. In a preferred embodiment, the pivot through holes in the upper end portions 44B, 46B, 50B, and 52B of the lifting arms 44, 46, 50, and 52 used to make the pivotal connections between the lifting arms and the left and right side bunks 40 and 42 are positioned to be adequately over-center, but the lifting arms are approximately vertical for aesthetics, and not to create a lack of over-center concern if the lifting arms have a rearward angle when fully up.

Applying hydraulic pressure to a first port of the left and right side hydraulic actuators 56 and 58 in unison to causes extension of their actuator rods 62 relative to their actuator bodies 60 provides the rotational drive to the rearward and forward lifting frames 36 and 38 to raise the left and right side bunks 40 and 42, and applying hydraulic pressure to a second port of the left and right side hydraulic actuators 56 and 58 in unison to causes retraction of their actuator rods relative to their actuator bodies provides the rotational drive to the rearward and forward lifting frames to lower the left and right side bunks 40 and 42. Alternatively, if the lifting arms are not over-center, relief of the hydraulic pressure applied to the first port of the left and right side hydraulic actuators 56 and 58 allows the bunks to move downward under the weight of lifting frames, bunks and any load on the bunks.

Hydraulic Actuator Alignment

The rearward lifting frame 36 and the forward lifting frame 38 are pivotally connected to the lower frame 12 such that the left side rearward lifting arm 44 and the left side forward lifting arm 50 pivot in a first left side plane when raising and lowering the left side bunk 40, with the first left side plane preferably being defined by the longitudinal center lines of the left side forward and rearward lifting arms, and the right side rearward lifting arm 46 and the right side forward lifting arm 52 pivot in a first right side plane when raising and lowering the right side bunk 42, with the first right side plane preferably being defined by the longitudinal center lines of the right side forward and rearward lifting arms.

The pivotal connections of the left side hydraulic actuator 56 to the left side rearward support member 26 and the left side rearward lifting arm 44 are arranged such that the left side hydraulic actuator rotates about these pivotal connections in a second left side plane when raising and lowering the left side bunk 40, preferably the second left side plane being coplanar with the first left side plane, and the pivotal connections of the right side hydraulic actuator 58 to the right side rearward support member 28 and the right side rearward lifting arm 46 are arranged such that the right side hydraulic actuator rotates about these pivotal connections in a second right side plane when raising and lowering the right side bunk 42, preferably the second right side plane being coplanar with the first right side plane.

Figure 10:
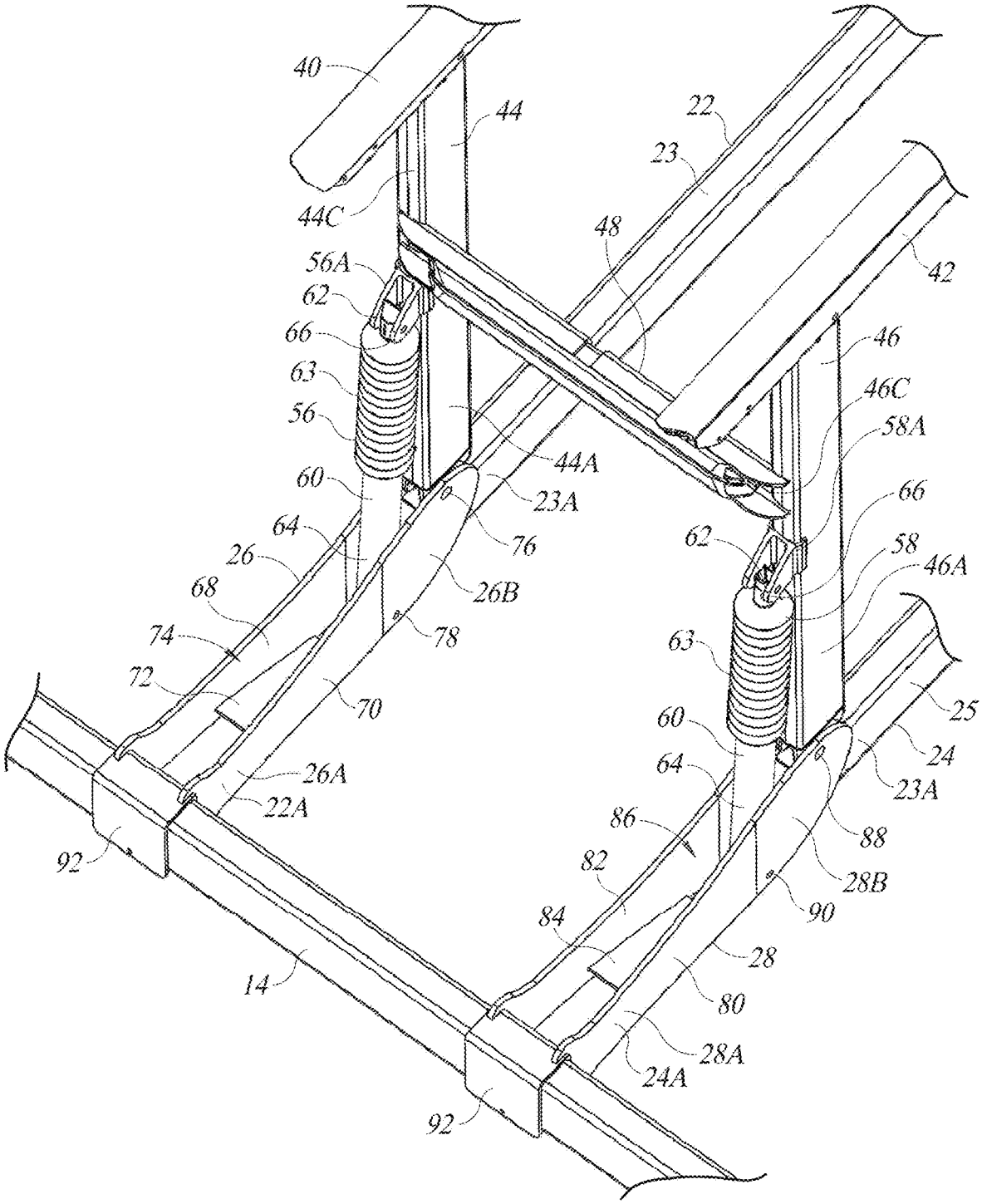
FIG. 10 is an enlarged fragmentary view of the rearward end portion of the lift of FIG. 1.

As best shown in FIG. 10, the left side rearward support member 26 includes a vertically oriented, laterally outward side plate 68 and a vertically oriented, laterally inward side plate 70, in spaced apart relation, with a connecting floor plate 72 extending between them and rigidly attached to a lower portion of each side plate, to define an upwardly open, left side space 74 between the side plates. The outward side plate 68 is positioned on an outward side of the rearward end portion 23A of the left side forward beam portion 23 and rigidly attached thereto, and the inward side plate 70 is positioned on an inward side of the rearward end portion 23A of the left side forward beam portion and rigidly attached thereto. A forwardly located upper support member pivot pin 76 and a more rearwardly located lower support member pivot pin 78 extend between forward end portions of the outward side plate 68 and the inward side plate 70 of the left side support member 26, which forward end portions comprise the forward end portion 26B of the left side support member. The upper support member pivot pin 76 is located higher than an upper side of the left side forward beam portion 23 at its rearward end portion 23A (i.e., at an elevation above the upper side), and the lower support member pivot pin 78 is located lower than a lower side of the left side forward beam portion (i.e., at an elevation below the lower side) and rearward of a rearward end of the rearward end portion 23A of the left side forward beam portion. In a preferred embodiment, the distance the upper support member pivot pin 76 is located above the upper side of the left side forward beam portion 23 is the same as the distance the pivot axis of the lower end portion 50A of the left side forward lifting arm 50 is located above the upper side of the longitudinal left side beam.

Similarly, the right side support member 28 includes a vertically oriented, laterally outward side plate 80 and a vertically oriented, laterally inward side plate 82, in spaced apart relation, with a connecting floor plate 84 extending between them and rigidly attached to a lower portion of each side plate, to define an upwardly open, right side space 86 between the side plates. The outward side plate 80 is positioned on an outward side of the rearward end portion 25A of the right side forward beam portion 25 and rigidly attached thereto, and the inward side plate 82 is positioned on an inward side of the rearward end portion 25A of the right side forward beam portion and rigidly attached thereto. A forwardly located upper support member pivot pin 88 and a more rearwardly located lower support member pivot pin 90 extend between forward end portions of the outward side plate 80 and the inward side plate 82 of the right side support member 28, which forward end portions comprise the forward end portion 28B of the right side support member. The upper support member pivot pin 88 is located higher than an upper side of the right side rearward beam portion 25 at its rearward end portion 25A (i.e., at an elevation above the upper side), and the lower support member pivot pin 90 is located lower than a lower side of the right side rearward beam portion (i.e., at an elevation below the lower side) and rearward of a rearward end of the rearward end portion 25A of the right side forward beam portion. In a preferred embodiment, the distance the upper support member pivot pin 88 is located above the upper side of the right side rearward beam portion 25 is the same as the distance the pivot axis of the lower end portion 52A of the right side forward lifting arm 52 is located above the upper side of the longitudinal right side beam.

The lower end portion 44A of the left side rearward lifting arm 44 is pivotally connected to the left side support member 26 by the upper support member pivot pin 76 for rotation about the upper support member pivot pin, and the lower end portion 64 of the actuator body 60 of the left side hydraulic actuator 56 is pivotally connected to the left side support member 26 by the lower support member pivot pin 78 for rotation about the lower support member pivot pin. Similarly, the lower end portion 46A of the right side rearward lifting arm 46 is pivotally connected to the right side support member 28 by the upper support member pivot pin 88 for rotation about the upper support member pivot pin, and the lower end portion 64 of the actuator body 60 of the right side hydraulic actuator 58 is pivotally connected to the right side support member 28 by the lower support member pivot pin 90 for rotation about the lower support member pivot pin.

The upper end portion 66 of the actuator rod 62 of the left and right side hydraulic actuators 56 and 58 are pivotally connected to the rearward sides 44C and 46C of the left and right side rearward lifting arms 44 and 46 using connection lugs 56A and 58A, respectively, thus during rotation of the left and right side rearward lifting arms by the hydraulic actuators to raise the left and right side bunks 40 and 42, the hydraulic actuators are pushing upward on the lifting arms from under their location of connection to the lifting arms to move the left and right side rearward lifting arms in the first left and right side planes. The connection lugs 56A and 58A each support a pivot pin 57 extending between two flanges by which the upper end portion 66 of the actuator rod 62 of the corresponding left and right side hydraulic actuators 56 and 58 are pivotally connected to the left and right side rearward lifting arms 44 and 46. The lugs 56A and 58A each have a one-piece extruded construction, which creates a stronger joint since there are no welds that can experience a stress concentration at the edge of the lug. This construction also simplifies the design and reduces cost.

As described above, with these pivotal connections of the left side hydraulic actuator 56 to the left side support member 26 at a location between the outward and inward side plates 68 and 70, the left side hydraulic actuator rotates about the lower support member pivot pin 78 in the second left side plane when raising and lowering the left side bunk 40 substantially coplanar with the first left side plane, and with these pivotal connections of the right side hydraulic actuator 58 to the right side support member 28 at a location between the outward and inward side plates 80 and 82, the right side hydraulic actuator rotates about the lower support member pivot pin 90 in the second right side plane when raising and lowering the right side bunk 42 substantially coplanar with the first right side plane. The upper end portion 66 of the actuator rod 62 of each of the left and right side hydraulic actuators 56 and 58 is pivotally connected to the corresponding rearward sides 44C and 46C of the left and right side rearward lifting arms 44 and 46 for rotation about the pivot pin 57. This coplanar arrangement of the left and right side hydraulic actuators 56 and 58, with the left and right side support members 26 and 28, respectively, crates a direct load path, which adds stiffness, strength and durability to the watercraft lift 10, while reducing the number of bolts required, welding, weight, cost and assembly time. Further, having the upper end portion 66 of the actuator rod 62 of the left and right side hydraulic actuators 56 and 58 pivotally connected to the rearward sides 44C and 46C of the left and right side rearward lifting arms 44 and 46 results in the upward force exerted between the left and right side hydraulic actuators and the left and right side rearward lifting arms having the load applied to the rearward lifting arms in alignment with the first left and right side planes, which reduces the torsion on the rearward lifting arms and the tension stress on the welds, thereby reducing the risk of weld cracking and enables higher hydraulic cylinder loads and higher lifting capacity without increasing the number of hydraulic cylinders used.

Floor Plates

Figure 11:
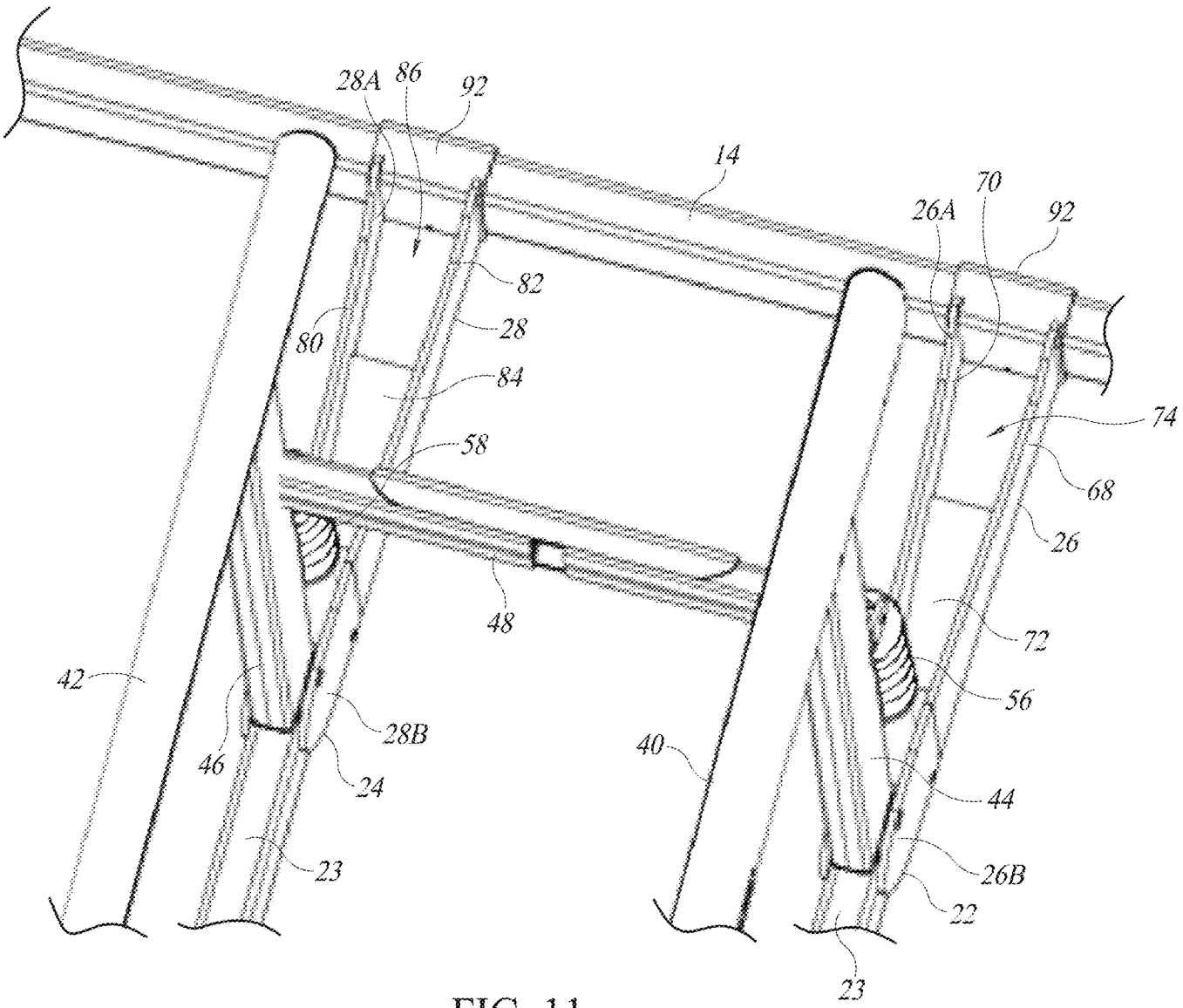
FIG. 11 is another enlarge fragmentary view of the rearward end portion of the lift of FIG. 1.
Figure 12:
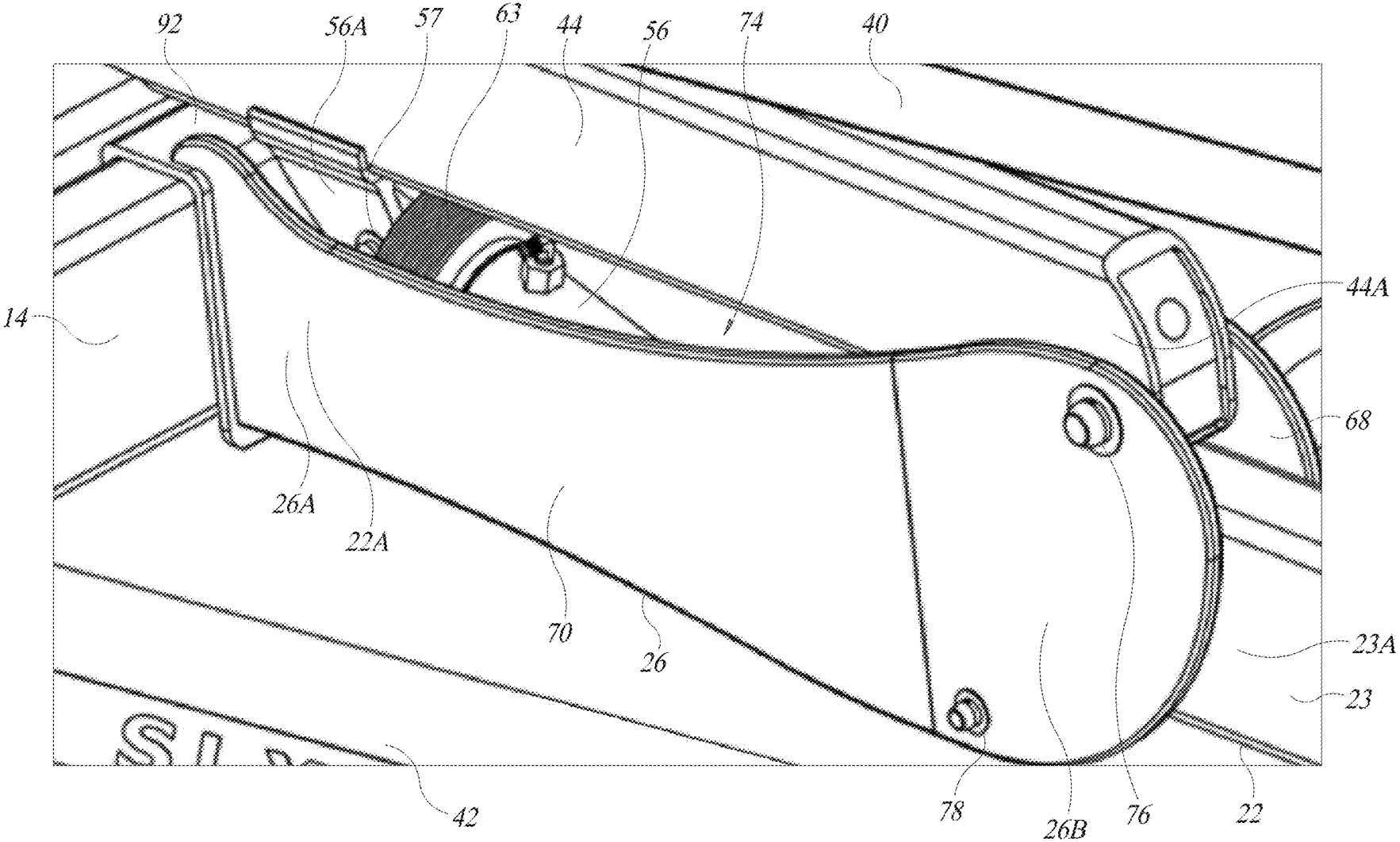
FIG. 12 is an enlarged isometric view of the support member for a hydraulic actuator of the lift of FIG. 1.

One function of the floor plates 72 and 84 (see FIG. 10) is to laterally stiffen the longitudinal beam extending between the rearward and forward lateral beams 14 and 18 of the lower frame 12, formed by the combination of the longitudinal left and right side beams 22 and 24. The left side space 74 between the outward and inward side plates 68 and 70 is sufficiently wide to receive therein the actuator body 60 of the left side hydraulic actuator 56, with the floor plate 72 serving as a support shelf for the actuator body during assembly of the watercraft lift 10. The floor plate 72 is positioned such that when the actuator body 60 is laid thereon for connection of its lower end portion 64 to left side support member 26, an aperture in the lower end portion is properly aligned to receive the lower support member pivot pin 78. Similarly, the right side space 86 between the outward and inward side plates 80 and 82 is sufficiently wide to receive therein the actuator body 60 of the right side hydraulic actuator 58, with the floor plate 84 serving as a support shelf for the actuator body during assembly of the watercraft lift 10. The floor plate 84 is positioned such that when the actuator body 60 is laid thereon for connection of its lower end portion 64 to right side support member 28, an aperture in the lower end portion is properly aligned to receive the lower support member pivot pin 90. As best seen in FIG. 11, the distance between the pair of side plates 68 and 70 and the distance between the pair of side plates 80 and 82 is wider at the rearward end (i.e., the pairs of side plates flare outward in the rearward direction) to provide more clearance for the hydraulic actuator body 60 and larger diameter corrugated boot 63, as well as the pins 57 pivotally connecting the upper end portions 64 of the actuator rods 62 to the connection lugs 56A and 58A, and to provide a wider footprint on rearward connector or saddles 92 on the rearward lateral beam 14 to add strength. The forward end portions of the floor plates 72 and 84 also dips downward to provide clearance for the hydraulic hoses connected to the hydraulic actuators 56 and 58. The left and right side spaces 74 and 86 between the side plates and the floor plates are sufficiently large to receive and nest therein a sufficient portion of the corresponding left and right side hydraulic actuators 56 and 58 when the watercraft lift 10 is in the fully lowered position, as shown in FIG. 12, without being damaged by contact with the left and right side rearward lifting arms 44 and 46.

Adjustable Width Bunks

To provide for adjustment of the lateral distance between the left and right side bunks 40 and 42, so as to better accommodate watercraft of different sizes and hull shapes on the watercraft lift 10, and also side shift both of the bunks such as to position the watercraft thereon at a desired distance from a dock, the rearward end portions 26A and 28A of the left and right side support members 26 and 28 are laterally movably and adjustably attached to the rearward lateral beam 14, and the forward end portions 22B and 24B of the longitudinal left and right side beams 22 and 24 (and forward end portions 23B and 25B of the left and right forward beam portions 23 and 25) are laterally movably and adjustably attached to the forward lateral beam 18. Each of the rearward end portions 26A and 28A of the left and right side support members 26 and 28 has a rearward saddle 92, through which the rearward lateral beam 14 extends, and each of the forward end portions 23B and 25B of the left and right side forward beam portions 23 and 25 has a forward connector or saddle 94 through which the forward lateral beam 18 extends, permitting the sliding of the rearward saddles 92 along the rearward lateral beam and the sliding of the forward saddles 94 along the forward lateral beam during setting up the watercraft lift 10 for the watercraft to be using the watercraft lift or subsequent lateral positional adjustments of the bunks 40 and 42. The rearward and forward saddles 92 and 94 may be securely clamped to the rearward and forward lateral beams 14 and 18, respectively, once the left and right side support members 26 and 28 and the longitudinal left and right side beams 22 and 24 are moved to the positions that place the left and right side bunks 40 and 42 at the desired lateral spacing for use of the watercraft lift 10 and retained in that position during subsequent use of the watercraft lift. The saddles 92 and 94 are used for clamping to the rearward and forward lateral beams 14 and 18 verses bolted connections since aligning bolt holes or drilling underwater is difficult. The saddles 92 and 94 have a downwardly facing open side to assist in assembly, and to enable the lateral side beams to be secure when the saddles 92 and 94 are loosened for adjusting. The length of the saddles 92 and 94 is sized to be adequately long to provide stability when the rearward and forward connect members 48 and 54 are not attached and saddles 92 and 94 are loosened when bunk width is being adjusted.

Benefits of Adjusting Bunk Width

By being able to adjust the lateral spacing between the left and right side support members 26 and 28 and the longitudinal left and right side beams 22 and 24 to adjust the later spacing between the left and right side bunks 40 and 42, a number of benefits may be realized. Widening the distance between the left side rearward lifting arm 44 and the right side rearward lifting arm 46, and between the left side forward lifting arm 50 and the right side forward lifting arm 52, also results in the watercraft lift 10 being adjustable to minimize the water depth needed to float the watercraft on and off the watercraft lift. The farther the bunks are moved outward to increase the space between them, the lower the keel will be for a typical V-hull watercraft. In this manner, the keel can be lowered until it is just slightly above the rearward lateral beam 14, hence allowing the watercraft to use the watercraft lift 10 in water shallower than otherwise possible if the lateral spacing between the bunks was not adjustable and fixed at a lateral spacing holding the keel higher above the rearward lateral beam.

Also, watercraft hulls often have running strakes that are longitudinal protruding features or ridges that assist the watercraft in tracking and performance, and other hull protrusions, and if a running strake or other protrusion is located in line with and contacting the bunk, the watercraft will not sit centered or level on the left and right side bunks 40 and 42. By adjusting the lateral spacing between the longitudinal left and right side beams 22 and 24 to adjust the lateral spacing between the bunks 40 and 42, contact of the bunks with strakes and other hull protrusions can be avoided.

Figure 13:
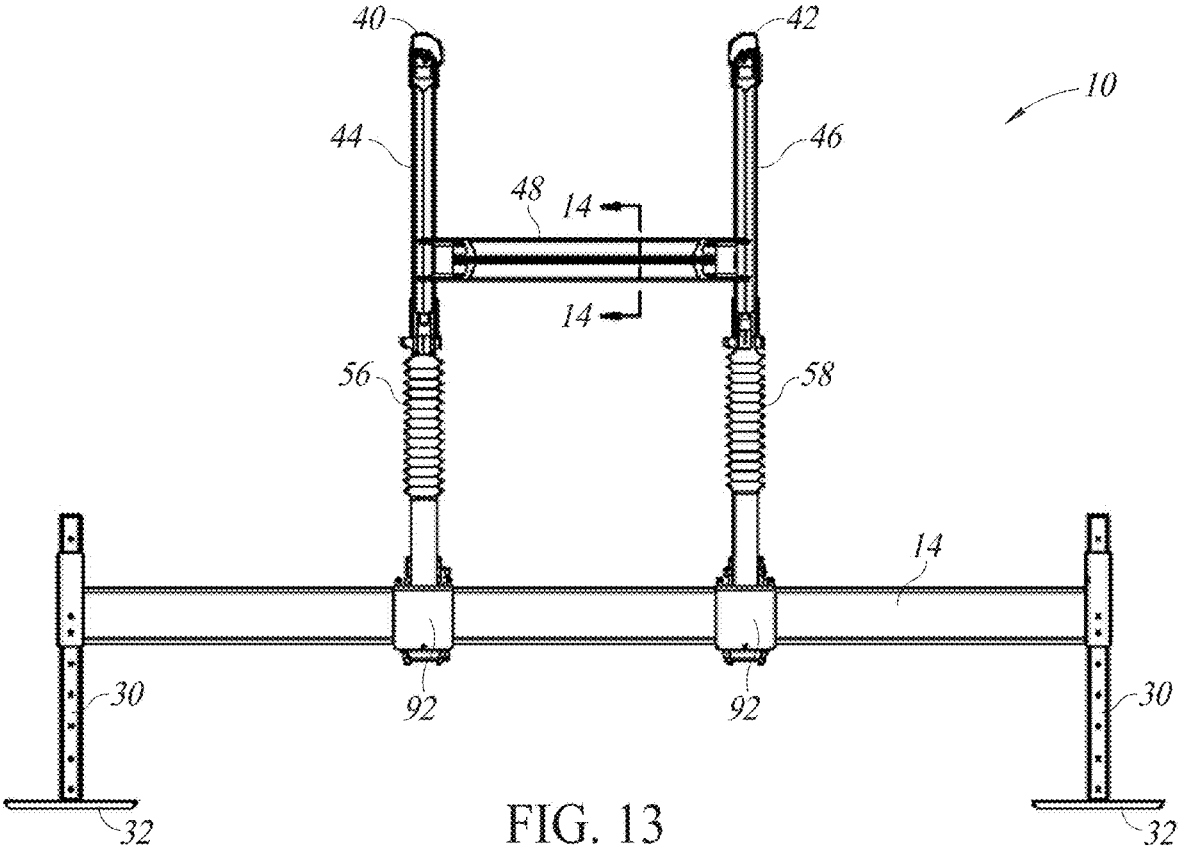
FIG. 13 is a rear elevational view of the lift of FIG. 1.
Figure 14:
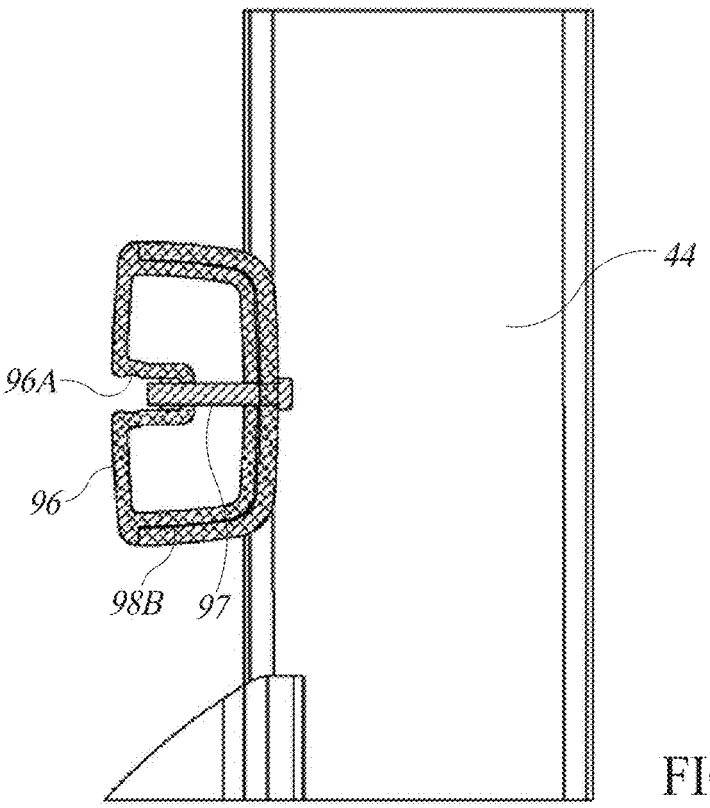
FIG. 14 is a cross sectional view of a connector member of the lift of FIG. 1.
Figure 15:
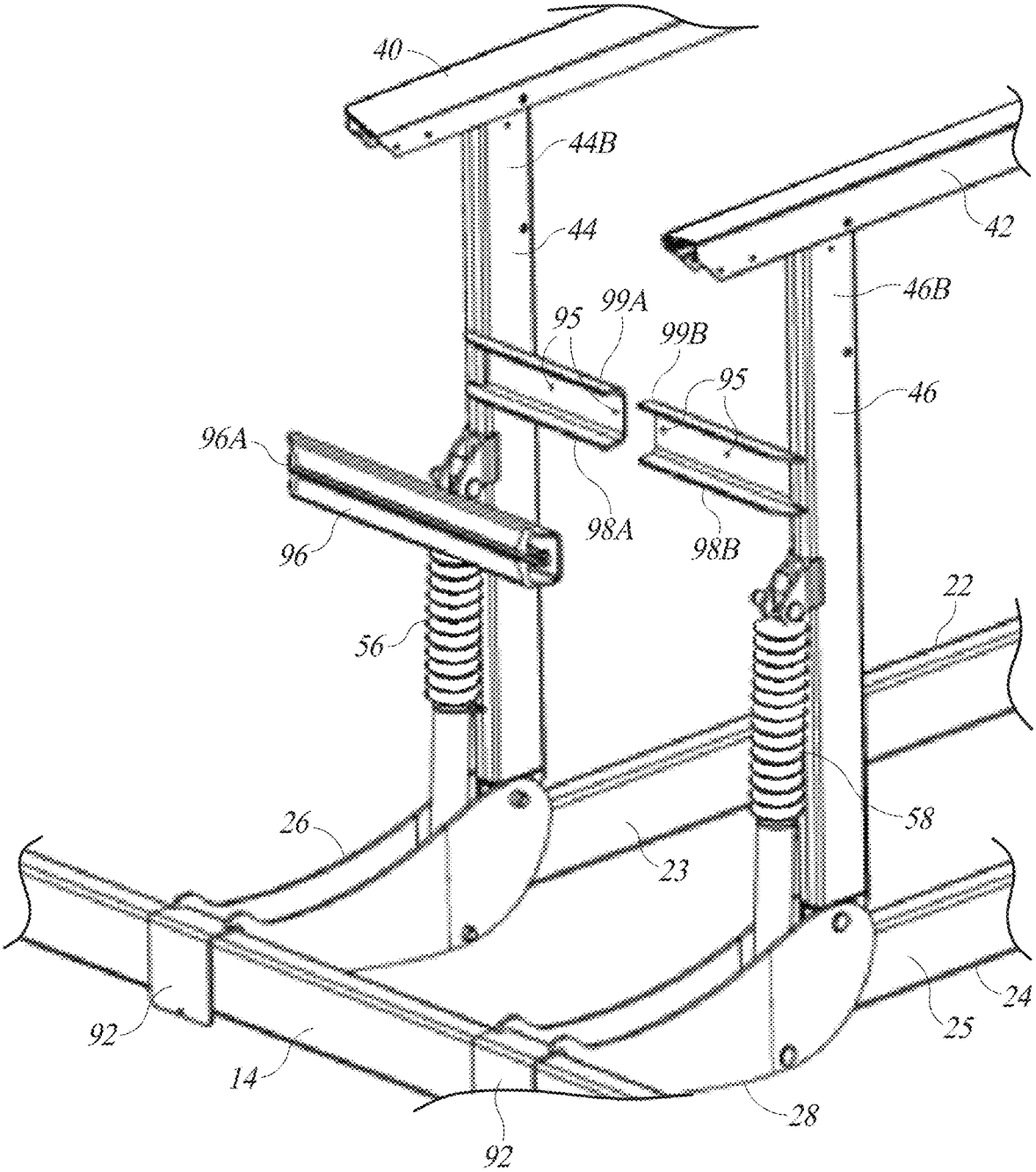
FIG. 15 is a partially exploded view of the connected member of FIG. 14.

In the preferred embodiment, the rearward connector member 48 and the forward connector member 54, which extend between the left and right side rearward lifting arms 44 and 46, and extend between the left and right side forward lifting arms 50 and 52, respectively, each include a tube 96 adjustably connected to a left side channel member 98A and a right side channel member 98B. The rearward connector member 48 is illustrative of the construction of both the rearward and forward connector members 48 and 54, and is best understood by reference to FIGS. 13, 14, and 15. The use of the tube 96 and channel members 98A and 98B allows the rearward and forward connector members 48 and 54 to better handle torsion, which assists in synchronizing movement of the left and right side lifting arms 44, 46, 50, and 52 when raising and lowering the bunks 40 and 42. It further allows the length of the rearward and forward connector members 48 and 54 to be adjusted to accommodate desired changes in the lateral spacing between the left and right side bunks 40 and 42 to accommodate a particular size and style of watercraft.

The left side channel member 98A of the rearward connector member 48 is a generally U-shaped rearwardly opened channel with an end portion rigidly attached to the left side rearward lifting arm 44 and extends laterally inward toward the right side rearward lifting arm 46 and terminates in a free end portion 99A. The right side channel member 98B of the rearward connector member 48 is a generally U-shaped rearwardly opened channel with an end portion rigidly attached to the right side rearward lifting arm 46 and extends laterally inward toward the left side rearward lifting arm and terminates in a free end portion 99B. The distance between the free end portions 99A and 99B is determined by the desired lateral spacing between the left and right side bunks 40 and 42, with the minimum lateral spacing of the bunks being when the free end portions 99A and 99B touch. To adjust the lateral spacing between the left and right side bunks, the longitudinal left and right side beams 22 and 24 are laterally moved to a position along the rearward and forward lateral beams 14 and 18 that provides the desired lateral spacing between the bunks.

To maintain that lateral spacing during normal use of the watercraft lift 10, the tube 96 is positioned within the rearwardly open channels of both the left and right side channel members 98A and 98B, so that it longitudinally extends along at least a portion of both channel members. To secure the tube 96 to the channel members 98A and 98B, the tube 96 has a longitudinally extending, rearwardly facing recess 96A with the inward wall portion of the recess and the forward wall of the tube having a series of laterally spaced apart through holes sized to receive a bolt 97 therethrough. Each of the left and right channel members 98A and 98B has two laterally spaced apart through holes 95. With the tube and channel members assembled, a plurality of bolts 97 are extended through the through holes of the tube and the corresponding through holes of the left and right channel members and tightened. If subsequently a different lateral spacing between the bunks 40 and 42, the bolts 97 are loosened for both the rearward and forward connector members 48 and 54 to allow lateral movement of the longitudinal left and right side beams 22 and 24 as needed to provide a different desired lateral spacing between the bunks. The width of the recess 96A is sized to capture the nut of the bolt 97 and prevent the nut from rotating and the bolt is tightened or loosened, thus requiring only one wrench to set or change the lateral spacing of the bunks. This tube and channel construction avoids the jamming typically occurring when using telescoping tubes. It should be understood that a similar alternative arrangement for the connector member may use left and right side tubes attached to the left and right side lifting arm, respectively, with a central channel that extends along at least a portion of both of the left and right side tubes and is securable in the manner described above to both to maintain the desired lateral spacing of the bunks 40 and 42. The recess 96A may also be configured to accept a decorative trim strip (not shown) to hide the holes of the tube 96 and the bolts 97.

Figure 16:
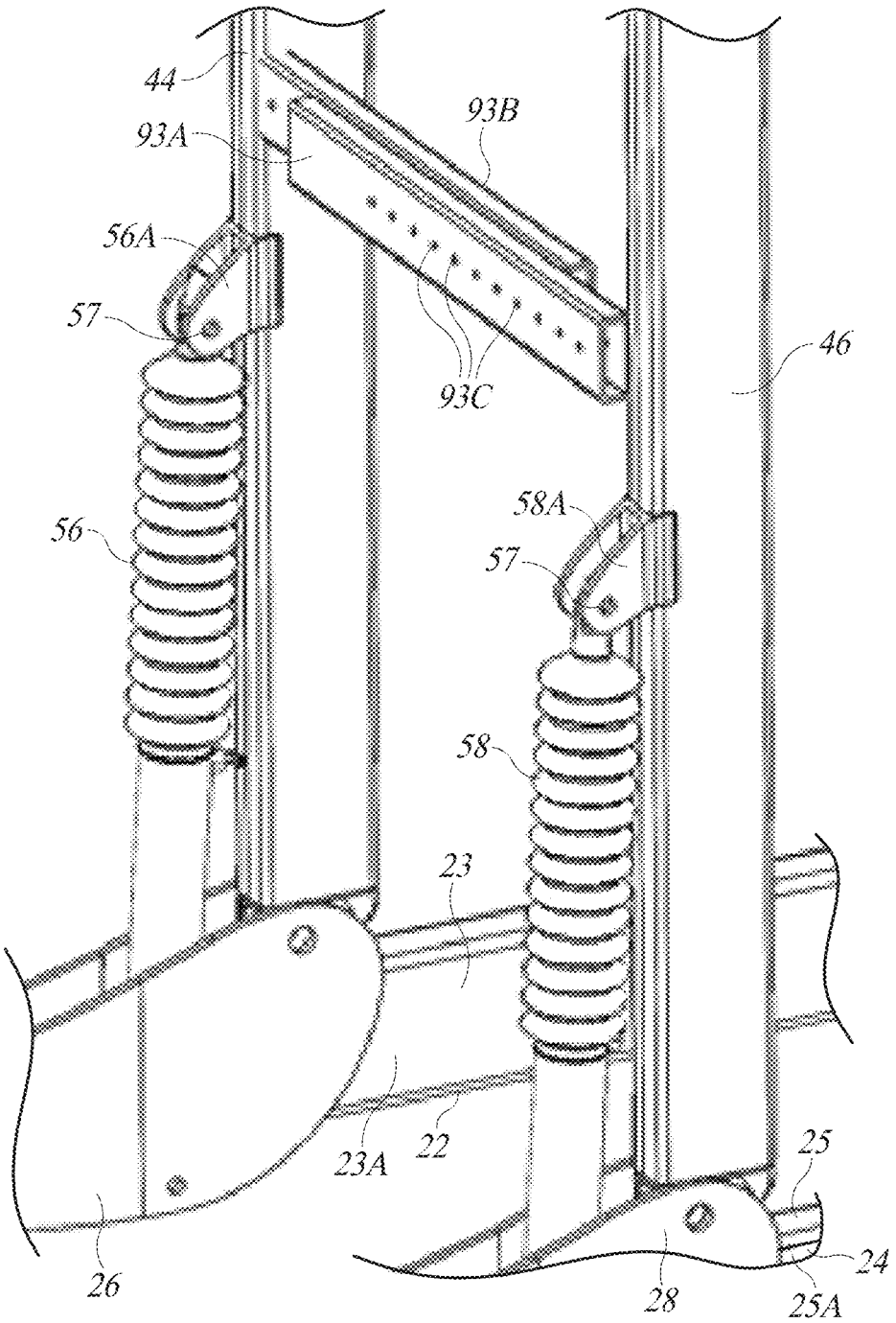
FIG. 16 is a fragmentary view of an alternative connector member.

An alternative embodiment for adjusting the lateral spacing between the bunks 40 and 42 is shown in FIG. 16. The rearward connector member 48 is illustrative of the construction of both the rearward and forward connector members 48 and 54. In this embodiment, the rearward connector member 48 and the forward connector member 54, which extend between the left and right side rearward lifting arms 44 and 46, and extend between the left and right side forward lifting arms 50 and 52, respectively, each comprise a left side arm 93A and a right side arm 93B. The left side arm 93A of the rearward connector member 48 is rigidly attached to the left side rearward lifting arm 44 and extends laterally inward toward the right side rearward lifting arm 46, and the right side arm 93B of the rearward connector member 48 is rigidly attached to the right side rearward lifting arm 46 and extends laterally inward toward the left side rearward lifting arm. The left and right side arms are sufficiently long to overlap at all desired lateral spacings between the bunks 40 and 42. To secure the left and right side arms 93A and 93B together to maintain that lateral spacing of the bunks during normal use of the watercraft lift 10, each of the left and right side arms 93A and 93B has a series of laterally spaced apart through holes 93C sized to receive bolts (not shown) through corresponding pairs of through hole of the left and right side arms. The preferred embodiment is more desirable since various lengths of connector tubes 96 can be used for a wider range of adjustment without cutting.

The forward saddles 94 at the ends of the forward end portions 23B and 25B of the left and right side forward beam portions 23 and 25 each have a bracket 100, which projects forwardly beyond and upwardly above the forward lateral beam 18 and support a pivot pin 102 extending between two spaced apart flanges Thus, the lower end portions 50A and 52A of the left and right side forward lifting arms 50 and 52 pivot about a pivot axis forward of the forward lateral beam 18.

Hydraulic Actuator Cushion

To reduce the movement of the watercraft lift 10, and hence the water craft supported on the left and right side bunks 40 and 42, when the watercraft lift 10 is reaching the fully raised position shown in FIGS. 1 and 2 in response to operation of the left and right side hydraulic actuators 56 and 58, the hydraulic actuators have a hydraulic cushion that slows the end-of-stroke movement of the hydraulic actuators as the watercraft lift nears the fully raised position. For watercraft lifts that go over-center in the up position, the boat accelerates in speed as the lift nears the top position, which causes the boat to abruptly stop, which causes the lift to have forward/rearward movement.

There are several means to create a hydraulic cushion, with many designs being complex using springs and valves which adds significant cost, and increases failure risk. In the preferred embodiment of FIG. 1, for example, an as illustrated in FIGS. 48A-48F, an upper port of the hydraulic actuator is positioned such that the flow restricting piston ring 172 covers an upper port 170 with approximately 0.3" remaining in the stroke. With the upper port covered, the fluid is forced to bypass through the flow restricting piston ring in the piston. This embodiment provides the cushion feature with little to no additional cost. An optional check valve may be used to prevent fluid from flowing from the lower part of the cylinder to the top section, which increases lowering speeds for the first approx. 0.3 inches when the upper port is uncovered.

Legs

Figure 9A:
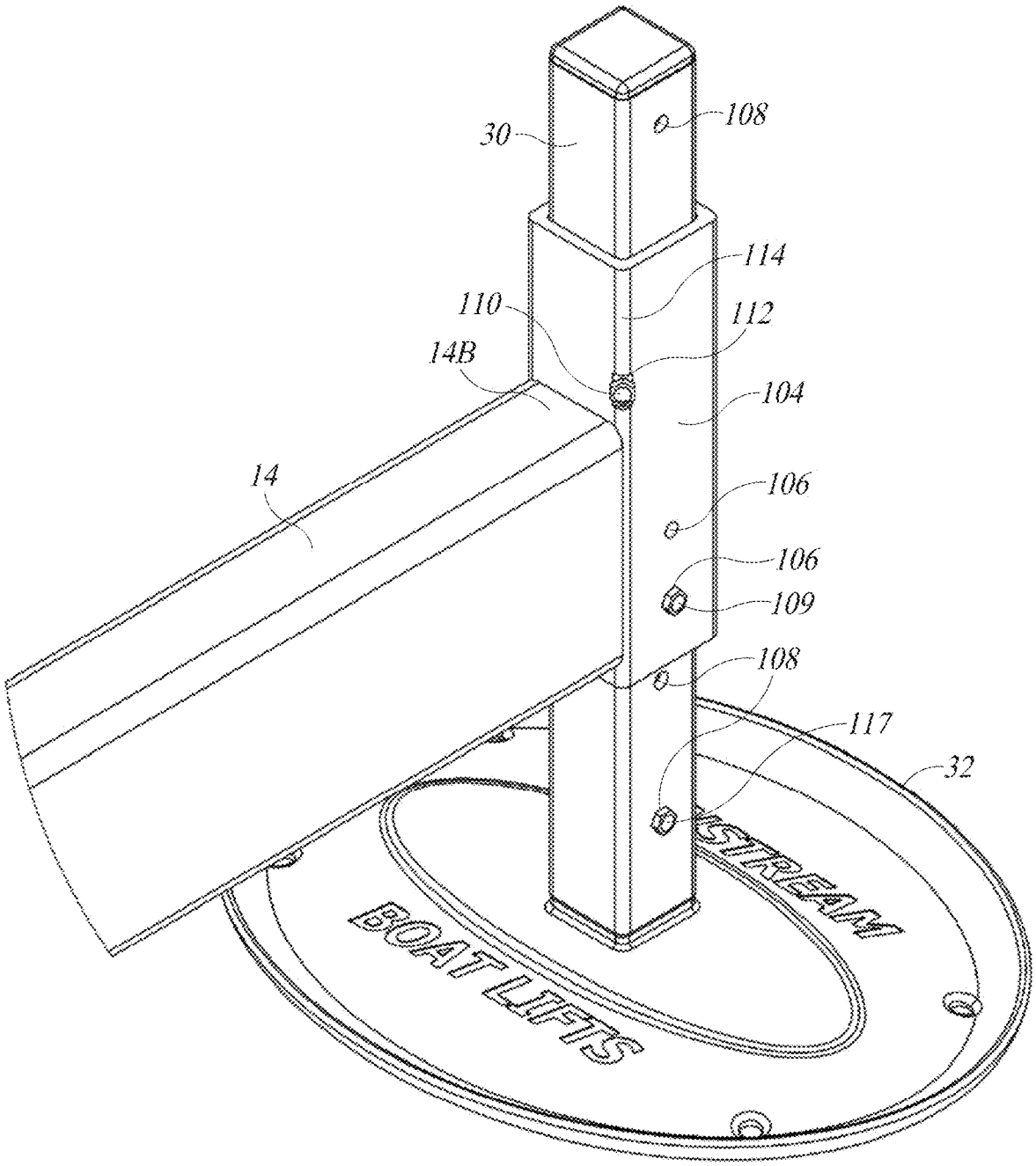
FIG. 9A is an enlarged view of the encircled area of FIG. 9 showing a foot.

As previously noted, the lower frame 12 is supported by four legs 30 with the foot 32 attached to a lower end of the leg for positioning on the seabed 34. Since the seabed 34 upon which the watercraft lift 10 is positioned is often not completely level, the left end portion 14A and the right end portion 14B of the rearward lateral beam 14, and the left end portion 18A and the right end portion 18B of the forward lateral beam 18, each has an upright leg socket 104 rigidly attached thereto (as illustrated in FIGS. 9 and 9A), through which one of the legs 30 extends, permitting the leg to slide up and down within the leg socket during setting up the watercraft lift 10. The leg socket 104 has a pair of through holes 106 spaced apart to correspond to a selected pair of a plurality of through holes 108 in the leg 30, with the holes sized to receive bolts 109 to secure the leg within the leg socket with a desired extension of the leg out the lower end of the leg socket. The amount of the extension of each of the four legs 30 out of the four leg sockets 104 is selected to position each of the feet 32 on the seabed 34 while maintaining the lower frame 12 with a horizontal orientation.

Set Screw

In addition to the use of bolts to secure each of the legs 30 in the selected position within the leg socket 104, as shown in FIG. 9A, a set screw 110 is located in a threaded aperture 112 located in a corner 114 of the leg socket 104 to provide the maximum number of threads in the aperture in the leg socket corner receiving the set screw, and pushes the leg against the two opposite, perpendicularly arranged faces of the inside of the leg socket (i.e., into the interior corner opposite the aperture defined by these interior faces), which secures the leg within the leg socket in both laterally and longitudinally. This assists in reducing the movement between the leg and the leg socket, to provide greater stability and reduced movement of the watercraft lift 10 when in use. This and other features add stiffness to the watercraft lift 10 to reduce movement of the watercraft on the lift when the watercraft lift is operating and also when stationary.

Bolt Trick

Figure 41:
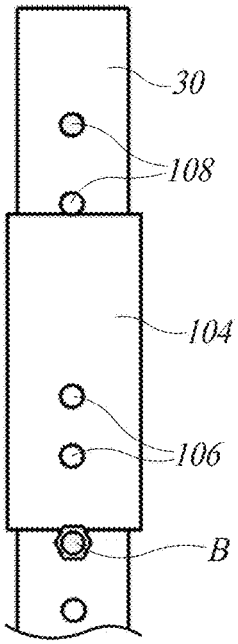
FIG. 41 is a side elevational view of a leg and leg socket showing an alignment process.

As shown in FIG. 41, the lower through hole 106 of the leg socket 104 is positioned such that if the shaft of a bolt B is inserted into the through hole 108 of the leg 30 immediately below the leg socket, and the leg socket is moved down into contact with the bolt B, the through hole of the leg socket will align with the through hole of the leg immediately above the through hole of the leg into which the shaft of the bolt was inserted. With the through holes of the leg socket and the leg so aligned, the bolt 109 shown in FIG. 9A can be easily inserted. The same methodology may be used on most any mating telescoping shapes.

Drain Holes

Figure 9B:
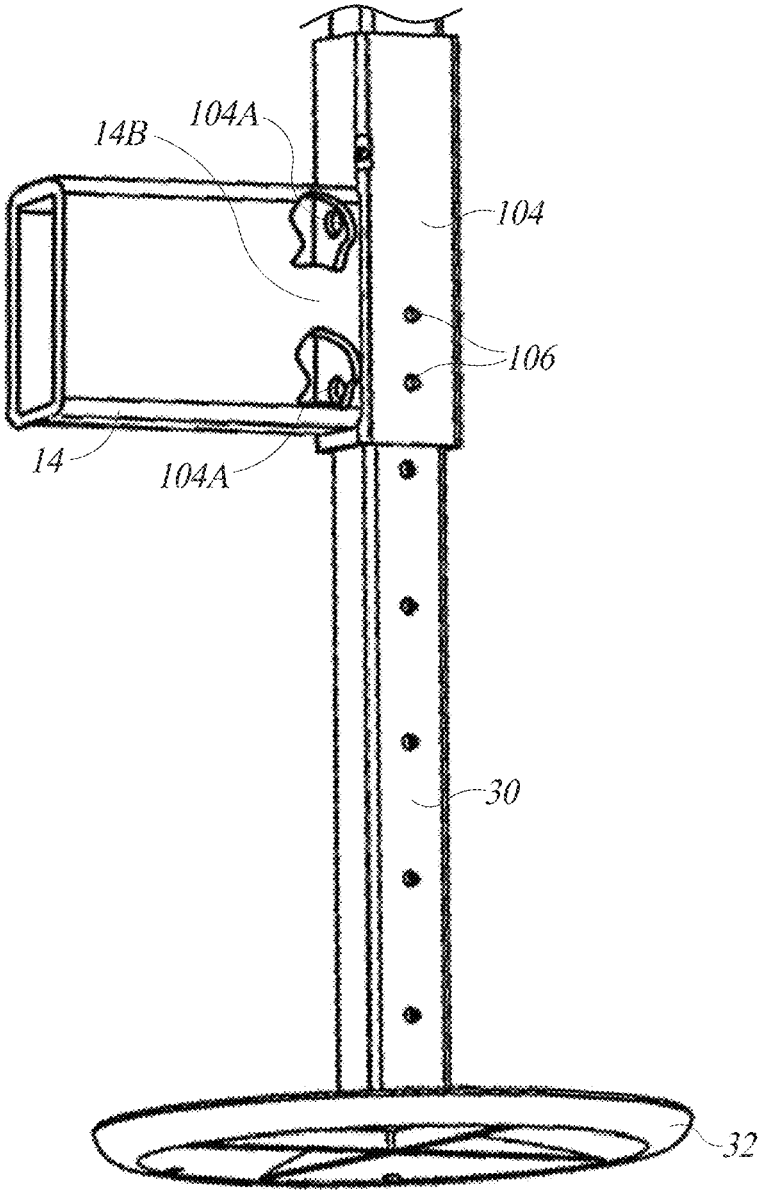
FIG. 9B is a fragmentary view of a crossbeam of the lift of FIG. 1 showing the drain holes.

As shown in FIG. 9B, each of the four leg sockets 104 has a pair of drain holes 104A which are in fluid communication with an open end of the one of the left end portion 14A and the right end portion 14B of the rearward lateral beam 14, and the left end portion 18A and the right end portion 18B of the forward lateral beam 18, to which it is attached, such that water within the rearward and forward lateral beams drains out through the drain hole and into the interior of the leg socket for discharge. This reduces or eliminates the machining of the large rearward and forward lateral beams to accommodate the drainage of water from within the lateral beams and provides a cleaner look to the watercraft lift 10.

Foot

Figure 17:
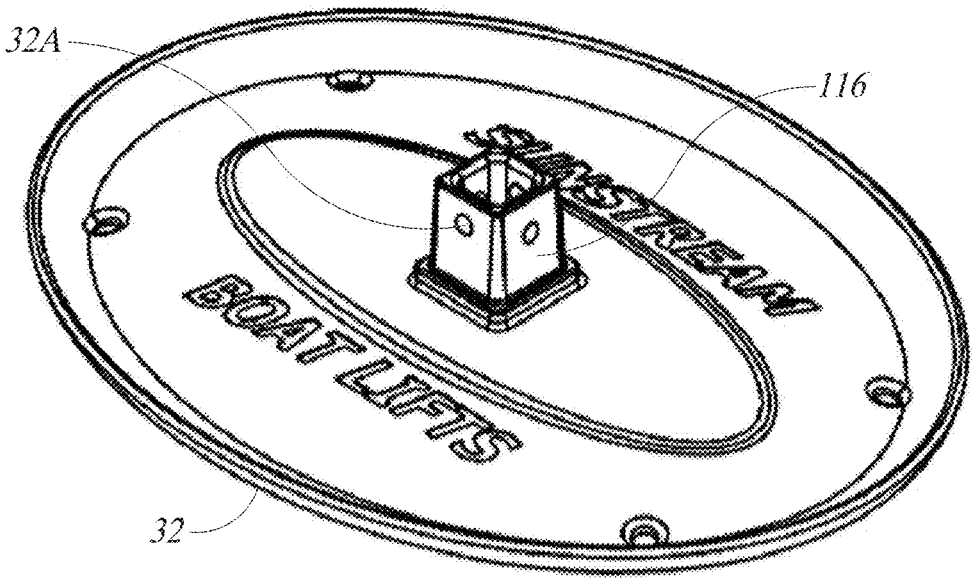
FIG. 17 is an isometric top view of the top of a foot of the lift of FIG. 1.
Figure 18:
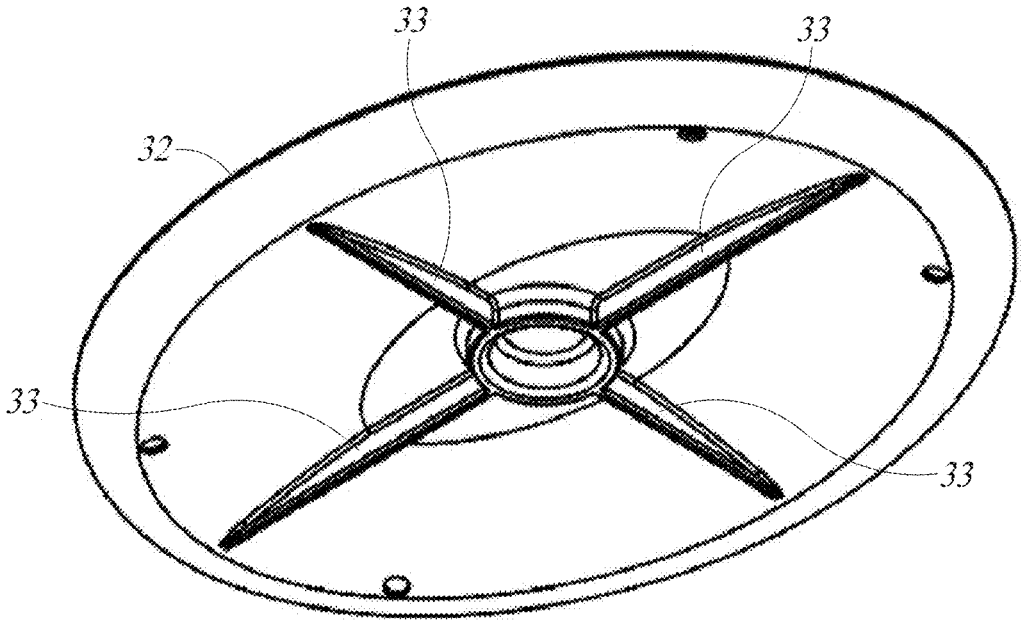
FIG. 18 is an isometric bottom view of the foot of FIG. 17.
Figure 18A:
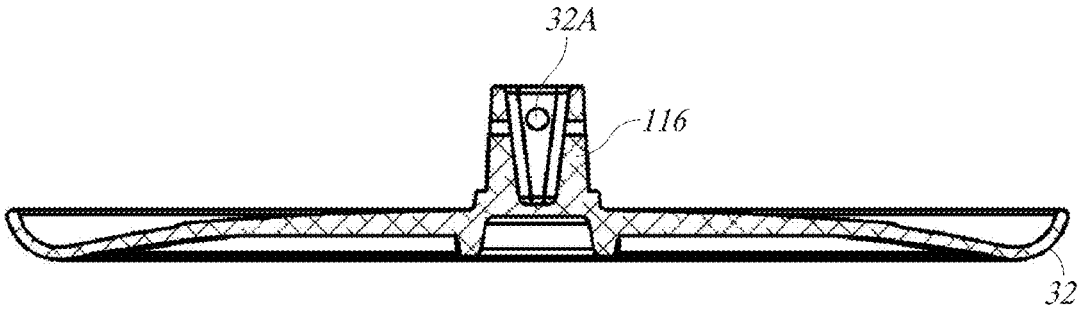
FIG. 18A is a cross-sectional view of the foot of FIG. 17.
Figure 19:
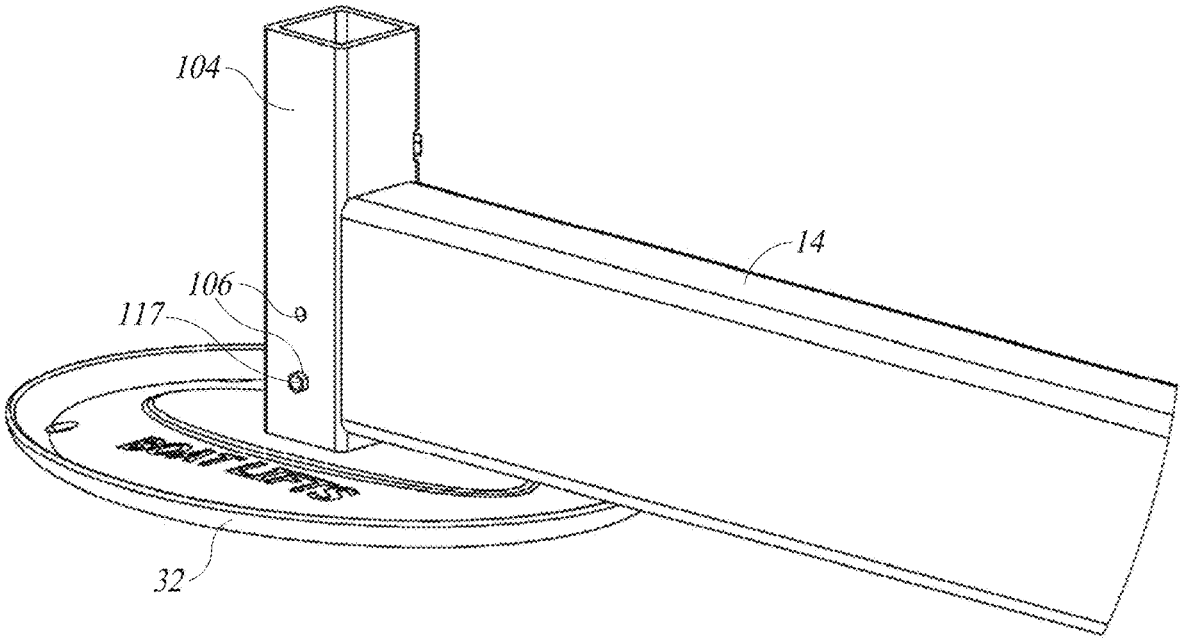
FIG. 19 is a fragmentary view of a lateral beam and foot of the lift of FIG. 1.
Figure 20:
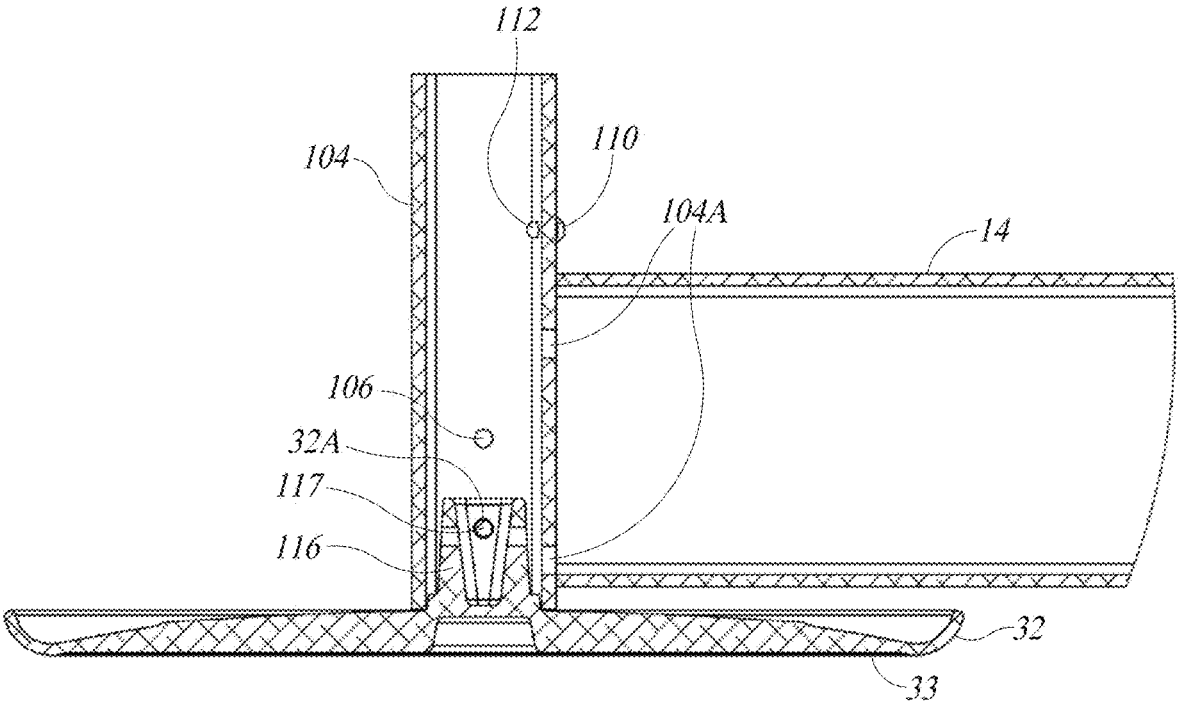
FIG. 20 is cross-sectional view of a lateral beam and foot of FIG. 19.
Figure 42:
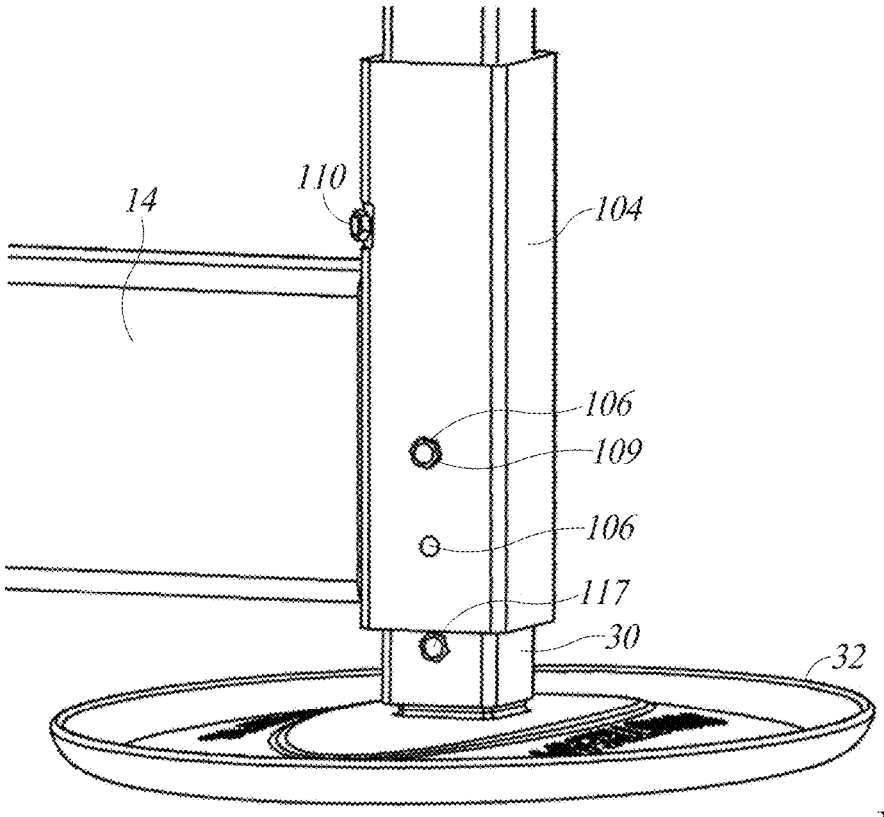
FIG. 42 is a fragmentary view of a lateral beam, leg, leg socket and foot of the lift of FIG. 1.
Figure 43:
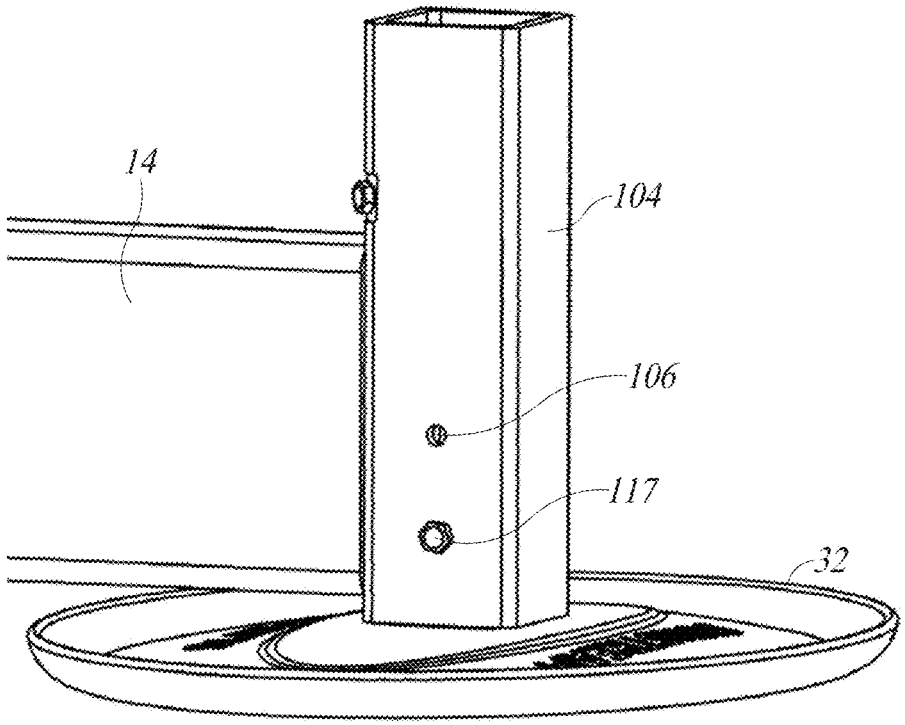
FIG. 43 is a fragmentary view of a lateral beam, leg socket and foot of the lift of FIG. 1 without using the leg.

As shown in FIGS. 17, 18, and 18A, in the preferred embodiment the foot 32 is a casting with structural ribbing 33, and has an upwardly projecting foot connection stud or insert member 116 sized to be received within a lower end portion of the leg 30 and be connected thereto with a bolt or pin 117 extending through a through hole 32A in the foot connection insert member and into the lower one of the through holes 108 of the leg (see FIG. 9A). To lower the lower frame 12 closer to the seabed 34 so as to allow use of the watercraft lift 10 in shallower water as shown in FIGS. 19 and 20, or simply to lower the cost, the legs 30 may be eliminated and the foot connection insert members 116 inserted into the lower ends of the leg sockets 104 and be connected thereto with bolts or pins 117 extending through the lower ones of the through holes 106 of the leg sockets and through hole 32A in the foot connection insert member, as shown in FIGS. 19 and 20. The advantage of this approach is shown by a comparison of the use of the leg 30 inserted into the leg socket 104 as illustrated in FIG. 42 and the use of the foot connection insert member 116 inserted into the leg socket as illustrated in FIG. 43. The stud 116 may be cross drilled to enable two options for bolt elevation, which can enable geometry for the 'bolt trick', which uses a bolt shank temporarily in the first unused exposed hole under the leg sleeve, but also allows for geometry that enables the foot to bolt directly to the leg sleeve with the foot orientated 90 degrees without a leg to save water depth.

Figure 24:
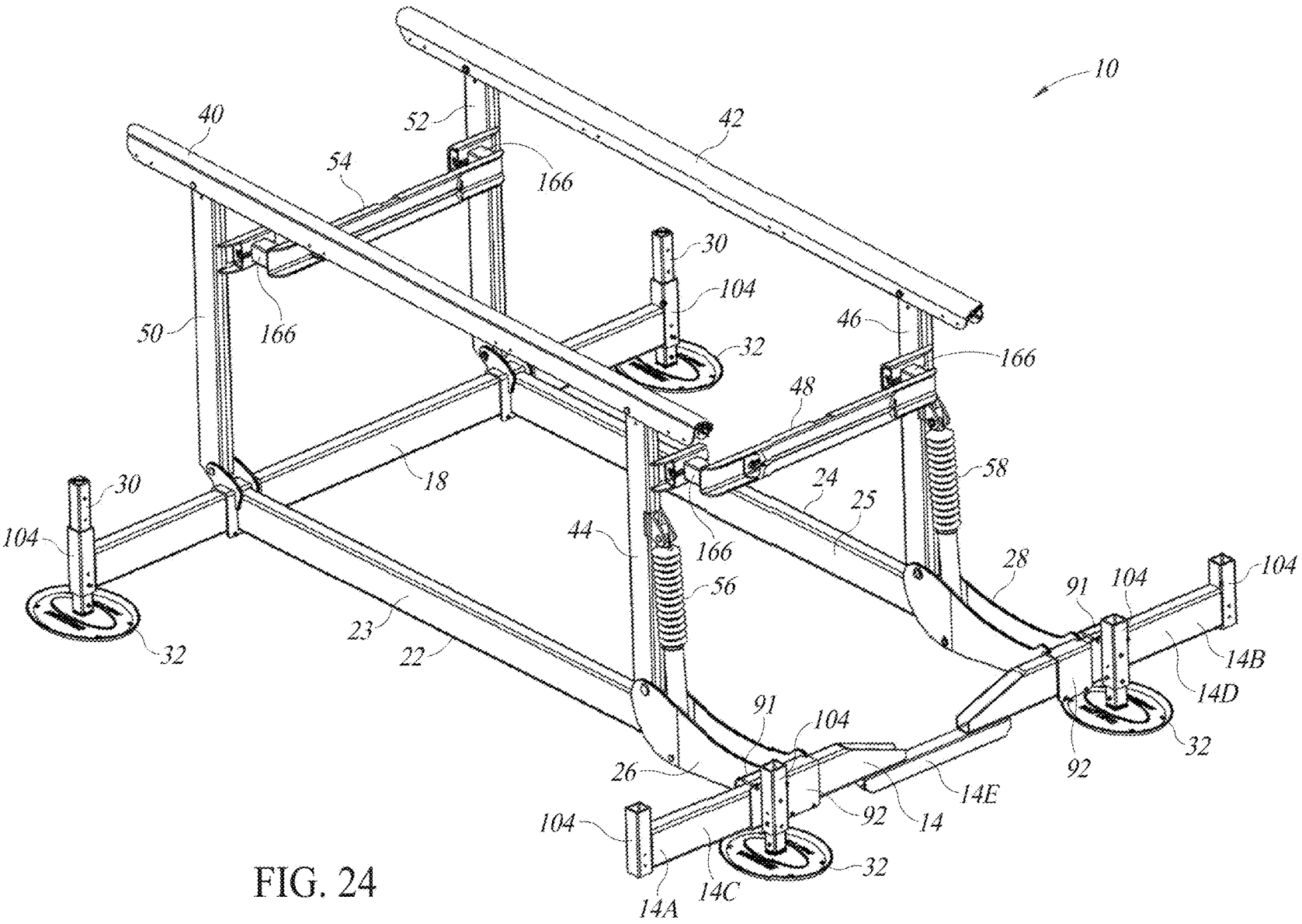
FIG. 24 is an isometric view of a shallow water embodiment of the lift of FIG. 1 shown in the fully raised position.

A similar result may be achievable in an alternative embodiment shown in FIG. 24 where left and right side rearward saddles 91 are laterally movably attached to the left end portion 14A and right end portion 14B, respectively, of the rearward lateral beam 14, and each saddle has the leg socket 104 rigidly attached thereto with the rearward foot connection insert member 116 inserted into the leg socket, rather than into the leg sockets connected to the outer ends of the rearward lateral beam 12. This permit the load of watercraft lift 10 to be transmitted to the seabed 34 at more inward locations and applies less torque to the left and right end portions 14A and 14B of the rearward lateral beam 14.

In yet another embodiment not illustrated, the rearward lateral beam 14 may be eliminated and the leg sockets 104 attached directly to the rearward end portions 26A and 28A of each of the left and right side support members 26 and 28. This is possible by the elimination of twist from the loading of the hydraulic actuators 56 and 58 as a result of the left and right side rearward lifting arms 44 and 46, and the left and right side hydraulic actuators 56 and 58 having their first and second rotational planes in coplanar alignment.

In an additional embodiment not illustrated, the support members 26 and 28 may be eliminated, and the leg sockets 104 connected directly to the rearward end portions 23A and 25A of the left and right rearward beam portions 23 and 25.

Figure 21:
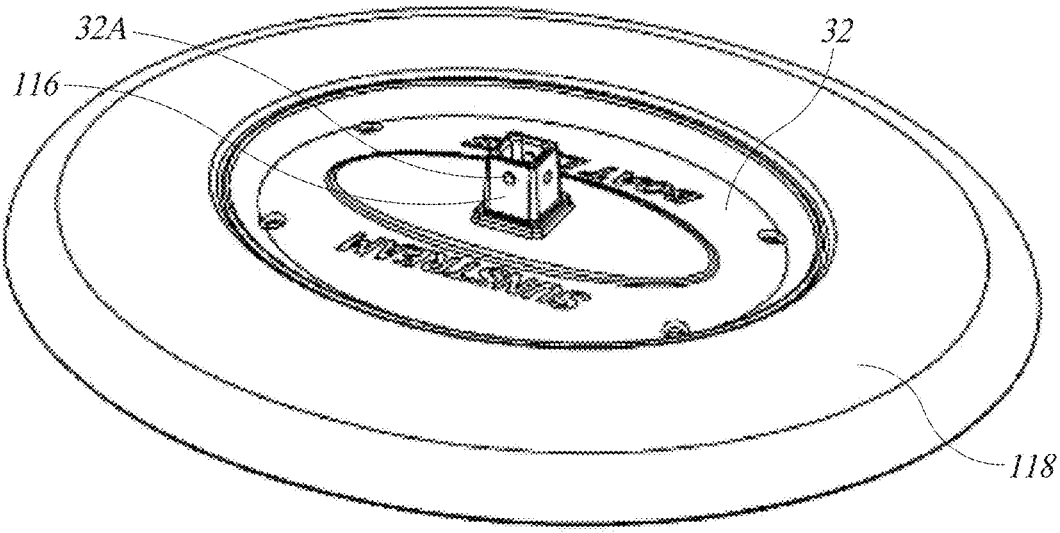
FIG. 21 is an isometric view of the foot of the lift of FIG. 1 with a mud ring attached.
Figure 22:
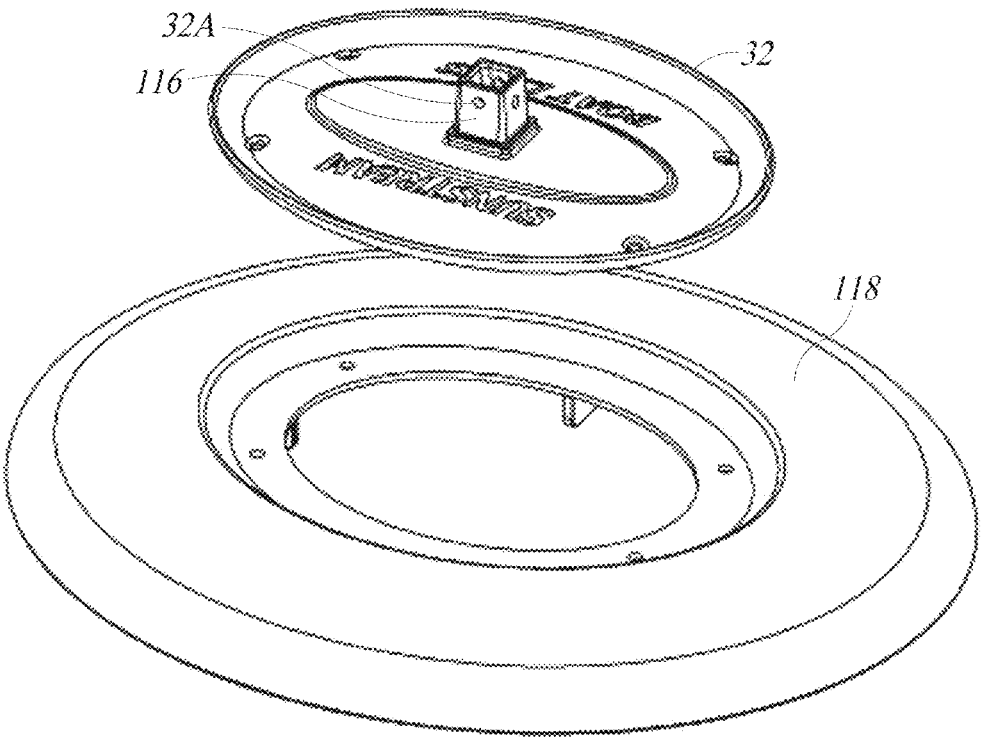
FIG. 22 is an exploded view of the foot and mud ring of FIG. 21.

As shown in FIGS. 21 and 22, a separate perimeter mud ring 118 may be bolted to the foot 32 to provide a greater surface area for engaging the soft seabed 34 using bolts (not shown) extending through aligned bolt receiving apertures 119A-119D in the foot 32 and 121A-121D in the mud ring 118, respectfully.

Figure 23:
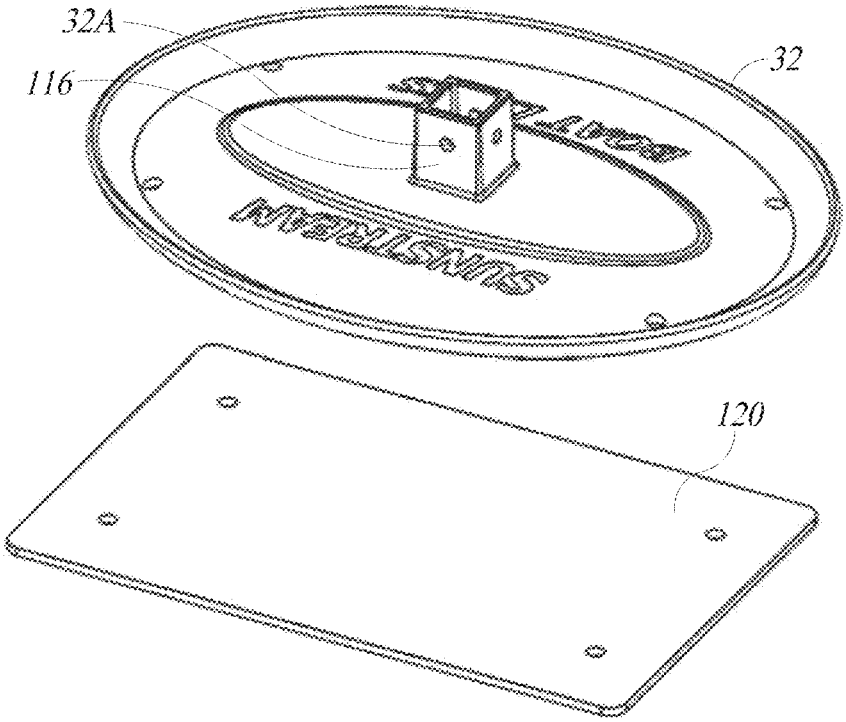
FIG. 23 is an exploded view of the foot and mud ring of FIG. 21 and a reinforcing plate attachable thereto.

A reinforcing plate 120 shown in FIG. 23 may be bolted onto the foot 32 for installations where the seabed 34 is a hard bottom and where the seabed is steep, both of which tend to put additional stress on the foot, using bolts (not shown) extending through aligned bolt receiving apertures 119A-119D in the foot 32 and 121A-121D in the reinforcing plate 120, respectively.

Shallow Water Configuration

Figure 24A:
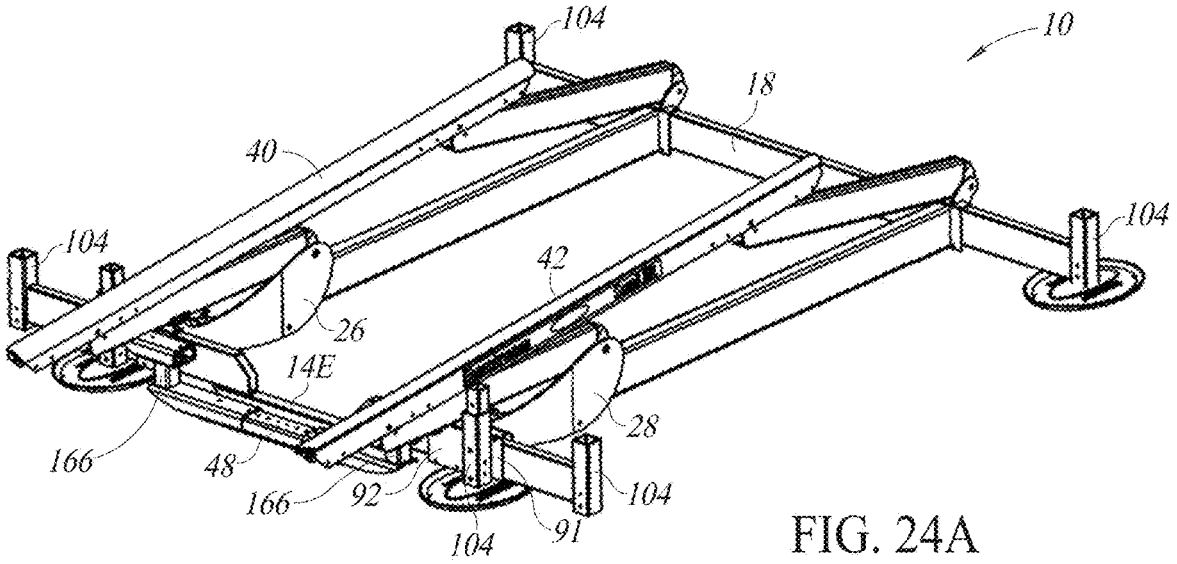
FIG. 24A is a isometric view of the lift of FIG. 24 shown in the fully lowered position embodiment.
Figure 24B:
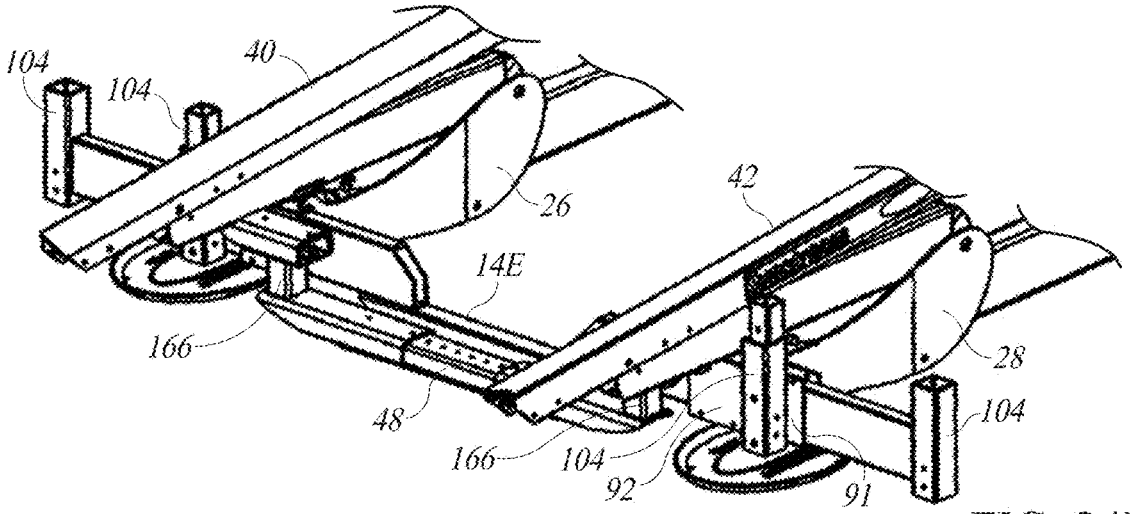
FIG. 24B is a fragmentary view of the rearward portion of the lift of FIG. 24.
Figure 24C:
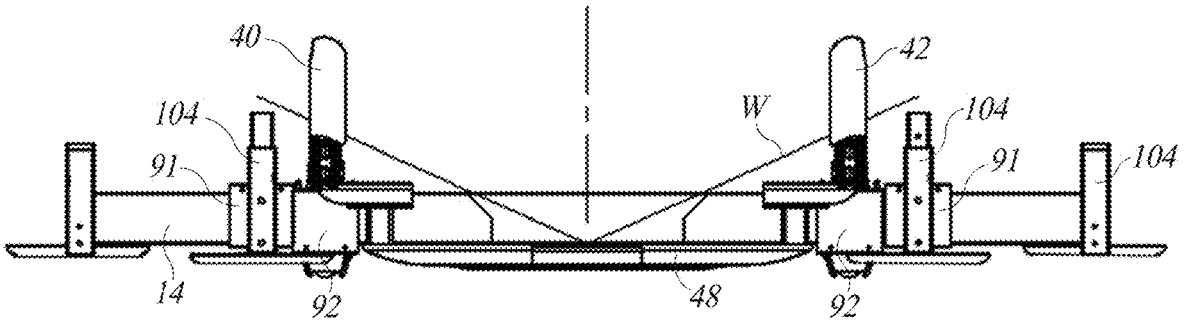
FIG. 24C is a rear elevational view of the lift of FIG. 24 in the fully lowered position.
Figure 25:
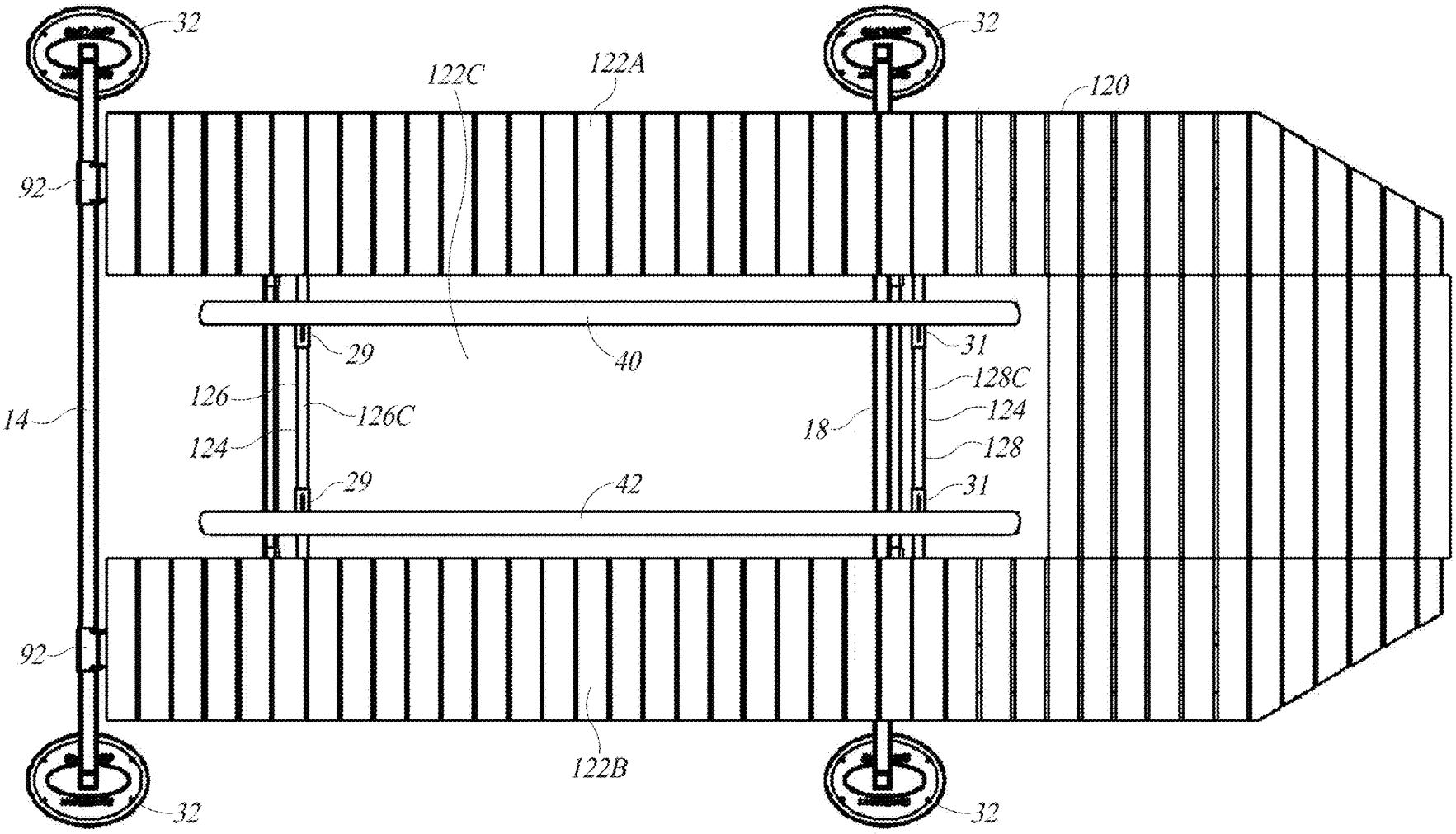
FIG. 25 is a top plan view of an alternative embodiment of the lift of FIG. 1 having a platform.
Figure 26:
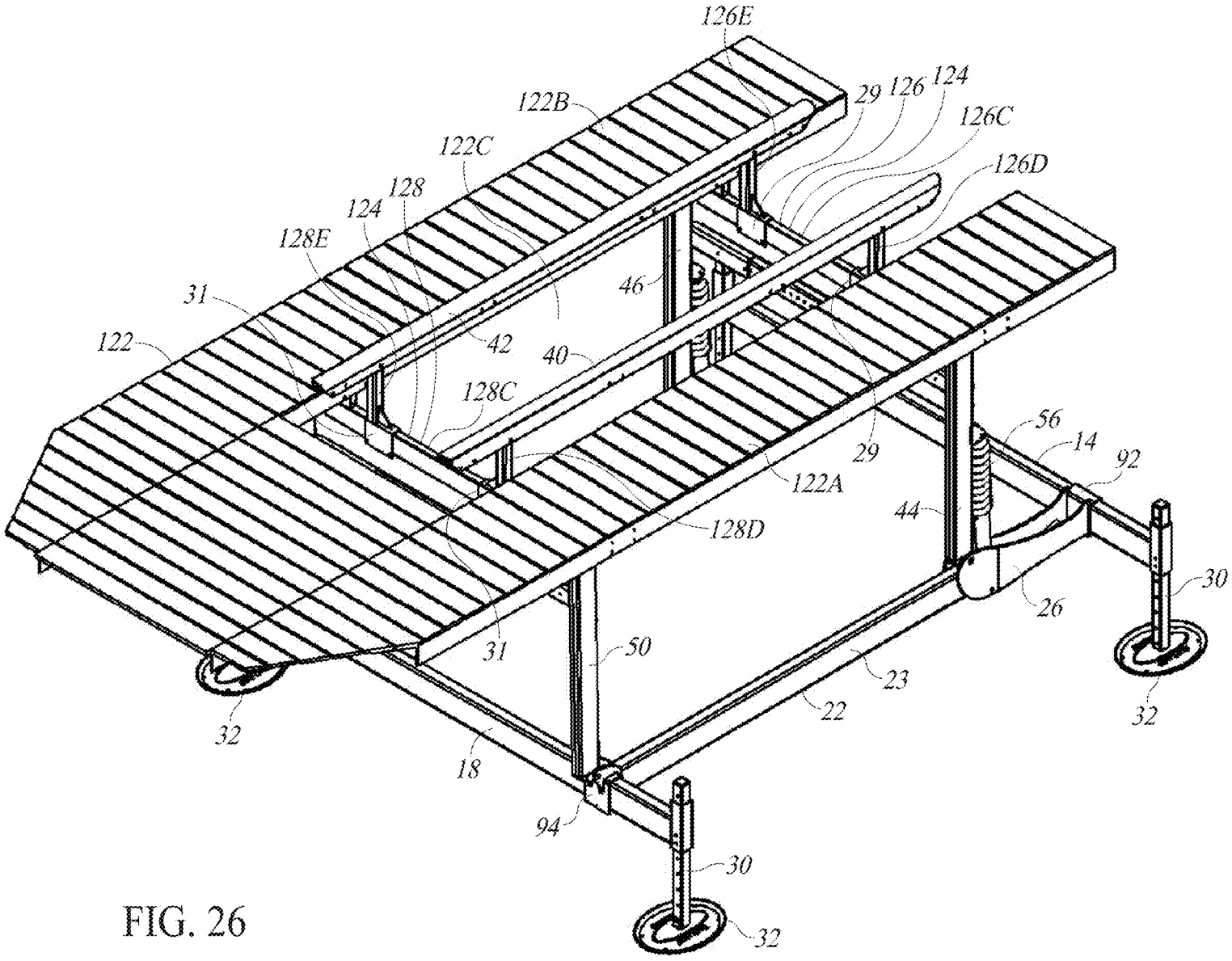
FIG. 26 is a left side isometric view of the embodiment of FIG. 25.
Figure 27:
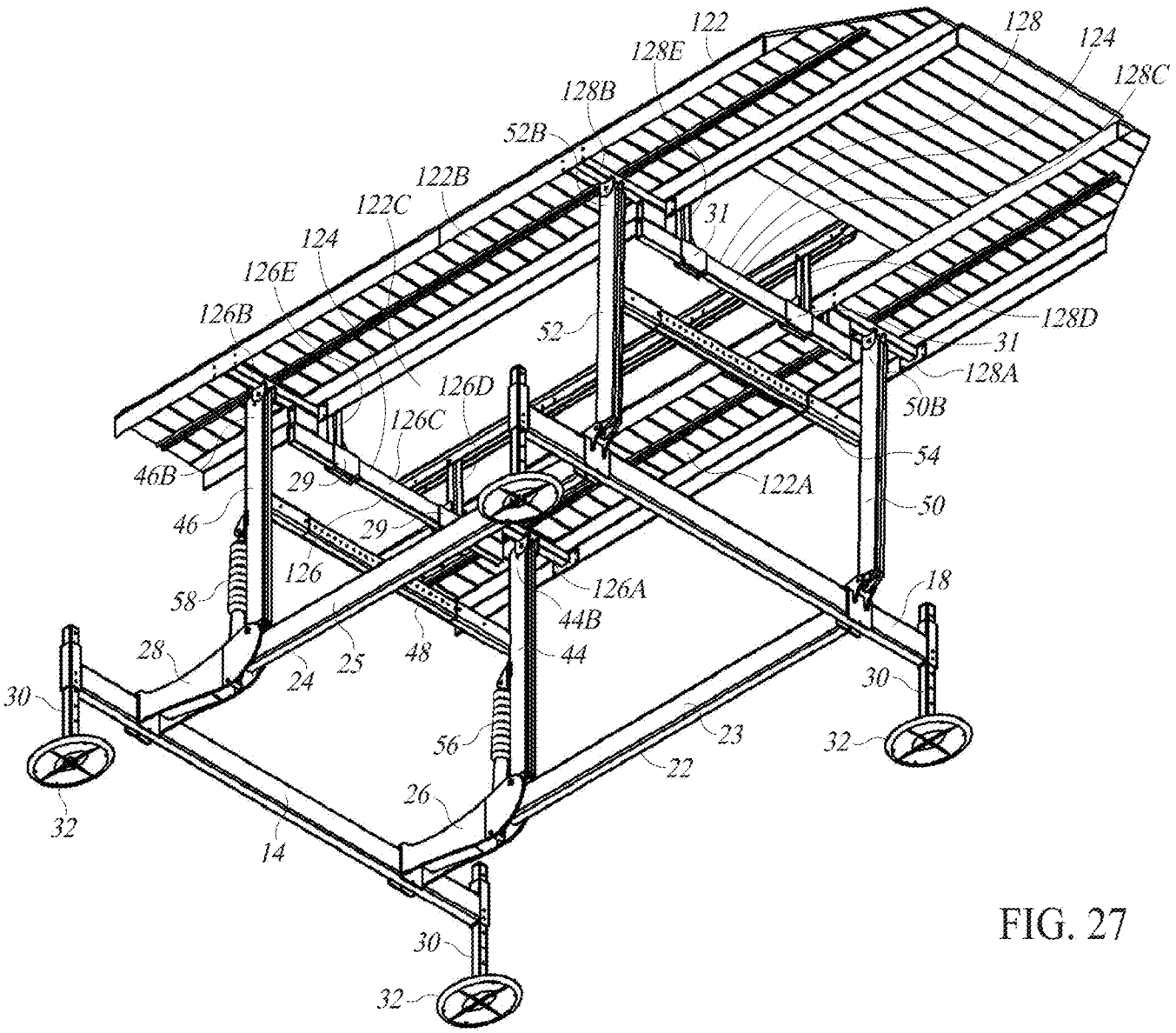
FIG. 27 is a bottom isometric view of the embodiment of FIG. 25.
Figure 28:
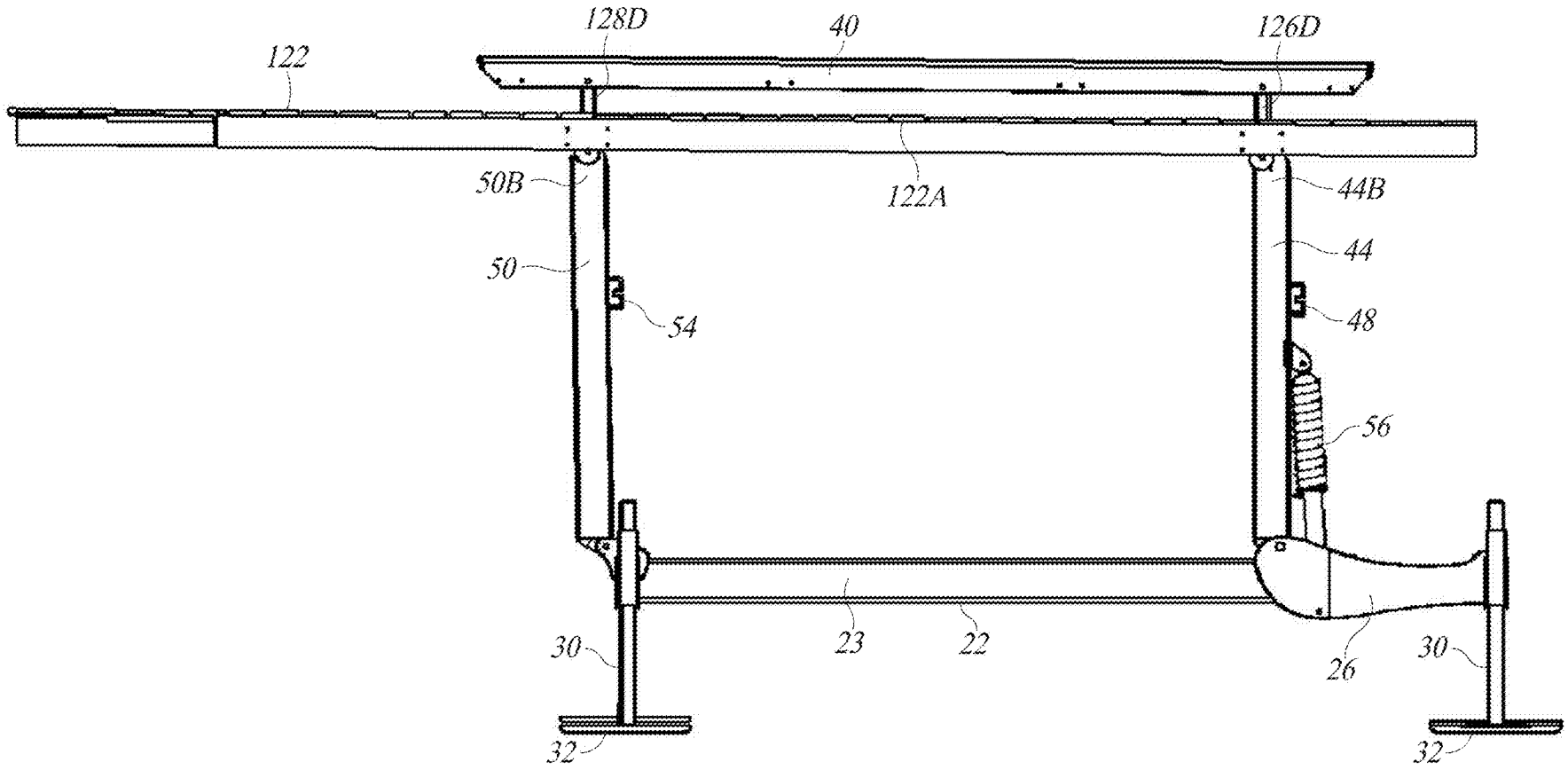
FIG. 28 is a left side elevational view of the embodiment of FIG. 25.
Figure 29:
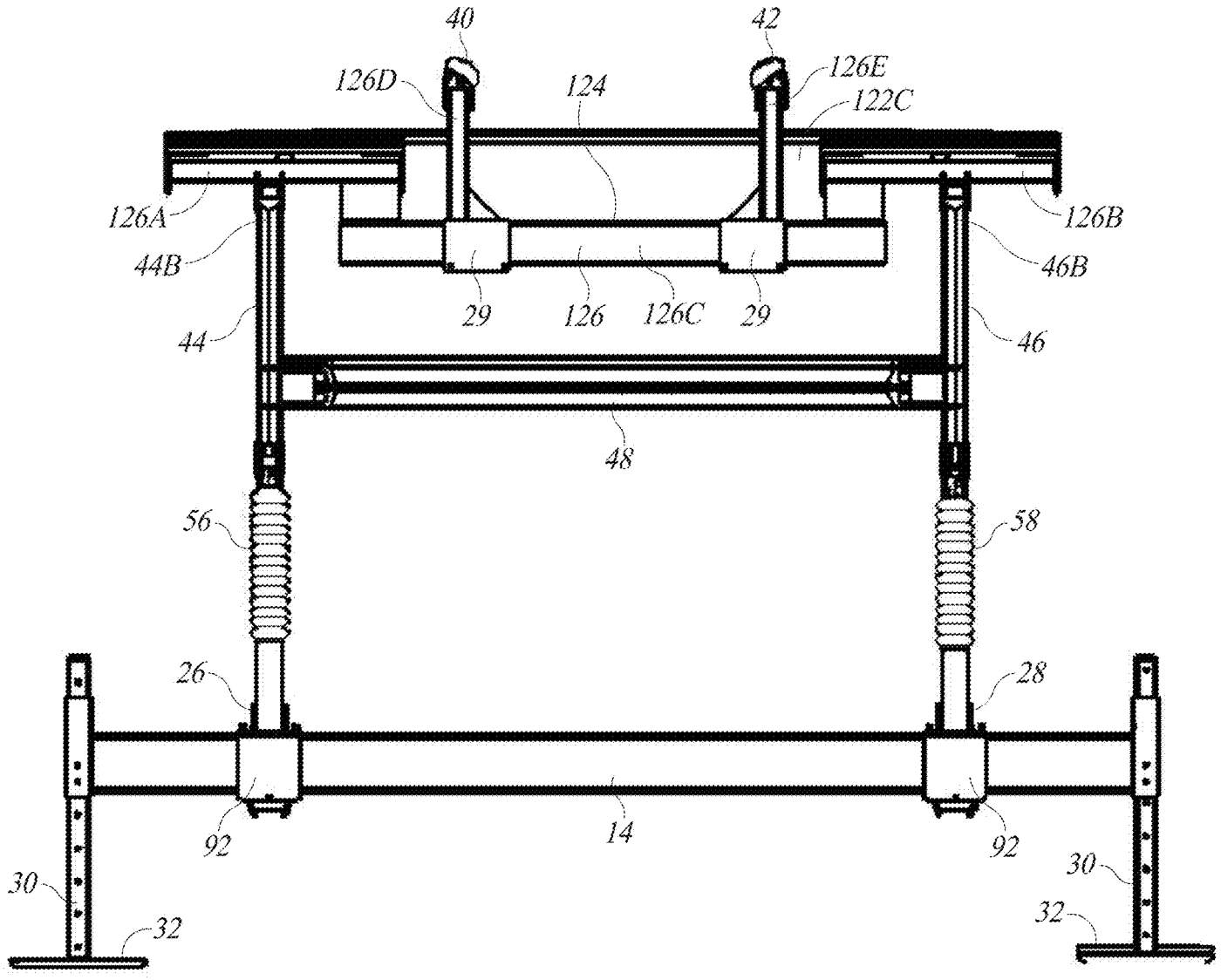
FIG. 29 is a rear elevational view of the embodiment of FIG. 25.

In the embodiment of FIG. 24 for use of the watercraft lift 10 in shallower water, the rearward lateral beam 14 comprise a left side rearward lateral beam portion 14C, a right side rearward lateral beam portion 14D, and a drop down central lateral beam portion 14E positioned between the left and right side rearward lateral beam portions 14C and 14D. The central drop down beam portion 14E lowers the lower frame 12 in the region where the keel of the watercraft "W" passes over when moving onto and off of the watercraft lift. The central drop down beam portion 14E extends between the left and right side rearward lateral beam portions 14C and 14D, but at a lower elevation than the left and right side rearward lateral beam portions, thus providing more clearance and allowing access and egress from the watercraft lift in shallower water than with a straight rearward lateral beam 14. To provide clearance from the keel of the watercraft to the rearward and forward connector members 48 and 54 when the watercraft lift 10 is in the fully lowered position, an offset member 166 is inserted between each of the end portions of the rearward and forward connector members 48 and 54 and the one of the lifting arms 44, 46, 50, and 52 to which attached. This results in the upward most portion of the central portion of the connector members 48 and 50 being at an elevation substantially the same as upward most portion of the drop down central lateral beam portion 14E of the rearward lateral beam 14 when the watercraft lift 10 is in the fully lowered position. FIGS. 24A, 24B, and 24C illustrate for the connector member 48 its position adjacent to the rearward lateral beam 14 when the watercraft lift 10 is in the fully lowered position.

Platform Deck Configuration

As alternative embodiment of the watercraft lift 10 is shown in FIGS. 25-29 having a deck 122, preferably with left and right side catwalks 122A and 122B with a rearwardly opening central aperture 122C therebetween, to provide walking access around the watercraft while being supported by the watercraft lift and to fill in the gap between the watercraft lift a dock (not shown) adjacent to which the watercraft lift is positioned. The deck 122 is supported by a bracket 124 having a Gull wing shaped rearward crossbeam 126 and a Gull wing shaped forward crossbeam 128. The rearward crossbeam 126 has a left side portion 126A pivotally connected to the upper end portion 44B of the left side rearward lifting arm 44, and a right side portion 126B pivotally connected to the upper end portion 46B of the right side rearward lifting arm 46. Similarly, the forward crossbeam 128 has left side portion 128A pivotally connected to the upper end portion 50B of the left side forward lifting arm 50, and a right side portion 128B pivotally connected to the upper end portion 52B of the right side forward lifting arm 52. The left and right side rearward portions 126A and 126B, and the left and right side forward portions 128A and 128B, support the deck 122 at a level above the upper end portions 44B, 46B, 50B and 52B of the left and right side rearward and forward lifting arms 44, 46, 50, and 52.

The rearward crossbeam 126 has a middle portion 126C with a left side post 126D and a right side post 126E attached thereto, and the forward crossbeam 128 has a middle portion 128C with a left side post 128D and a right side post 128E attached thereto. The left and right side posts 126D, 126E, 128D and 128E project upwardly through the central aperture 122C of the deck 122, with the left side bunk 40 pivotally attached to the upper end portion of the left side posts 126D and 128D, and the right side bunk 42 pivotally attached to the upper end portion of the right side posts 126E and 128E to position the bunks above the deck. The lower end portions of each the left and right side posts 126D and 126E has a rearward connector or saddle 29 attached thereto through which the middle portion 126C of the rearward crossbeam 126 extends, permitting the sliding of the rearward saddles 29 along the middle portion of the rearward crossbeam. Similarly, the lower end portions of each the left and right side posts 128D and 128E has a forward connector or saddle 31 attached thereto through which the middle portion 128C of the forward crossbeam 128 extends, permitting the sliding of the forward saddles 31 along the middle portion of the forward crossbeam. This permits sliding of the rearward and forward saddles 29 and 31 along the middle portions 126C and 128C of the rearward and forward crossbeams 126 and 128 during setting up the watercraft lift 10 to a desired lateral spacing between the left and right side bunks 40 and 42 for the watercraft to be using the watercraft lift. The rearward and forward saddles 29 and 31 may be securely clamped to the rearward and forward cross beams 126 and 128 once the left and right side bunks 40 and 42 are at the desired lateral spacing and retained in that position during subsequent use of the watercraft lift. The Gull wing shaped rearward and forward crossbeams 126 and 128 minimize the water depth requirement to position a watercraft on the watercraft lift 10 of this embodiment. The partial decking of the deck 122 is better in waves and saves money and time in decking.

Four Hydraulic Actuators Configuration

Figure 30:
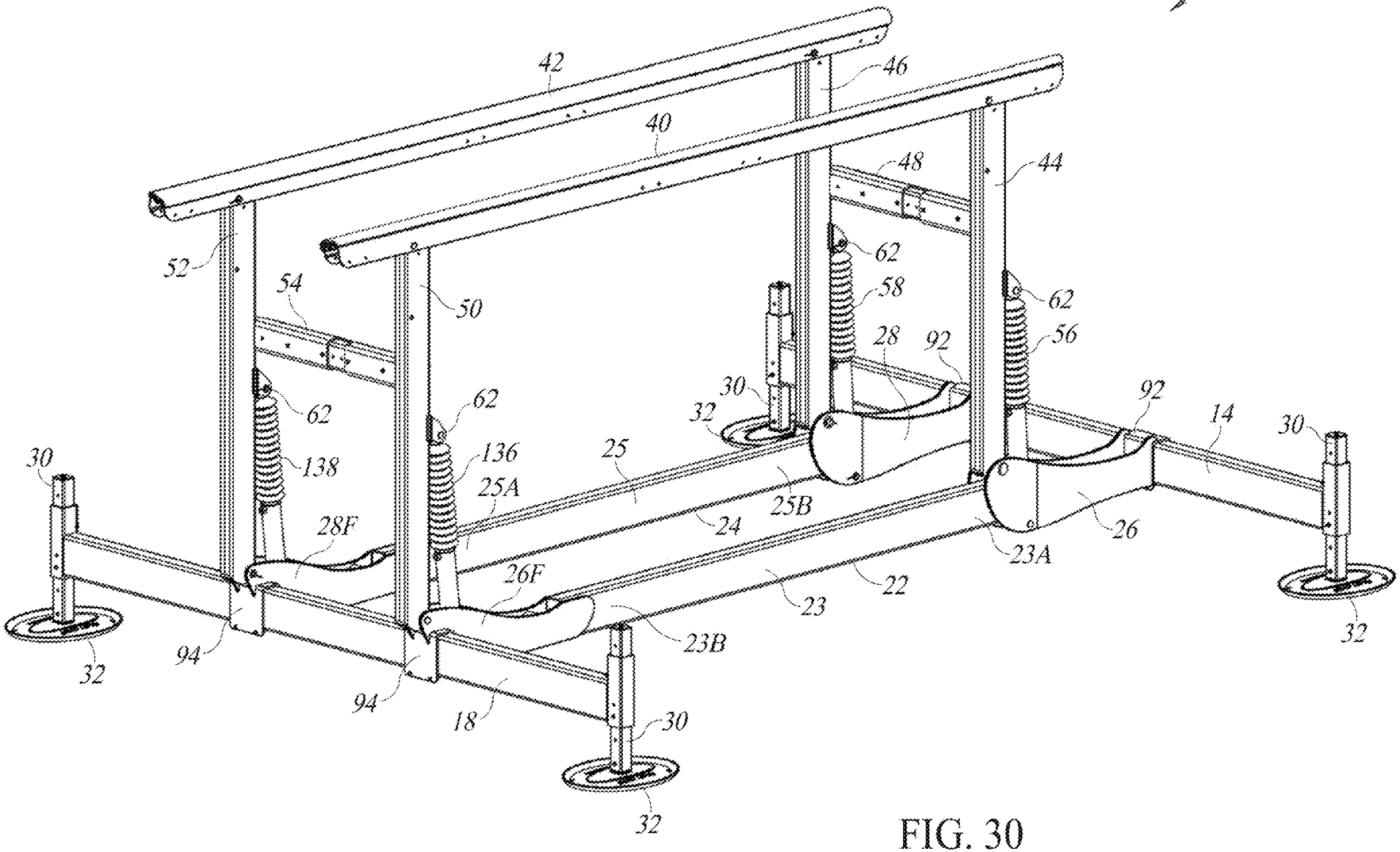
FIG. 30 is an isometric view of an alternative embodiment of the lift of FIG. 1 using four hydraulic actuators.

In an alternative embodiment shown in FIG. 30, the watercraft lift 10 may include a second left side dual-directional hydraulic actuator 136 and a second right side dual-directional hydraulic actuator 138 to provide lifting force to the left and right side forward lifting arms 50 and 52, respectively. Hydraulic actuators 136 and 138 use substantially the same construction as hydraulic actuators 56 and 58. This embodiment includes a left side forward support member 26F and a right side forward support member 28F, construction and connected much like the left and right side rearward support members 26 and 28, respectively. The forward end portions of the left and right side forward support members 26F and 28F are supported by the forward lateral beam 18 using forward saddles 94. The rearward end portion of the left side forward support member 26F is rigidly attached to the forward end portion 23B of the left side forward beam portion 23, and the rearward end portion of the right side forward support member 28F is rigidly attached to the forward end portion 25B of the right side rearward beam portion 25. The actuator rod 62 of the second left side hydraulic actuator 136 is pivotally connected to the left side forward lifting arm 50, and the actuator rod 62 of the second right side hydraulic actuator 138 is pivotally connected to the right side forward lifting arm 52, to provide additional lifting force to the left and right side bunks 40 and 42. The lower end portion 64 of the actuator body 60 of the second left side hydraulic actuator 136 is pivotally connected to the left side forward support member 26F, and the lower end portion 64 of the actuator body 60 of the second right side hydraulic actuator 138 is pivotally connected to the right side rearward support member 28F.

Figure 31:
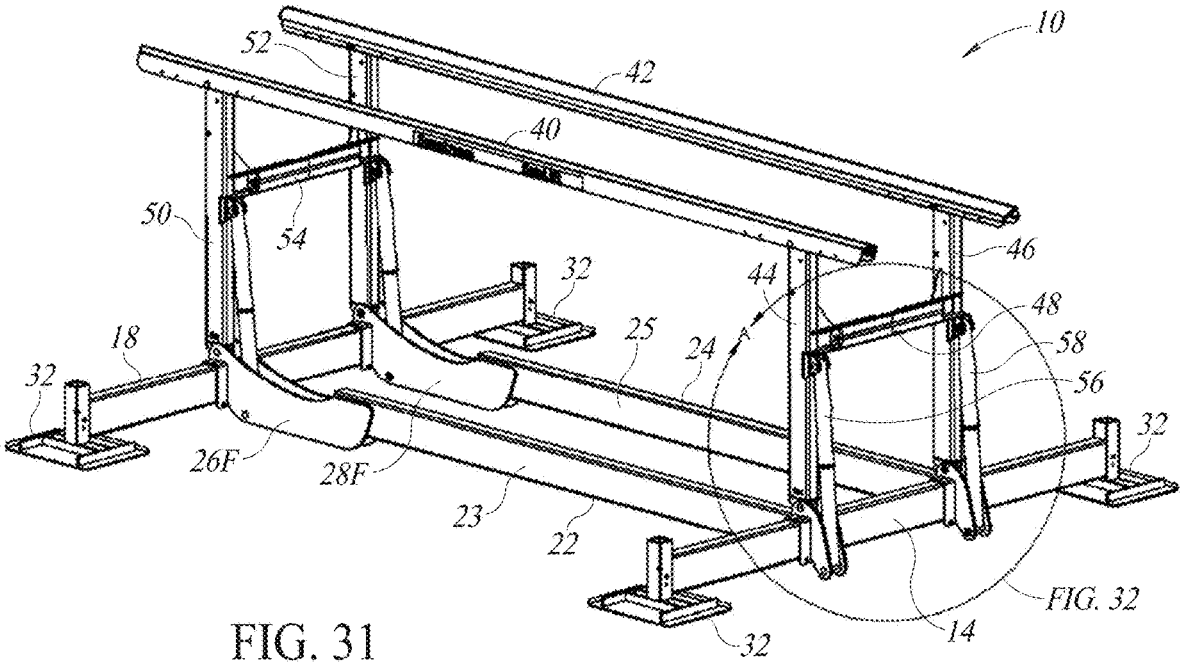
FIG. 31 is an isometric view of an alternative embodiment of the lift of FIG. 1.
Figure 32:
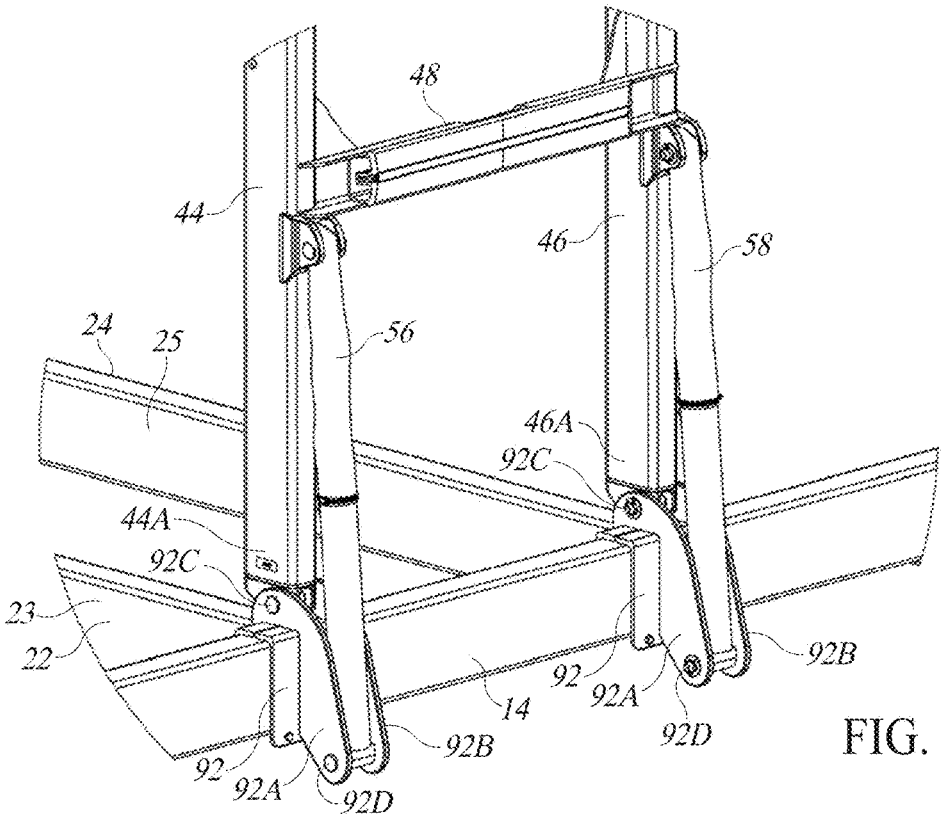
FIG. 32 is an enlarged isometric view of the encircled area of FIG. 31.

Another embodiment using rearward and forward pairs of hydraulic actuators (i.e., using at least four hydraulic actuators) somewhat similar to the one illustrated in FIG. 30 is shown in FIGS. 31 and 32. In this embodiment the left side forward beam portion 23 and the right side forward beam portion 25 extend rearward fully to the rearward lateral beam 14, with each of the rearward end portion 23A of the left side forward beam portion and the rearward end portion 25A of the right side rearward beam portion being supported by the rearward lateral beam 14 by one of the rearward saddle 92. Instead of using the rearward left and right side support members 26 and 28, in this embodiment each of the rearward saddles 92 has two spaced apart flanges 92A and 92B with two pivot pins 92C and 92D extending between them. The lower end portion 44A of the left side rearward lifting arm 44 is pivotally connected to the pivot pin 92C of the leftward one of the rearward saddles 92 and the lower end portion 64 of the actuator body 60 of the left side hydraulic actuator 56 is pivotally connected to the pivot pin 92D of the leftward one of the rearward saddles 92 at a location rearward of and below the rearward lateral beam 14. Similarly, the lower end portion 46A of the right side rearward lifting arm 46 is pivotally connected to the pivot pin 92C of the rightward one of the rearward saddles 92 and the lower end portion 64 of the actuator body 60 of the right side hydraulic actuator 58 is pivotally connected to the pivot pin 92D of the rightward one of the rearward saddles 92 at a location rearward of and below the rearward lateral beam 14.

Figure 49:
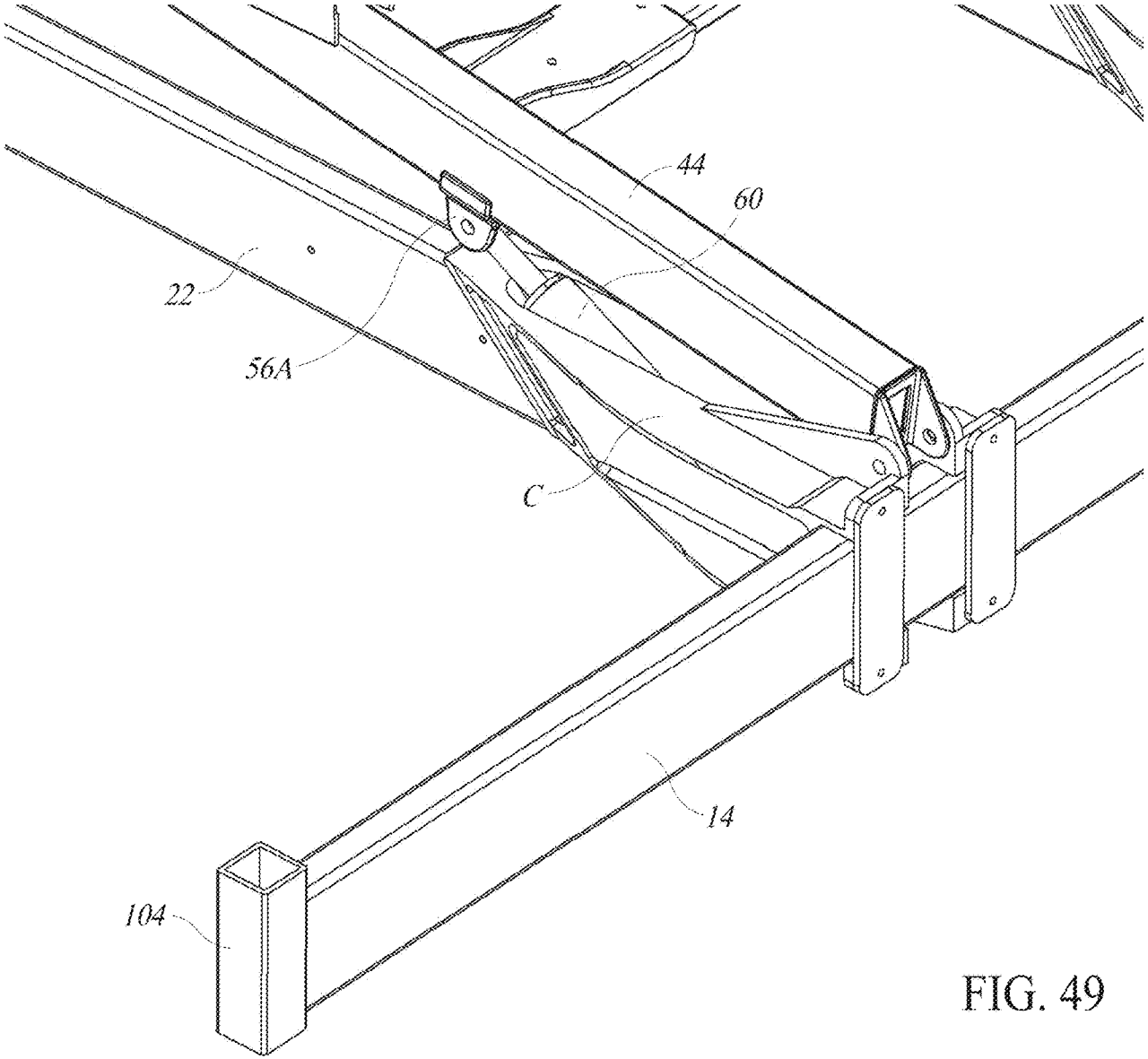
FIG. 49 is a fragmentary top isometric view of an alternative embodiment of the lift of FIG. 1.

FIG. 49 illustrates another alternative to using the rearward left and right side support members 26 and 28 to attach the actuator body 60 to a lateral beam, such as rearward lateral beam 14. A casting C is clamped to the lateral beam.

In the embodiment of FIG. 30 and the embodiment of FIGS. 31 and 32, each of the left side hydraulic actuators is in substantial rotational coplanar alignment with the left side lifting arm to which it applies lifting force, and each of the right side hydraulic actuators is in substantial rotational coplanar alignment with the right side lifting arm to which it applies lifting force, with their first and second rotational planes in coplanar alignment. In an alternative embodiment not shown, the hydraulic actuators are inboard of the longitudinal side beams 22 and 24.

Three H-Frame Configuration

Figure 44:
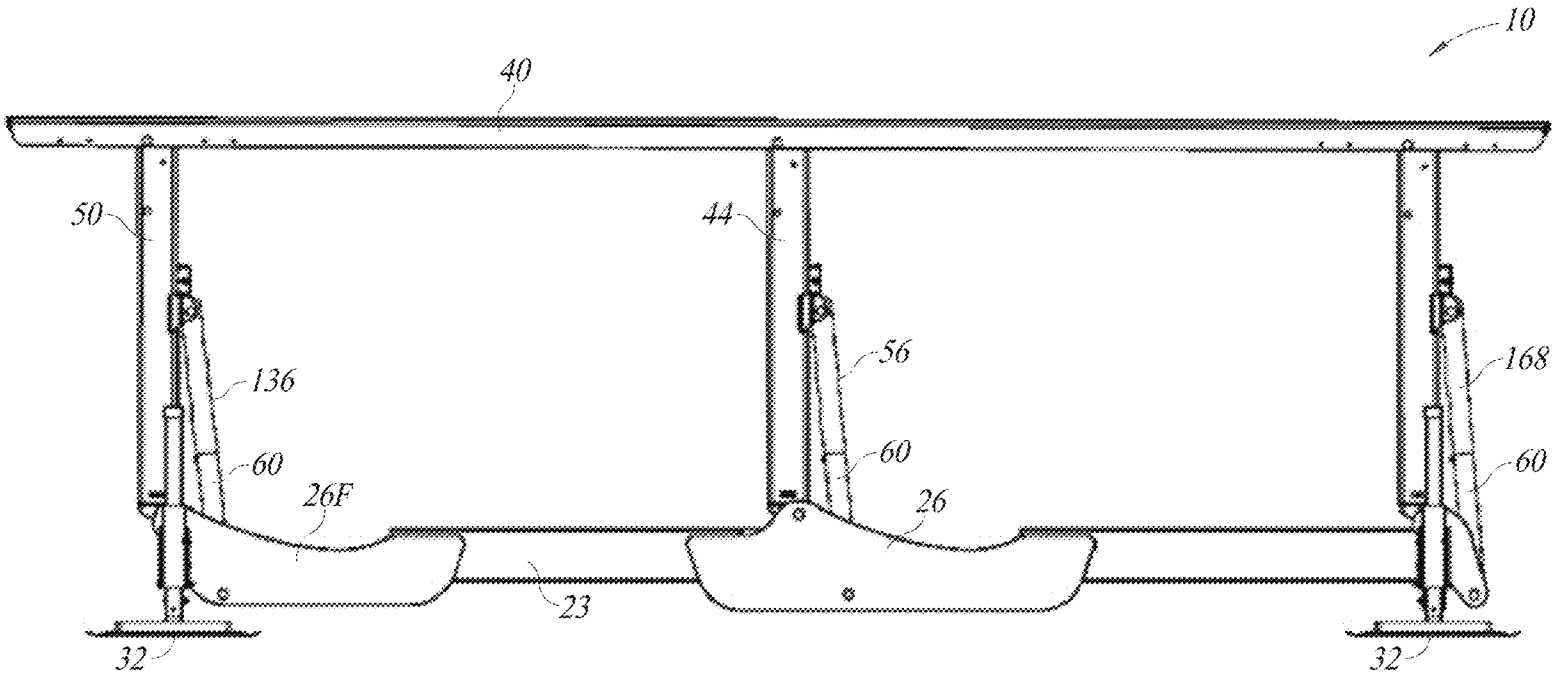
FIG. 44 is a side elevational view of an alternative embodiment of the lift of FIG. 1 using three H-frames shown in the fully raised position.
Figure 45:
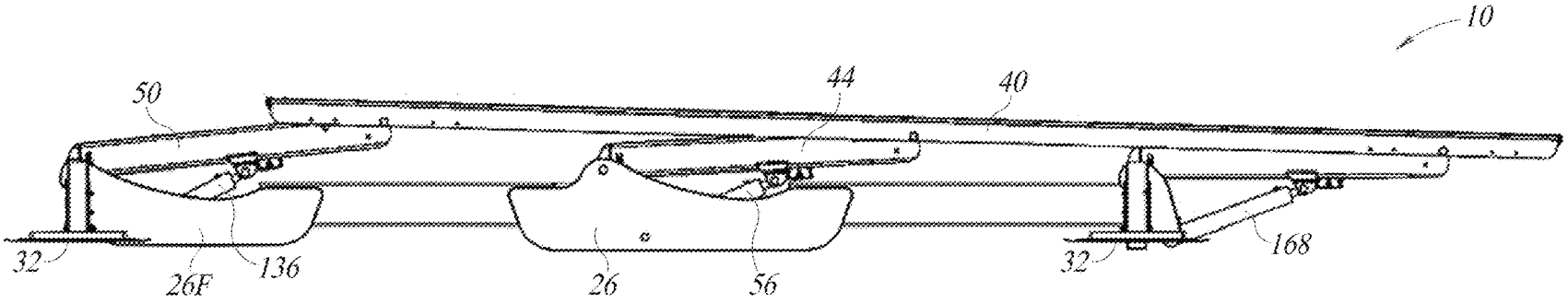
FIG. 45 is a side elevational view of the lift of FIG. 44 shown in the fully lowered position.
Figure 46:
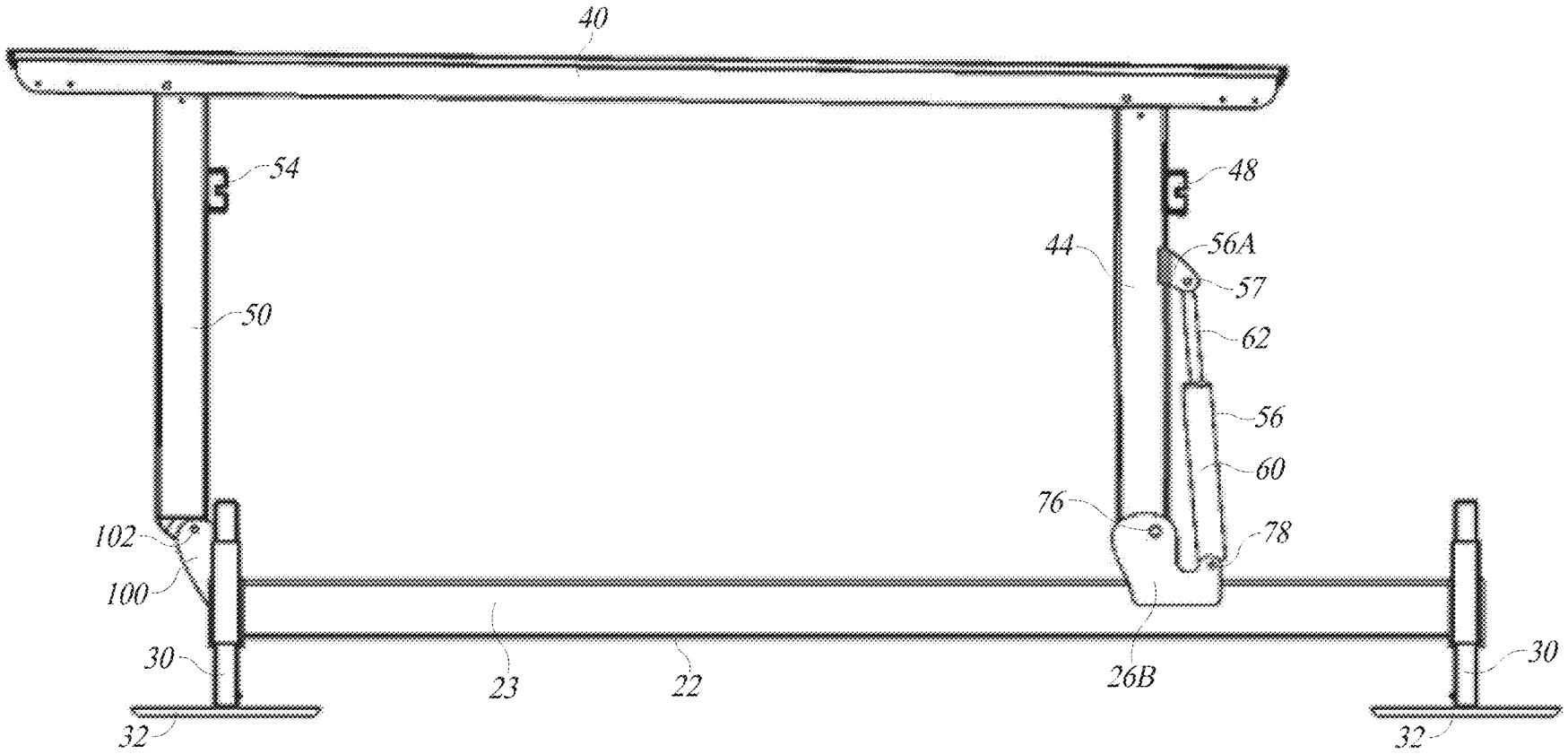
FIG. 46 is a side elevational view of an alternative embodiment of the lift of FIG. 1 shown in the fully raised position.
Figure 47:
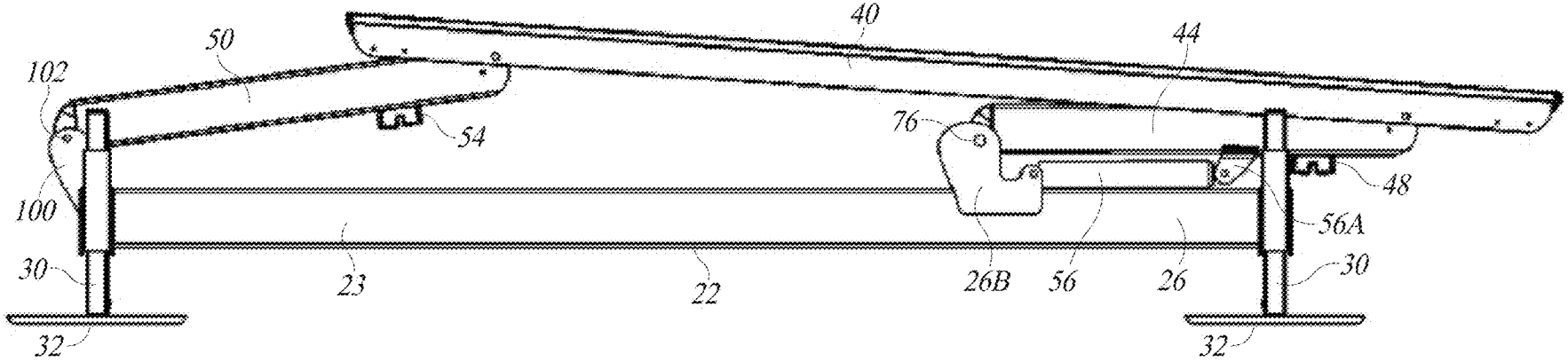
FIG. 47 is a side elevational view of the lift of FIG. 46 shown in the fully lowered position.
Figure 48A:
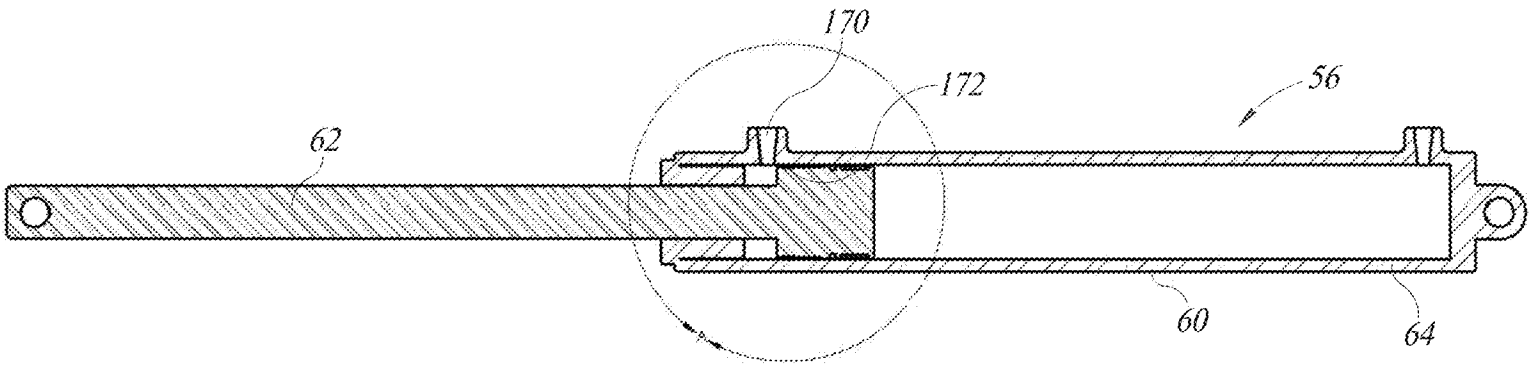
FIGS. 48A-48F illustrate hydraulic cylinder using a hydraulic cushion and the step of operation.
Figure 48B:
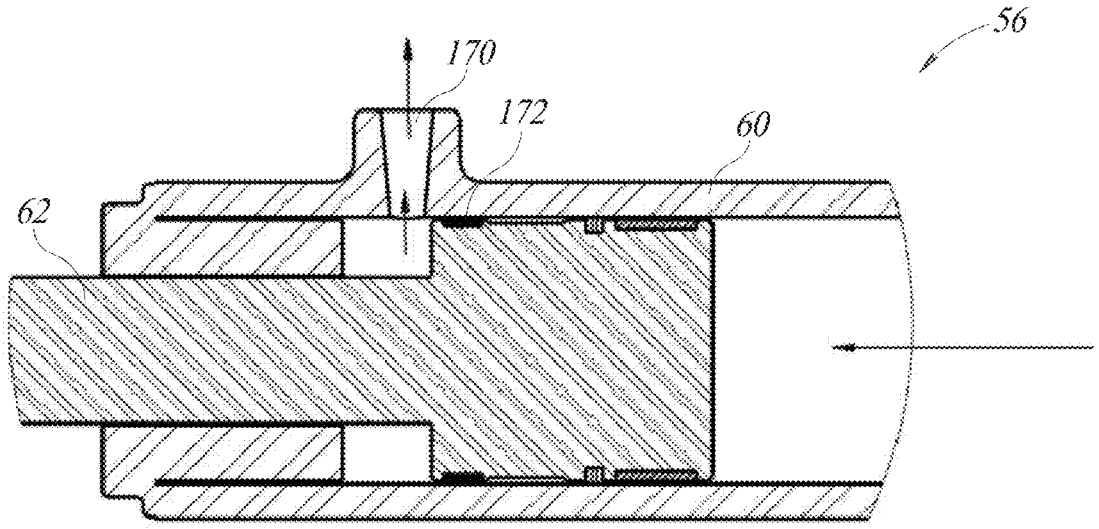
Figure 48C:
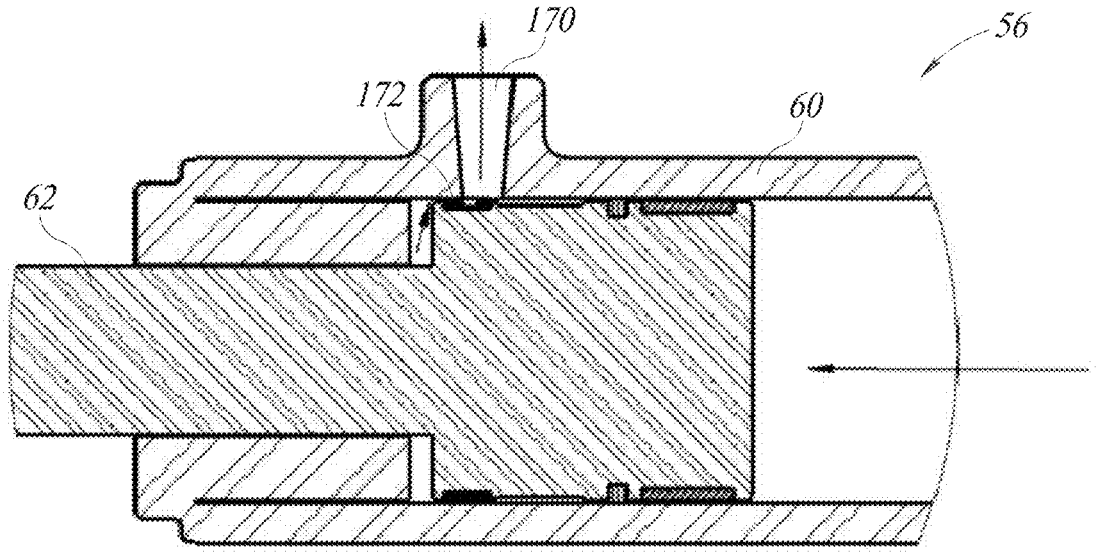
Figure 48D:
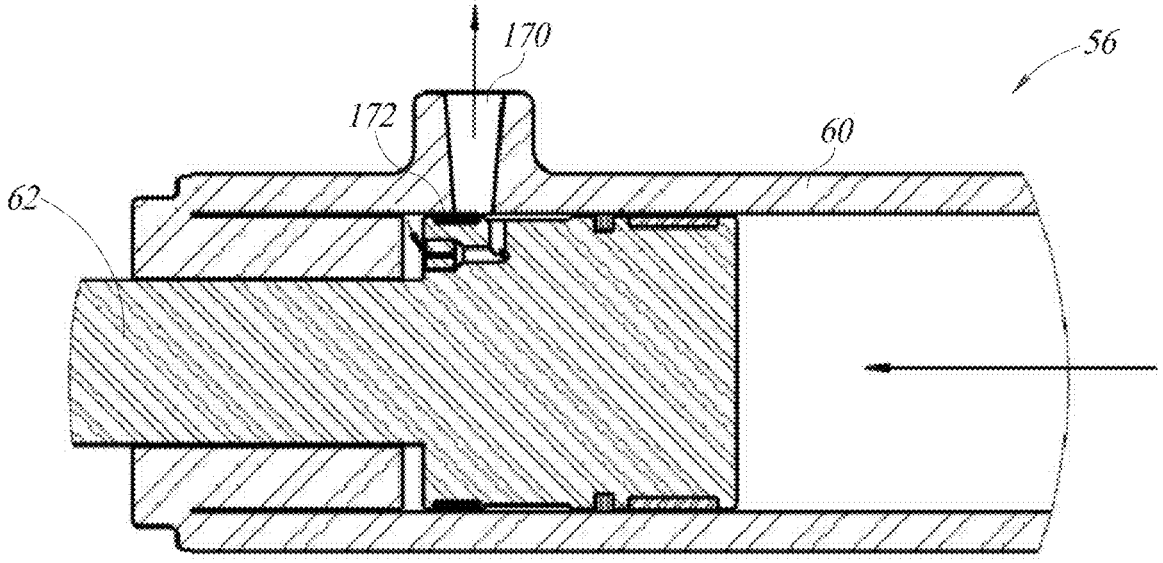
Figure 48E:
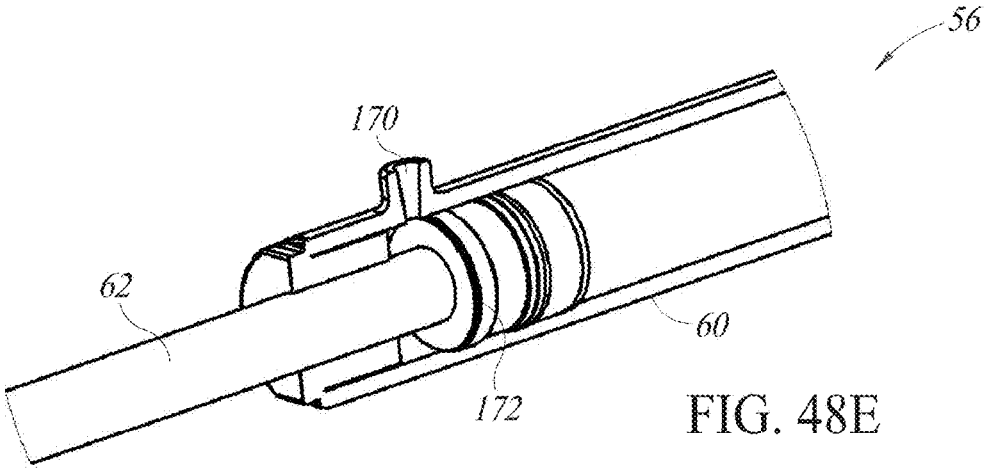
Figure 48F:
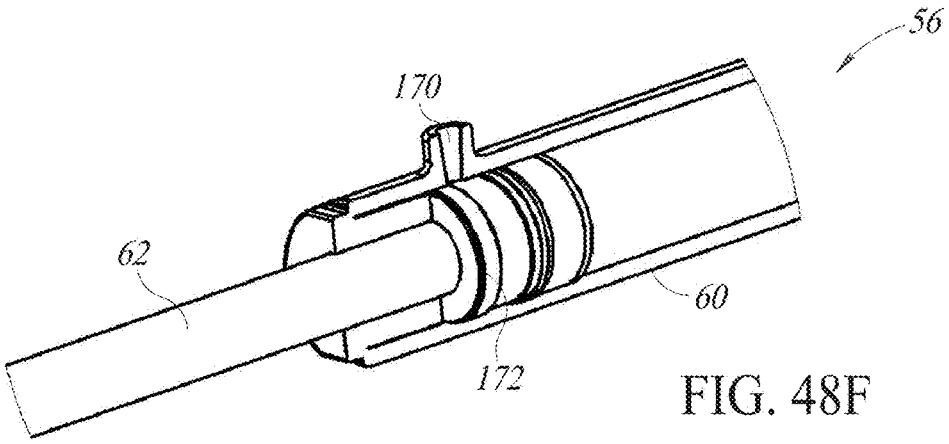

Another embodiment of the watercraft lift 10 is shown in FIGS. 44 and 45, which is similar to watercraft 10 shown in FIG. 30, but has an additional H-shaped lifting arm and an additional set of hydraulic actuators connected thereto. This embodiment is best used for longer, heavier watercraft, since it adds additional support for long side support members 26 and 28, and adds the additional pair of hydraulic actuators 168 for more lifting force. It is desirable to provide the bunks with a rearward slope when the watercraft lift is in the fully lowered position to assist with stopping the watercraft when landing on the watercraft lift. The slope also assures the front of the bunks will not dip when deadlifting from the lowest position, which would spikes the loads and possibly break the structure. The challenge is that there is no geometry that would enable this 5 bar linkage to start with a slope in the fully lowered position, and be substantially horizontal when moved to the fully raised position. This embodiment enables this kinematics by selecting upper and lower pivot points of the center H-frame at a location that results in bunk deflection of less than 0.5" during transient lifting, and close to no deflection in the fully raised position which is acceptable for long term storage for watercraft. In the preferred embodiment, the middle hole in the left and right support members is exactly centered between the forward and rear pivot holes of the left and right support members. The middle pivot hole in the left and right side support members is in the middle longitudinally between the forward and rear pivot holes in each side support member, but up vertically 0.83," the middle H-shaped arm is taller than the rear H-shaped arm, and the forward H-Shaped arm is taller than the middle H-shaped arm.

Single Hydraulic Actuator Configuration

Figure 33:
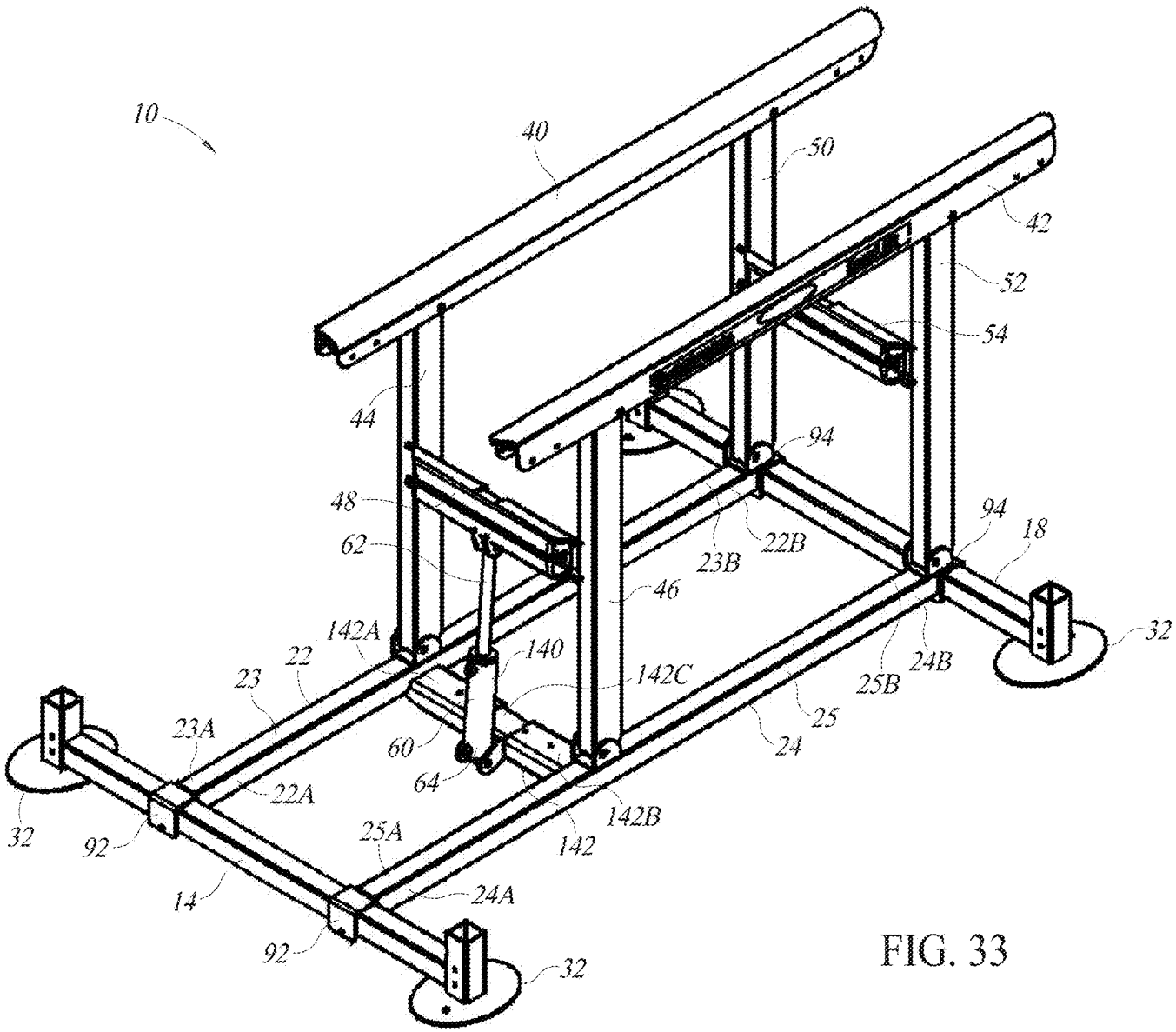
FIG. 33 is an isometric view of an alternative embodiment of the lift of FIG. 1 using one hydraulic actuator.

Another embodiment of the watercraft lift 10 is shown in FIG. 33, which uses a single dual-directional hydraulic actuator 140. The longitudinal left side beam 22 and the longitudinal right side beam 24 extend rearward fully between the rearward lateral beam 14 and the forward lateral beam 18, without the use of left and right side rearward support members 26 and 28, and with the rearward end portion 22A of the longitudinal left side beam and the rearward end portion 24A of the longitudinal right side beam being supported by the rearward lateral beam 14 by rearward saddles 92, and with the forward end portion 22B of the longitudinal left side beam and the forward end portion 24B of the longitudinal right side beam being supported by the forward lateral beam 18 by forward saddles 94. An extendable hydraulic actuator support beam 142 extends between and has a left end portion 142A rigidly connected to the longitudinal left side beam 22 and a right end portion 142B rigidly connected to the longitudinal right side beam 24. A central portion 142C extends between the left and right end portions 142A and 142B, and the lower end portion 64 of the actuator body 60 is pivotally connected to the central portion. The upper end portion 66 of the actuator rod 62 of hydraulic actuator 140 is pivotally connected to tube 96 of the rearward connector member 48. The lateral spacing between the left and right side bunks 40 and 42 by the adjustability of the rearward and forward connector members 49 and 54, as described above, and by the extendability of the hydraulic actuator support beam 142 which is accomplished by selectively extending the hydraulic actuator support beam and then bolting the respective portions of the hydraulic actuator support beam together using the various adjustment holes in each.

Pontoon Underdeck

Figure 34:
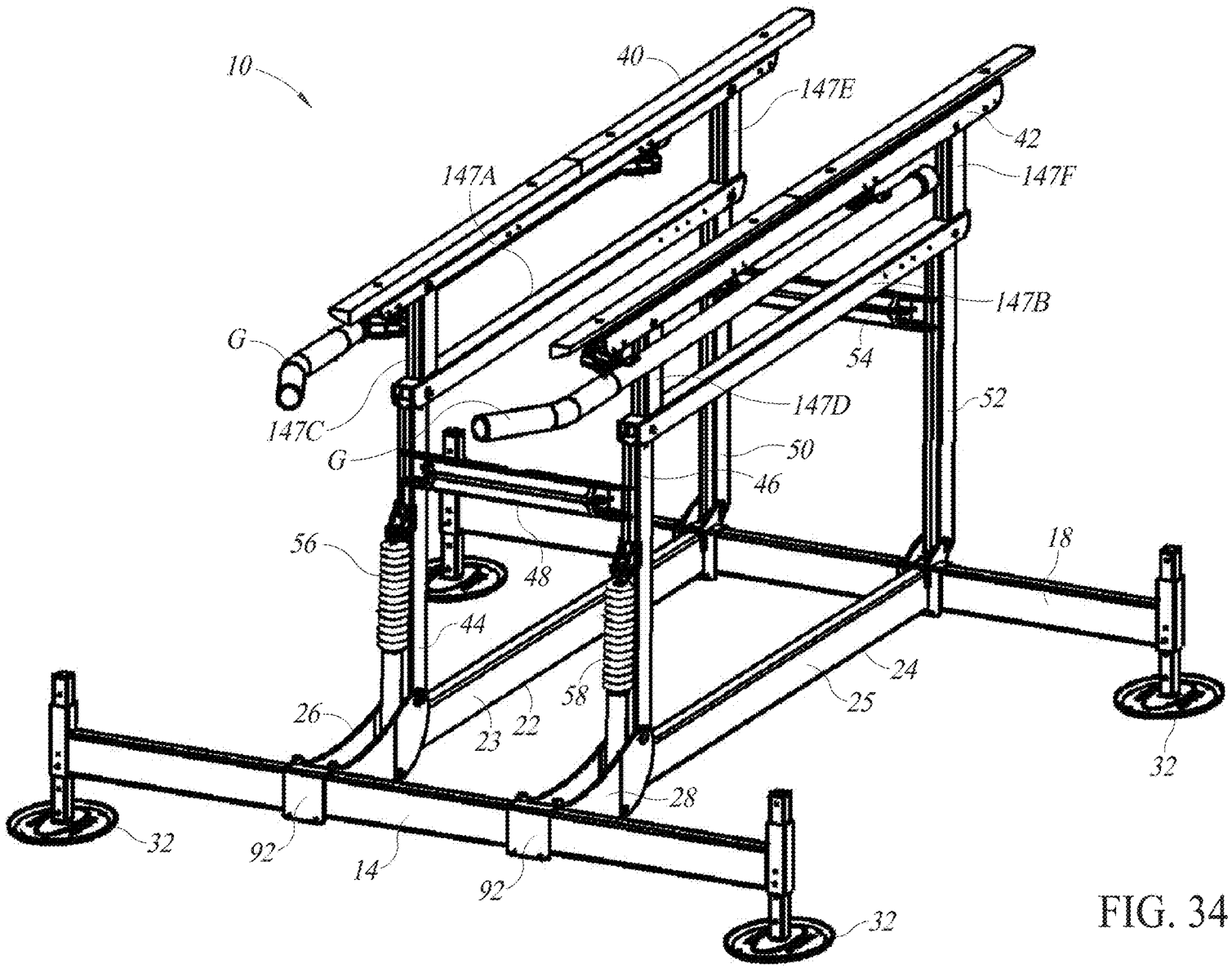
FIG. 34 is an isometric view of an alternative embodiment of the lift of FIG. 1 for under deck support of a pontoon boat.
Figure 34A:
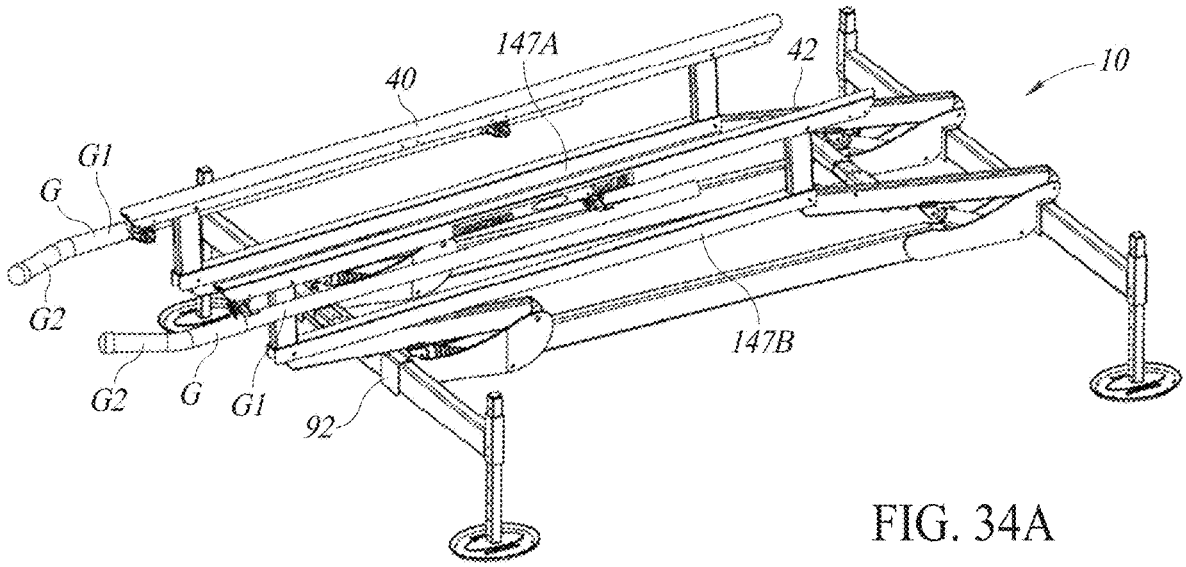
FIG. 34A is an isometric bottom view of the lift of FIG. 34.
Figure 34B:
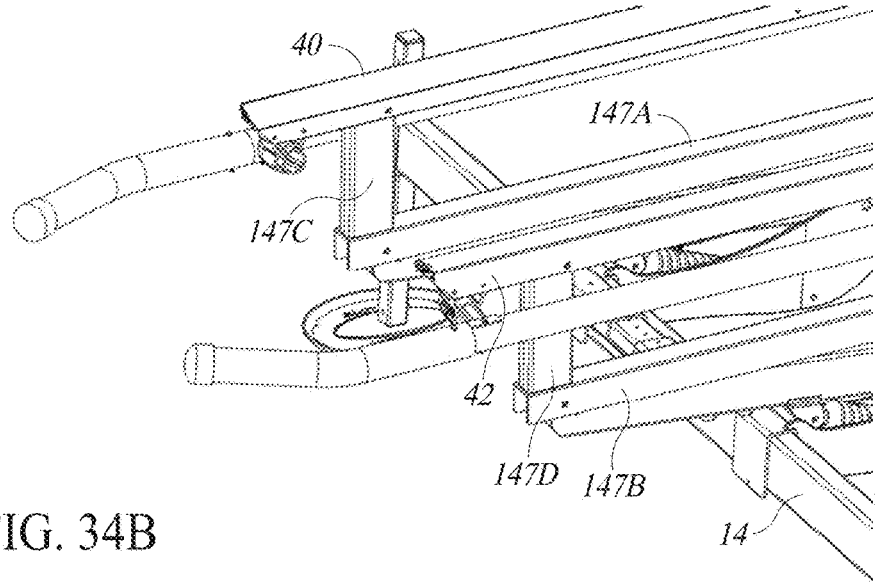
FIG. 34B is a fragmentary isometric top view of the lift of FIG. 34.
Figure 34C:
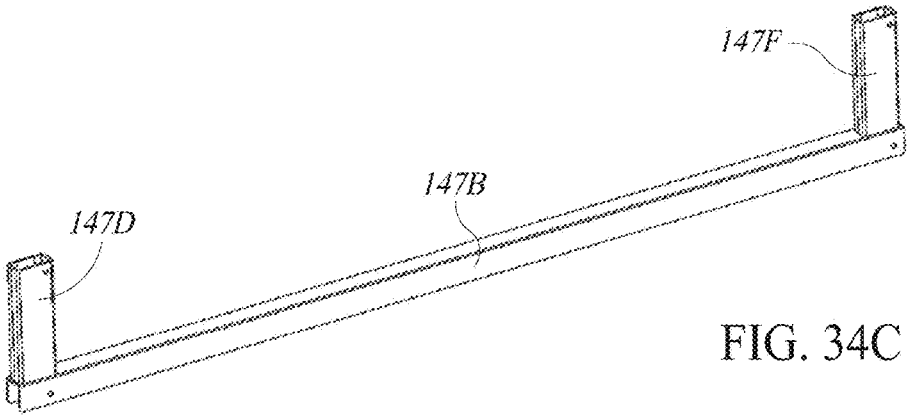
FIG. 34C is an isometric bottom view of a support component of the lift of FIG. 34.
Figure 35:
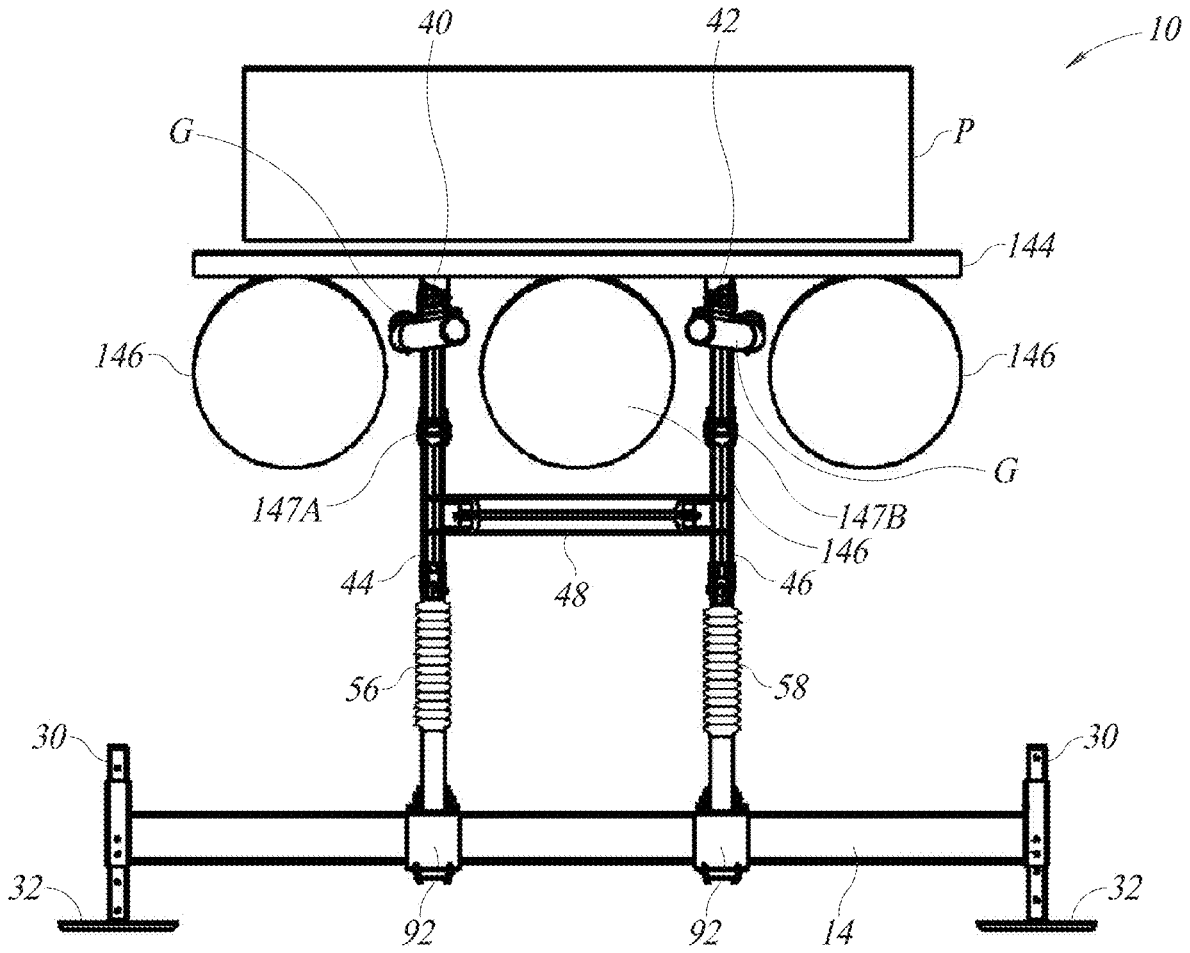
FIG. 35 is a rear elevational view of the lift of FIG. 34.

Additional benefits result from being able to adjust the lateral spacing between the longitudinal left and right side beams 22 and 24 when the watercraft lift 10 is used with a pontoon boat. The left and right side bunks 40 and 42 may be used to support the pontoon boat by engaging the underside of the platform of the pontoon boat without engaging the pontoons. The lateral spacing between the left and right side bunks 40 and 42 is adjusted to avoid contact with the pontoons, and if the pontoon boat has three laterally spaced apart pontoons, the bunks are spaced apart to straddle the center pontoon. FIGS. 34 and 35 show an embodiment of the watercraft lift 10 generally according to the construction of FIG. 1 used to support a pontoon boat "P" by engaging the underside of a platform 144 of the pontoon boat without engaging the three pontoons 146 of the watercraft. A similar embodiment is shown in FIGS. 34A, 34B, 34C. In a preferred embodiment, left and right side longitudinal support beams 147A and 147B, respectively, have the left side longitudinal support beam 147A pivotally connected to the upper end portions 44B and 50B of the left side rearward lifting arm 44 and the left side forward lifting arm 50, and the right side longitudinal support beam 147B pivotally connected to the upper end portions 46B and 52B of the right side rearward lifting arm 46 and the left side forward lifting arm 52. A rearward upright left side offset member 147C has a lower end portion rigidly attached to a rearward portion of the left side longitudinal support beam 147A and an upper end portion pivotally attached to a rearward end portion of the left side bunk 40, and a rearward upright right side offset member 147D has a lower end portion rigidly attached to a rearward portion of the right side longitudinal support beam 147B and an upper end portion pivotally attached to a rearward end portion of the right side bunk 42. In like fashion, a forward upright left side offset member 147E has a lower end portion rigidly attached to a forward portion of the left side longitudinal support beam 147A and an upper end portion pivotally attached to a forward end portion of the left side bunk 40, and a forward upright right side offset member 147F has a lower end portion rigidly attached to a forward portion of the right side longitudinal support beam 147B and an upper end portion pivotally attached to a forward end portion of the right side bunk 42. These offset members raise the elevation of the left and right side bunks 40 and 42 above the rearward and forward connector members 48 and 54 to avoid the center pontoon 146 contacting the connector members when the pontoon boat is being supported by the left and right side bunks.

To assist in loading the pontoon boat on the watercraft lift 10 in the proper lateral position, left and right lateral guides G are provided in the form of left and right side longitudinally extending lateral guide tube portions G1 attached to the lift frame by adjustable guide brackets. A rear end portion G2 of each of the left and right lateral guides G may be curved inward to assist to guide the pontoon boat to a correct side of the guide. A soft but stiff material, such as PVC, is well suited as a material for the lateral guides G.

Figure 34D:
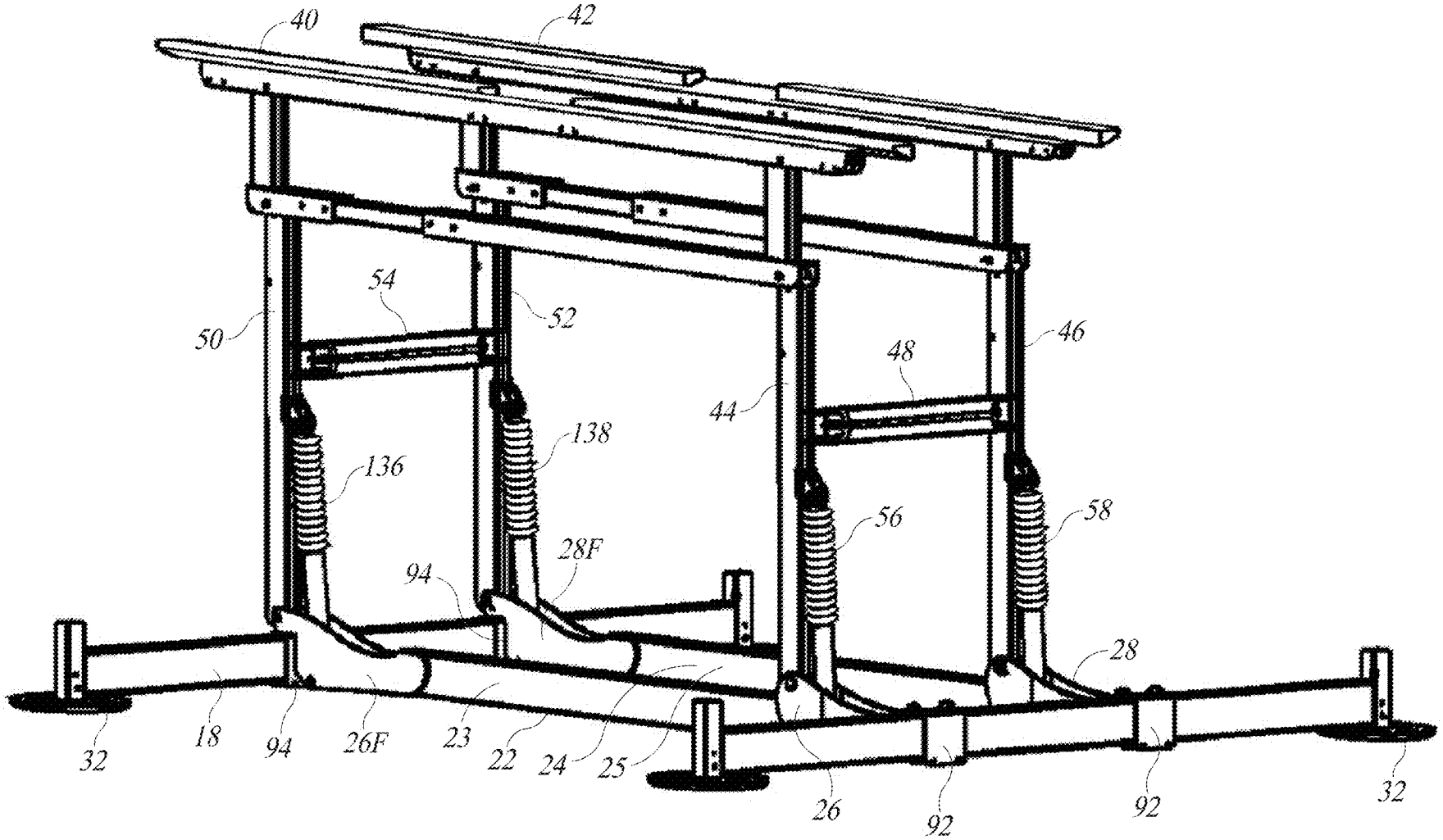
FIG. 34D is an isometric view of an alternative embodiment of the lift of FIG. 1 for under pontoon support of a pontoon boat.

FIG. 34D shows a similar embodiment to the one shown in FIG. 34, but using the four hydraulic actuators 56, 58, 136 and 138 of the embodiment shown in FIG. 30.

Pontoon Bunk Configuration

Figure 36:
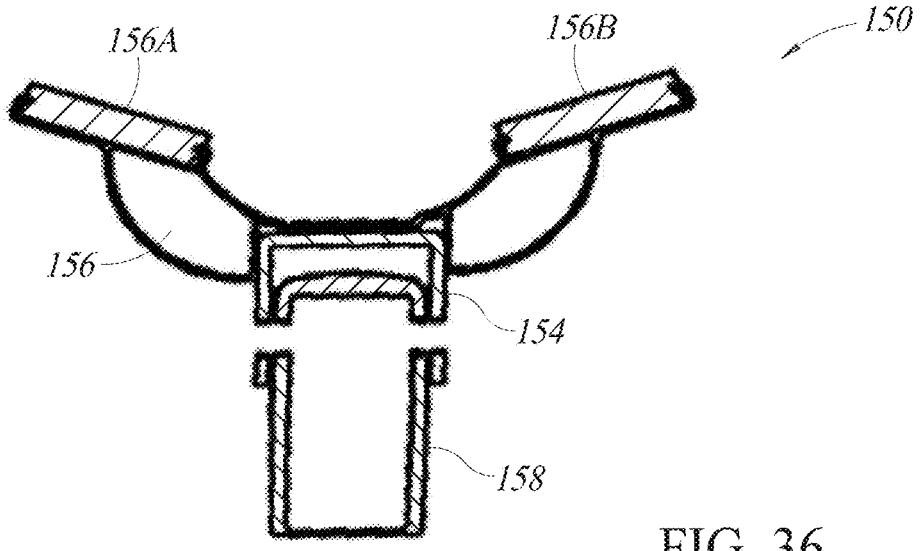
FIG. 36 is a cross-sectional view of the Y-Bunk of the pontoon bunk of FIG. 37.

If it is desired to support the pontoon boat by its pontoons, the left and right side bunks 40 and 42 may be replaced with an elongated, generally Y-shaped pontoon bunk 150. The cross-sectional shape of the pontoon bunk 150 is shown in FIG. 36. The pontoon bunk 150 includes a base connector portion 154 and an upper portion 156 attached to the base connector portion and projecting upwardly therefrom. The upper portion 156 includes an inwardly downward sloped support 156A and an inwardly downward sloped support 156B, which are spaced apart and sized to have a pontoon nested on and partially between them. One elongated pontoon bunk 150 is pivotally attached to the upper end portion 44B of the left side rearward lifting arm 44, and to the upper end portion 50B of the left side forward lifting arm 50.

Another elongated pontoon bunk 150 is pivotally attached to the upper end portion 46B of the right side rearward lifting arm 46, and to the upper end portion 52B of the right side forward lifting arm 52.

The lateral spacing been the left and right side pontoon bunks 150 is adjusted to position the left side pontoon bunk under the left side pontoon and the right side pontoon bunk under the right side pontoon. Unlike with typical pontoon boat lifts, no lateral beams which span the lateral distance between standard bunks and sit atop the standard bunks are required. This saves considerable amount of cost, weight, installation time hardware, and water depth required.

Figure 37:
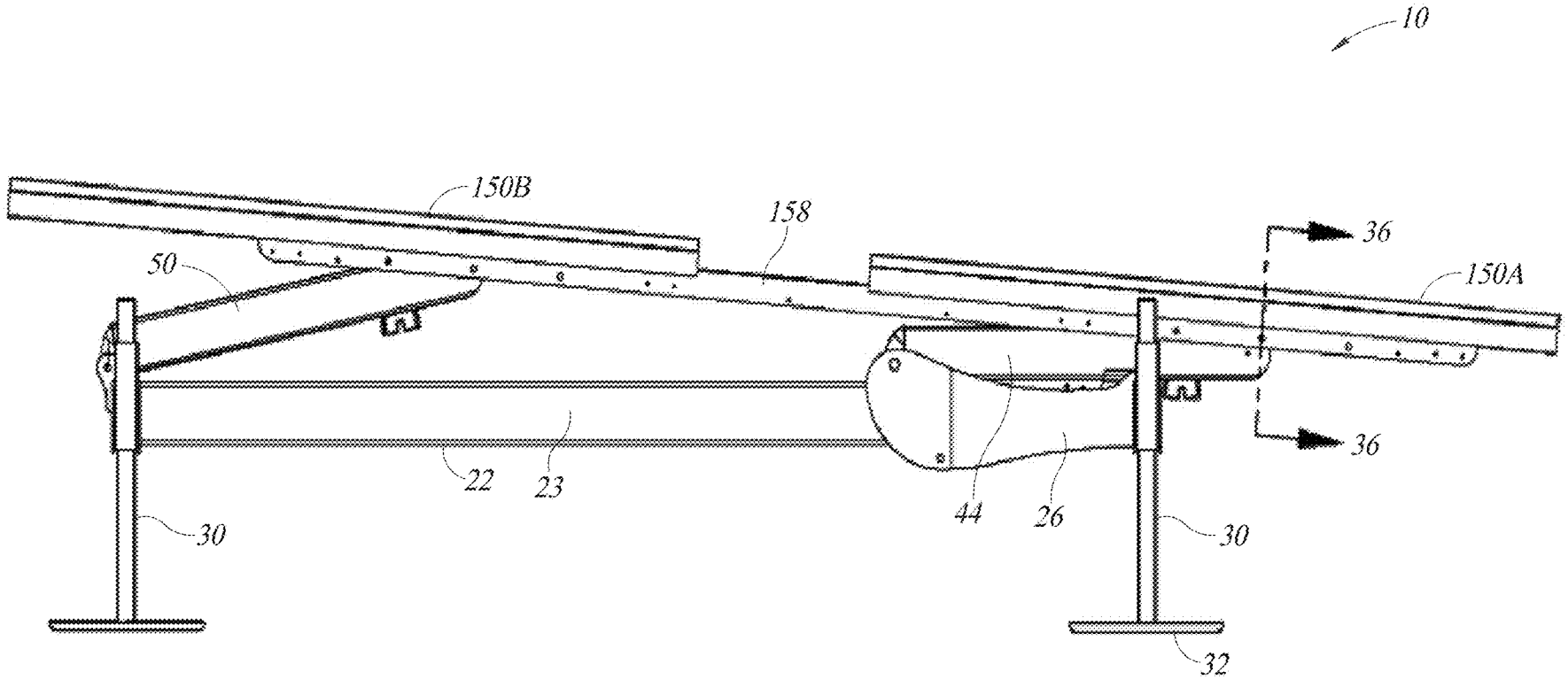
FIG. 37 is a side elevational view of an alternative embodiment of the lift of FIG. 1 for under pontoon support of a pontoon boat.
Figure 37A:
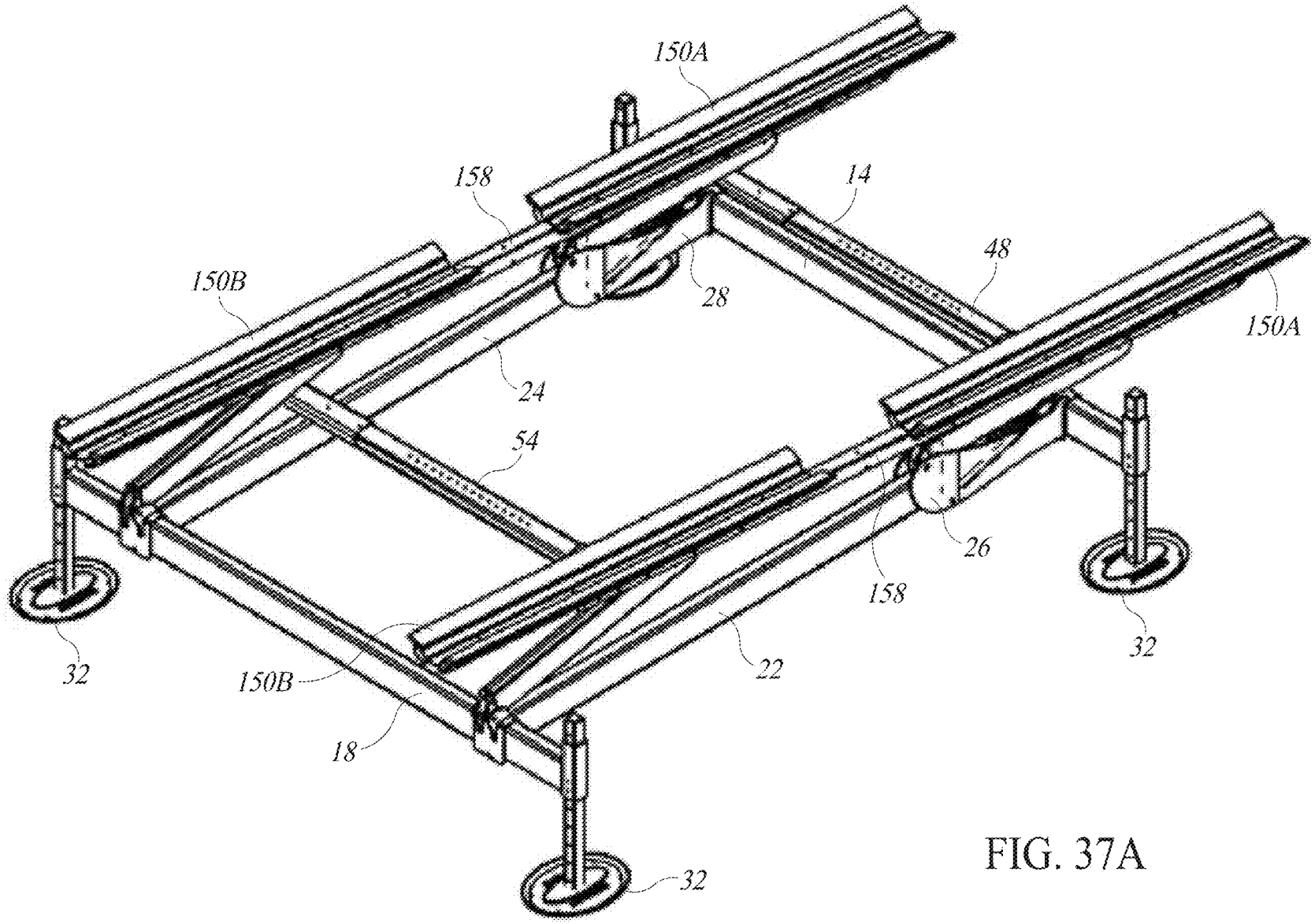
FIG. 37A is an isometric top view of the lift of FIG. 37.

To accommodate a wider variety of lengths of pontoon boats, it is convenient to include an adjustable length support feature. As shown in FIGS. 37 and 37A, the left and right side bunks 40 and 42 are replaced with left and right side longitudinal support beams 158, each with a rearward Y-shaped pontoon bunk 150A and a forward Y-shaped pontoon bunk 150B adjustably movably attached to the support beam, typically longitudinally spaced apart. The support beams 158 each have a plurality of longitudinally arranged through holes to permit adjustable attachment of the forward and rearward Y-shaped pontoon bunk 150A and 150B bunks at positions along the length of the support beams best suited for supporting the pontoons of the pontoon boat.

Figure 38:
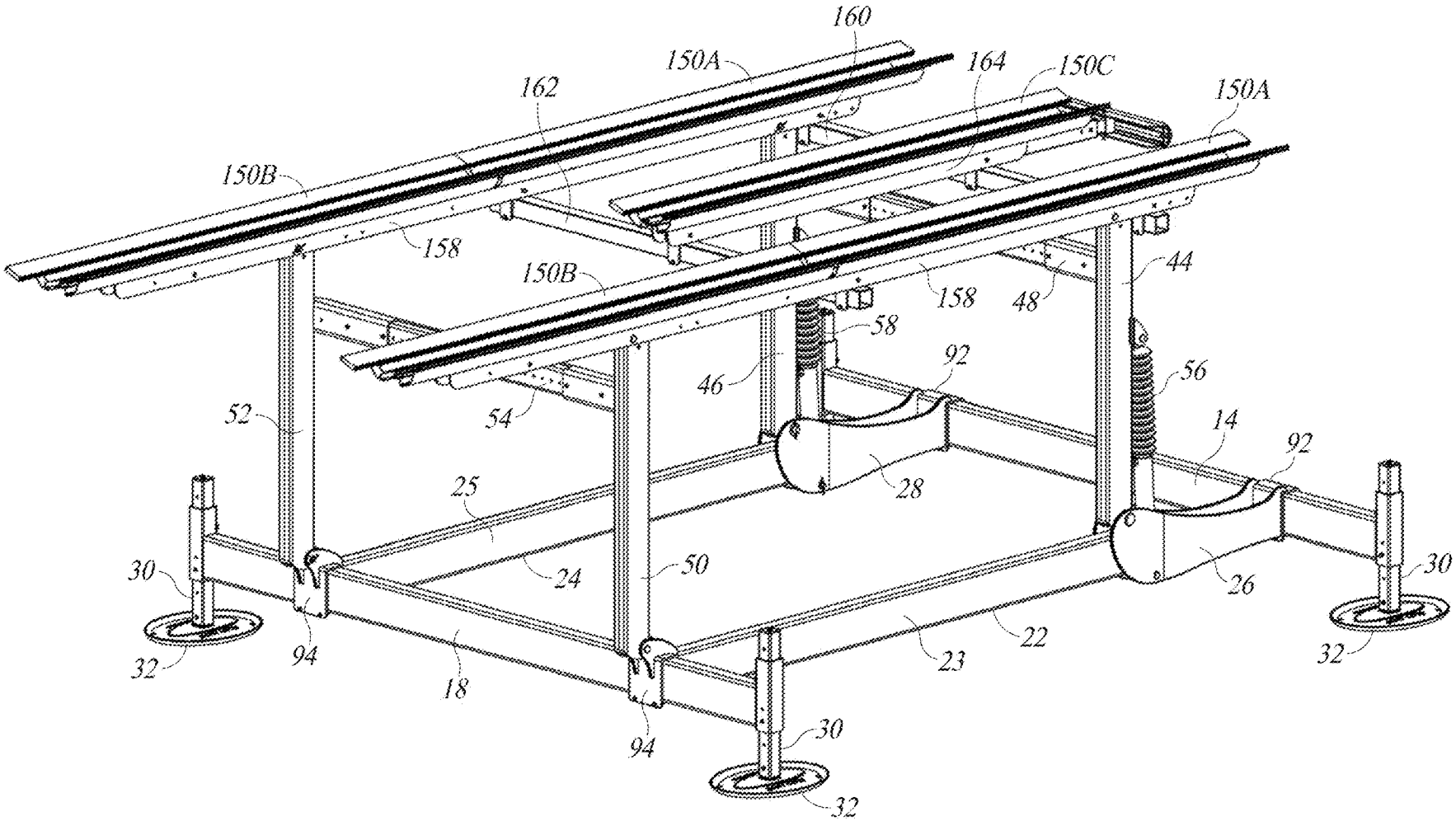
FIG. 38 is an isometric view of an alternative embodiment of the lift of FIG. 1 for under pontoon support of a pontoon boat having three pontoons.
Figure 39:
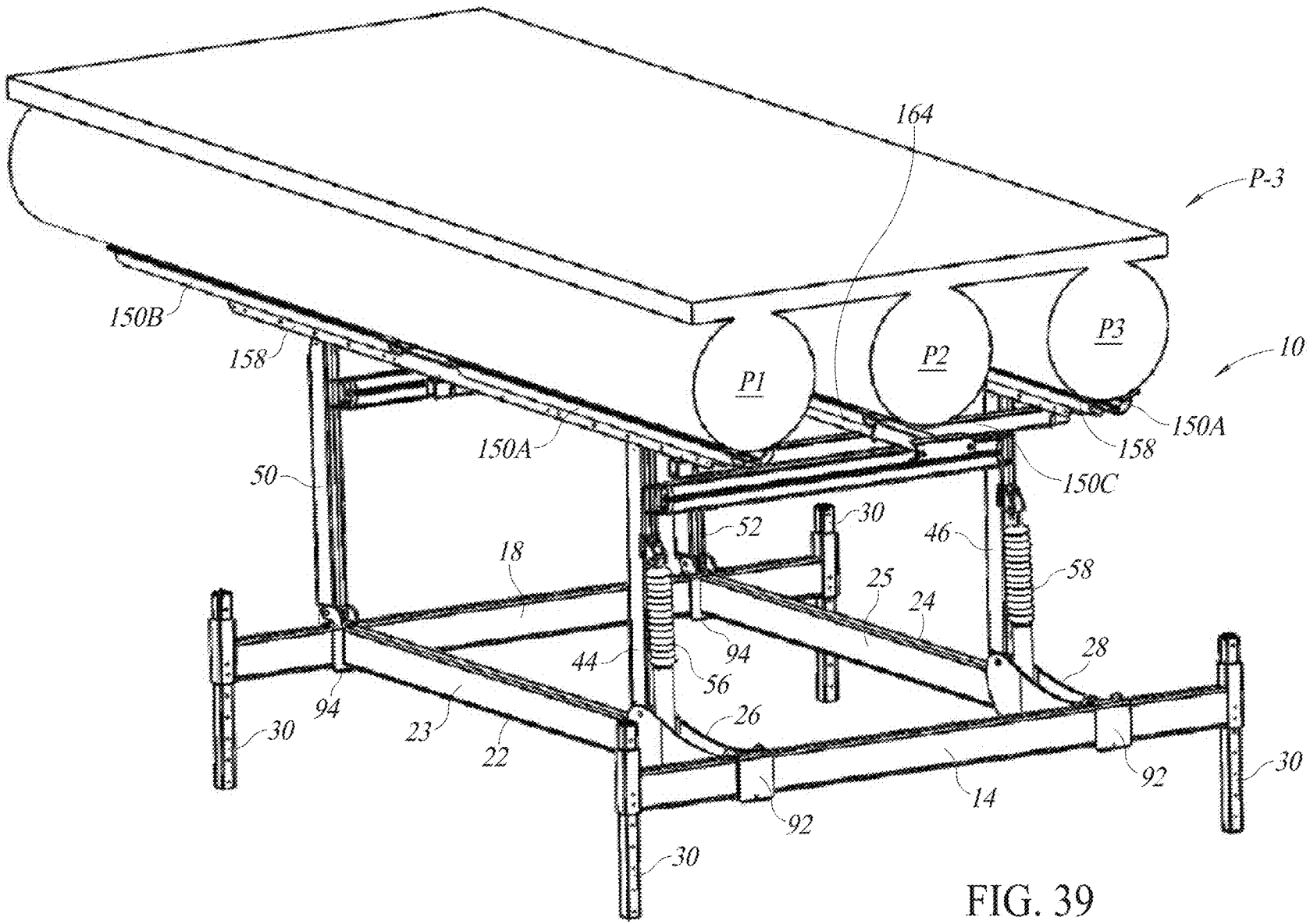
FIG. 39 is an isometric view of the lift of FIG. 28 shown supporting a pontoon boat.
Figure 40:
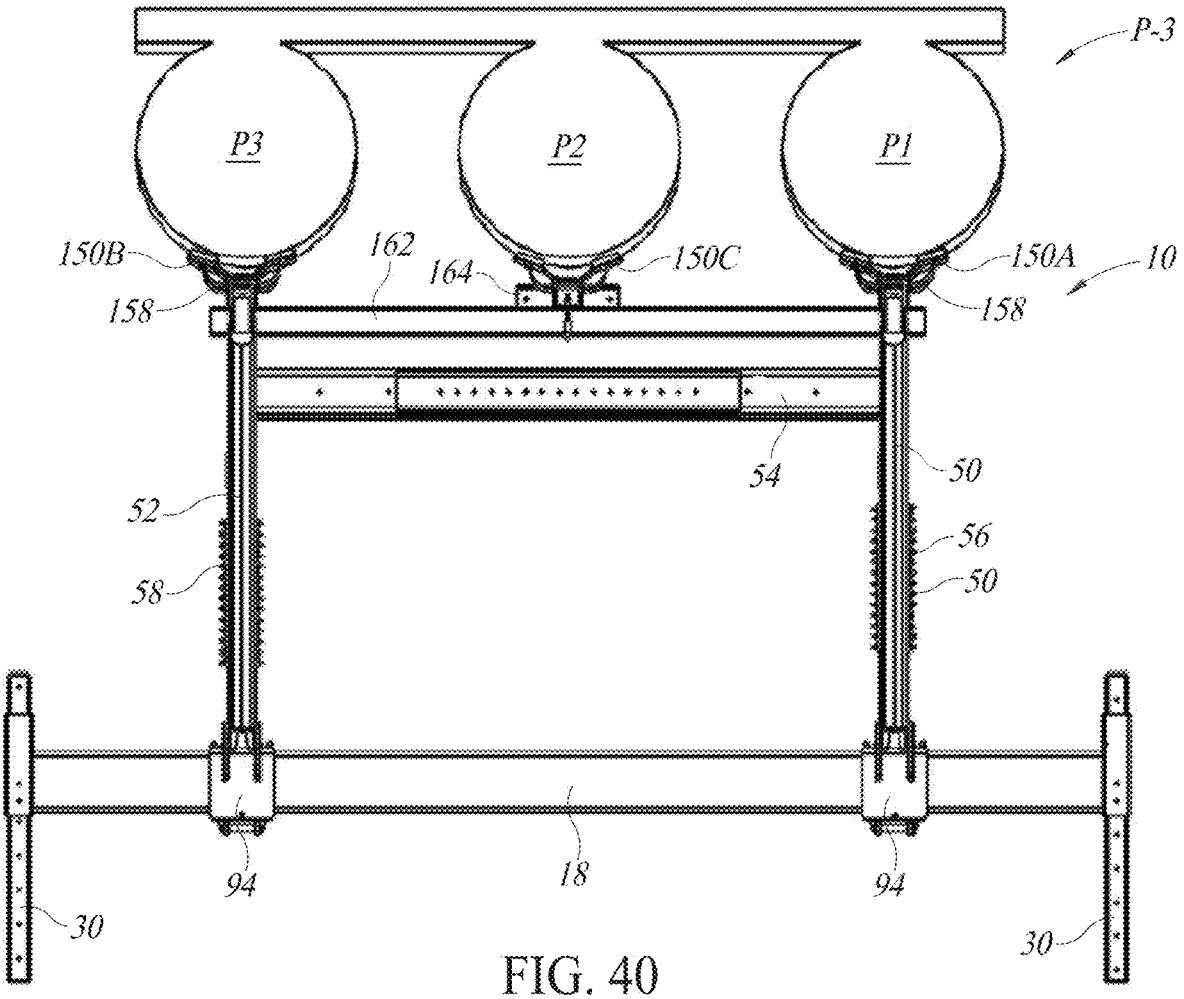
FIG. 40 is a front elevational view of the lift of FIG. 28.

When a pontoon boat "P-3" includes three pontoons P1, P2, and P3, it may be desirable to use a variation of the embodiment of FIG. 37, which is shown in FIGS. 38-40. In this embodiment, a pair of laterally spaced-apart lateral support beams 158 are used, each having a Y-shaped pontoon bunk 150A and a forward Y-shaped pontoon bunk 150B attached thereto to support pontoons P1 and P3. A rearward crossbeam 160 and a forward crossbeam 162 extend between and are attached to the lateral support beams. A center longitudinal support beam 164 extends longitudinally between the spaced-apart lateral support beams 158 and is attached to the rearward and forward crossbeams 160 and 162. The center longitudinal support beam 164 has a plurality of longitudinally arranged through holes to permit adjustable attachment of a center Y-shaped pontoon bunk 150C along the length of the center longitudinal support beam to allow selective longitudinal positioning of the center pontoon bunk to position the center pontoon bunk to better support the center pontoon P2.

The lateral spacing between the left and right side longitudinal support beams 158 and hence the pontoon bunks they support is adjusted so that when the pontoon boat is on the watercraft lift 10, in much the same manner as described above for the left and right side bunks 40 and 42. Since the weight of many pontoon boats is concentrated in the rear center of the boat due to the outboard engine, the length of the center Y-shaped pontoon bunk 150C may be shorter than the outer longitudinal support beams 158 to save cost and weight.

Stiffness

The watercraft lift 10 of the preferred embodiment, the lift frame is very stiff as a result of using alignment of the hydraulic actuators with the longitudinal side beams, using set screws with the leg sockets, and hydraulic cushions that slow the movement of the hydraulic actuators at the watercraft lift nears the fully raised position. The greatly reduces the shaking of the watercraft supported by the bunks. It also enables corrosion resistant materials, such as aluminum, to be used and still achieve the desired stiffness, versus steel which rusts and is too heavy for seasonal installation and removal.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C"

refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam, at least one of the longitudinal left and right side beams being selectively laterally movable relative to the other of the longitudinal left and right side beams between a plurality of lateral positions, and selectively locked in a selected one of the plurality of lateral positions;

a left side rearward lifting arm having a lower end portion pivotally attached to the rearward end portion of the longitudinal left side beam and an upper end portion;

a right side rearward lifting arm having a lower end portion pivotally attached to the rearward end portion of the longitudinal right side beam and an upper end portion;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm; and a right side actuator having a lower end portion pivotally attached to the rearward end portion of the longitudinal right side beam and an upper end portion pivotally attached to the right side rearward lifting arm; and a laterally extending rearward connector member having a left end portion attached to the left side rearward lifting arm and a right end portion attached to the right side rearward lifting arm, and a laterally extending forward connector member having a left end portion attached to the left side forward lifting arm and a right end portion attached to the right side forward lifting arm, the rearward connector member having first and second rearward connector portions selectively disconnectable and reconnectable to permit selective lateral movement of the at least one of the longitudinal left and right side beams selectively laterally moved relative to the other of the longitudinal left and right side beams to the selected one of the plurality of lateral positions, and the forward connector member having first and second forward connector portions selectively disconnectable and reconnectable to permit selective lateral movement of the at least one of the longitudinal left and right side beams selectively laterally moved relative to the other of the longitudinal left and right side beams to the selected one of the plurality of lateral positions;

wherein the left side rearward lifting arm is pivotally rotatable about the longitudinal left side beam in a first left side plane and the left side actuator is pivotally rotatable about the longitudinal left side beam in a second left side plane, the first and second left side planes being substantially coplanar, and the right side rearward lifting arm is pivotally rotatable about the longitudinal right side beam in a first right side plane and the right side actuator is pivotally rotatable about the longitudinal right side beam in a second right side plane, the first and second right side planes being substantially coplanar.

2. The watercraft lift apparatus of claim 1, wherein the left side rearward lifting arm is pivotally rotatable about the longitudinal left side beam in a left side plane and the left side actuator is pivotally rotatable about the longitudinal left side beam in the left side plane, and the right side rearward lifting arm is pivotally rotatable about the longitudinal right side beam in a right side plane and the right side actuator is pivotally rotatable about the longitudinal right side beam in the right side plane.

3. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam, at least one of the longitudinal left and right side beams being selectively laterally movable relative to the other of the longitudinal left and right side beams between a plurality of lateral positions, and selectively locked in a selected one of the plurality of lateral positions;

a left side rearward lifting arm having a lower end portion pivotally attached to the rearward end portion of the longitudinal left side beam and an upper end portion;

a right side rearward lifting arm having a lower end portion pivotally attached to the rearward end portion of the longitudinal right side beam and an upper end portion;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm; and a right side actuator having a lower end portion pivotally attached to the rearward end portion of the longitudinal right side beam and an upper end portion pivotally attached to the right side rearward lifting arm;

wherein the left side rearward lifting arm is pivotally rotatable about the longitudinal left side beam in a first left side plane and the left side actuator is pivotally rotatable about the longitudinal left side beam in a second left side plane, the first and second left side planes being substantially coplanar, and the right side rearward lifting arm is pivotally rotatable about the longitudinal right side beam in a first right side plane and the right side actuator is pivotally rotatable about the longitudinal right side beam in a second right side plane, the first and second right side planes being substantially coplanar.

4. The watercraft lift apparatus of claim 3, further comprising: a laterally extending rearward connector member having a first rearward connector portion with a left end portion attached to the left side rearward lifting arm, a second rearward connector portion with a right end portion attached to the right side rearward lifting arm, and a third rearward connector portion selectively removably connectable to at least one of the first and second rearward connector portions to selectively lock the first and second rearward connector portions together against relative lateral movement between the first and second rearward connector portions and to selectively unlock the first and second rearward connector portions to permit relative lateral movement between the first and second rearward connector portions to permit selective lateral movement of the at least one of the longitudinal left and right side beams relative to the other of the longitudinal left and right side beams to the selected one of the plurality of lateral positions; and a laterally extending forward connector member having a first forward connector portion with a left end portion attached to the left side forward lifting arm, a second forward connector portion with a right end portion attached to the right side forward lifting arm, and a third forward connector portion selectively removably connectable to at least one of the first and second forward connector portions to selectively lock the first and second forward connector portions together against relative lateral movement between the first and second forward connector portions and to selectively unlock the first and second forward connector portions to permit relative lateral movement between the first and second forward connector portions to permit selective lateral movement of the at least one of the longitudinal left and right side beams relative to the other of the longitudinal left and right side beams to the selected one of the plurality of lateral positions.

5. The watercraft lift apparatus of claim 4, wherein the first rearward connector portion has a right free end portion, the second rearward connector portion has a left free end portion, and the third rearward connector portion has a left end portion and a right end portion, the left end portion of the third rearward connector portion being selectively removably connectable to the right free end portion of the first rearward connector portion and the right end portion of the third rearward connector portion being selectively removably connectable to the left free end portion of the second rearward connector portion, and the first forward connector portion has a right free end portion, the second forward connector portion has a left free end portion, and the third forward connector portion has a left end portion and a right end portion, the left end portion of the third forward connector portion being selectively removably connectable to the right free end portion of the first forward connector portion and the right end portion of the third forward connector portion being selectively removably connectable to the left free end portion of the second forward connector portion.

6. The watercraft lift apparatus of claim 5, wherein the left end portion of the third rearward connector portion is selectively removably connectable to the right free end portion of the first rearward connector portion using at least one fastener and the right end portion of the third rearward connector portion is selectively removably connectable to the left free end portion of the second rearward connector portion using at least one fastener, and the left end portion of the third forward connector portion is selectively removably connectable to the right free end portion of the first forward connector portion using at least one fastener and the right end portion of the third forward connector portion is selectively removably connectable to the left free end portion of the second forward connector portion using at least one fastener.

7. The watercraft lift apparatus of claim 5, wherein the right free end portion of the first rearward connector portion is an elongated member, the left free end portion of the second rearward connector portion is an elongated member, the left end portion of the third rearward connector portion is an elongated member positionable adjacent to and extending along the length of the elongated member of the right free end portion of the first rearward connector portion and removably connectable together using a plurality of fasteners, and the right end portion of the third rearward connector portion is an elongated member positionable adjacent to and extending along the length of the elongated member of the left free end portion of the second rearward connector portion and removably connectable together using a plurality of fasteners; and the right free end portion of the first forward connector portion is an elongated member, the left free end portion of the second forward connector portion is an elongated member, the left end portion of the third forward connector portion is an elongated member positionable adjacent to and extending along the length of the elongated member of the right free end portion of the first forward connector portion and removably connectable together using a plurality of fasteners, and the right end portion of the third forward connector portion is an elongated member positionable adjacent to and extending along the length of the elongated member of the left free end portion of the second forward connector portion and removably connectable together using a plurality of fasteners.

8. The watercraft lift apparatus of claim 5, wherein the right free end portion of the first rearward connector portion is a channel member, the left free end portion of the second rearward connector portion is a channel member, the left end portion and right end portion of the third rearward connector portion comprise an elongated tubular member sized to be removably positioned within channel members of the right and left free end portions of the first and second rearward connector portions; and the right free end portion of the first forward connector portion is a channel member, the left free end portion of the second forward connector portion is a channel member, the left end portion and right end portion of the third forward connector portion comprise an elongated tubular member sized to be removably positioned within channel members of the right and left free end portions of the first and second forward connector portions.

9. The watercraft lift apparatus of claim 8, wherein the elongated tubular member of the left end portion and right end portion of the third rearward connector portion includes an elongated recess sized to receive at least one first fastener therein to selectively lock the first and second rearward connector portions together against relative lateral movement therebetween, and the elongated tubular member of the left end portion and right end portion of the third rearward connector portion includes an elongated recess sized to receive at least one second fastener therein to selectively lock the first and second rearward connector portions together against relative lateral movement therebetween; and the elongated tubular member of the left end portion and right end portion of the third forward connector portion includes an elongated recess sized to receive at least one third fastener therein to selectively lock the first and second forward connector portions together against relative lateral movement therebetween, and the elongated tubular member of the left end portion and right end portion of the third forward connector portion includes an elongated recess sized to receive at least one fourth fastener therein to selectively lock the first and second forward connector portions together against relative lateral movement therebetween.

10. The watercraft lift apparatus of claim 5, wherein the right free end portion of the first rearward connector portion is a first tubular member, the left free end portion of the second rearward connector portion is a second tubular member, the left end portion and right end portion of the third rearward connector portion comprise a first channel member sized to be removably receive therein the first and second tubular members of the right and left free end portions of the first and second rearward connector portions; and the right free end portion of the first forward connector portion is a third tubular member, the left free end portion of the second forward connector portion is a fourth tubular member, the left end portion and right end portion of the third forward connector portion comprise a second channel member sized to be removably receive therein the third and fourth tubular members of the right and left free end portions of the first and second forward connector portions.

11. The watercraft lift apparatus of claim 5, wherein the left side rearward lifting arm is pivotally rotatable about the longitudinal left side beam in a left side plane and the left side actuator is pivotally rotatable about the longitudinal left side beam in the left side plane, and the right side rearward lifting arm is pivotally rotatable about the longitudinal right side beam in a right side plane and the right side actuator is pivotally rotatable about the longitudinal right side beam in the right side plane.

12. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam, at least one of the longitudinal left and right side beams being selectively laterally movable relative to the other of the longitudinal left and right side beams between a plurality of lateral positions, and selectively locked in a selected one of the plurality of lateral positions;

a left side rearward lifting arm having a lower end portion pivotally attached to the rearward end portion of the longitudinal left side beam and an upper end portion;

a right side rearward lifting arm having a lower end portion pivotally attached to the rearward end portion of the longitudinal right side beam and an upper end portion;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm;

a right side actuator having a lower end portion pivotally attached to the rearward end portion of the longitudinal right side beam and an upper end portion pivotally attached to the right side rearward lifting arm;

a laterally extending rearward connector member having a first rearward connector portion with a left end portion attached to the left side rearward lifting arm, a second rearward connector portion with a right end portion attached to the right side rearward lifting arm, and a third rearward connector portion selectively removably connectable to at least one of the first and second rearward connector portions to selectively lock the first and second rearward connector portions together against relative lateral movement between the first and second rearward connector portions and to selectively unlock the first and second rearward connector portions to permit relative lateral movement between the first and second rearward connector portions to permit selective lateral movement of the at least one of the longitudinal left and right side beams relative to the other of the longitudinal left and right side beams to the selected one of the plurality of lateral positions, the first rearward connector portion further having a right free end portion, the second rearward connector portion further having a left free end portion, and the third rearward connector portion further having a left end portion and a right end portion, the left end portion of the third rearward connector portion being selectively removably connectable to the right free end portion of the first rearward connector portion and the right end portion of the third rearward connector portion being selectively removably connectable to the left free end portion of the second rearward connector portion; and a laterally extending forward connector member having a first forward connector portion with a left end portion attached to the left side forward lifting arm, a second forward connector portion with a right end portion attached to the right side forward lifting arm, and a third forward connector portion selectively removably connectable to at least one of the first and second forward connector portions to selectively lock the first and second forward connector portions together against relative lateral movement between the first and second forward connector portions and to selectively unlock the first and second forward connector portions to permit relative lateral movement between the first and second forward connector portions to permit selective lateral movement of the at least one of the longitudinal left and right side beams relative to the other of the longitudinal left and right side beams to the selected one of the plurality of lateral positions, the first forward connector portion further having a right free end portion, the second forward connector portion further having a left free end portion, and the third forward connector portion further having a left end portion and a right end portion, the left end portion of the third forward connector portion being selectively removably connectable to the right free end portion of the first forward connector portion and the right end portion of the third forward connector portion being selectively removably connectable to the left free end portion of the second forward connector portion;

wherein the left side rearward lifting arm is pivotally rotatable about the longitudinal left side beam in a first left side plane and the left side actuator is pivotally rotatable about the longitudinal left side beam in a second left side plane, the first and second left side planes being substantially coplanar, and the right side rearward lifting arm is pivotally rotatable about the longitudinal right side beam in a first right side plane and the right side actuator is pivotally rotatable about the longitudinal right side beam in a second right side plane, the first and second right side planes being substantially coplanar.

13. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam, at least one of the longitudinal left and right side beams being selectively laterally movable relative to the other of the longitudinal left and right side beams between a plurality of lateral positions, and selectively locked in a selected one of the plurality of lateral positions;

a left side rearward lifting arm having a lower end portion pivotally attached to the rearward end portion of the longitudinal left side beam and an upper end portion;

a right side rearward lifting arm having a lower end portion pivotally attached to the rearward end portion of the longitudinal right side beam and an upper end portion;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm; and a right side actuator having a lower end portion pivotally attached to the rearward end portion of the longitudinal right side beam and an upper end portion pivotally attached to the right side rearward lifting arm;

wherein the left side actuator is extendable to rotate the left side rearward lifting arm from a rotational position rearward of a top dead center position of the left side rearward lifting arm to a rotational end position forward of the top dead center position, and the right side actuator is extendable to rotate the right side rearward lifting arm from a rotational position rearward of a top dead center position of the right side rearward lifting arm to a rotational end position forward of the top dead center position.

14. The watercraft lift apparatus of claim 13, wherein the pivot connection of the rearward end portion of the left side watercraft support to the upper end portion of the left side rearward lifting arm is forward of a center line of the left side rearward lifting arm at a location such that when the left side actuator rotates the left side rearward lifting arm to a rotational end position forward of the top dead center position, the left side rearward lifting arm is vertically oriented, and the pivot connection of the rearward end portion of the right side watercraft support to the upper end portion of the right side rearward lifting arm is forward of a center line of the right side rearward lifting arm at a position such that when the right side actuator rotates the right side rearward lifting arm to a rotational end position forward of the top dead center position, the right side rearward lifting arm is vertically oriented.

15. The watercraft lift apparatus of claim 13, wherein the left side rearward lifting arm is pivotally rotatable about the longitudinal left side beam in a left side plane and the left side actuator is pivotally rotatable about their the longitudinal left side beam in the left side plane, and the right side rearward lifting arm is pivotally rotatable about the longitudinal right side beam in a right side plane and the right side actuator is pivotally rotatable about the longitudinal right side beam in the right side plane.

16. The watercraft lift apparatus of claim 13, wherein the left side rearward lifting arm is pivotally rotatable about to the longitudinal left side beam in a first left side plane and the left side actuator is pivotally rotatable about the longitudinal left side beam in a second left side plane, the first and second left side planes being substantially coplanar, and the right side rearward lifting arm is pivotally rotatable about the longitudinal right side beam in a first right side plane and the right side actuator is pivotally rotatable about the longitudinal right side beam in a second right side plane, the first and second right side planes being substantially coplanar.

17. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam, at least one of the longitudinal left and right side beams being selectively laterally movable relative to the other of the longitudinal left and right side beams between a plurality of lateral positions, and selectively locked in a selected one of the plurality of lateral positions;

a left side rearward lifting arm having a lower end portion pivotally attached to the rearward end portion of the longitudinal left side beam and an upper end portion;

a right side rearward lifting arm having a lower end portion pivotally attached to the rearward end portion of the longitudinal right side beam and an upper end portion;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm; and a right side actuator having a lower end portion pivotally attached to the rearward end portion of the longitudinal right side beam and an upper end portion pivotally attached to the right side rearward lifting arm;

wherein the left side actuator is extendable to rotate the left side rearward lifting arm from a rotational position rearward of a top dead center position of the left side rearward lifting arm to a rotational end position forward of the top dead center position, and to rotate the left side forward lifting arm from a rotational position rearward of a top dead center position of the left side forward lifting arm to a rotational end position forward of the top dead center position; and the right side actuator is extendable to rotate the right side rearward lifting arm from a rotational position rearward of a top dead center position of the right side rearward lifting arm to a rotational end position forward of the top dead center position, and to rotate the right side forward lifting arm from a rotational position rearward of a top dead center position of the right side forward lifting arm to a rotational end position forward of the top dead center position.

18. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam;

a left side rearward lifting arm having a lower end portion pivotally attached to the rearward end portion of the longitudinal left side beam and an upper end portion, the left side rearward lifting arm being rotatable about the longitudinal left side beam in a first left side plane;

a right side rearward lifting arm having a lower end portion pivotally attached to the rearward end portion of the longitudinal right side beam and an upper end portion, the right side rearward lifting arm being rotatable about the longitudinal right side beam in a first right side plane;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm, the left side actuator being rotatable about the longitudinal left side beam in a second left side plane, the first and second left side planes being substantially coplanar; and a right side actuator having a lower end portion pivotally attached to the rearward end portion of the longitudinal right side beam and an upper end portion pivotally attached to the right side rearward lifting arm, the right side actuator being rotatable about the longitudinal right side beam in a second right side plane, the first and second right side planes being substantially coplanar;

wherein the longitudinal left side beam comprises a left side forward beam portion and a left side rearward support member having a forward end portion and a rearward end portion, the left side rearward support member having an upright, laterally outward side plate and an upright, laterally inward side plate, in spaced apart relation, with a first left side pivot pin by which the lower end portion of the left side rearward lifting arm is pivotally attached to the rearward end portion of the longitudinal left side beam and a second left side pivot pin by which the lower end portion of the left side actuator is pivotally attached to the rearward end portion of the longitudinal left side beam, and the longitudinal right side beam comprises a right side forward beam portion and a right side rearward support member having a forward end portion and a rearward end portion, the right side rearward support member having an upright, laterally outward side plate and an upright, laterally inward side plate, in spaced apart relation, with a first right side pivot pin by which the lower end portion of the right side rearward lifting arm is pivotally attached to the rearward end portion of the longitudinal right side beam and a second right side pivot pin by which the lower end portion of the right side actuator is pivotally attached to the rearward end portion of the longitudinal right side beam; and wherein a left side floor member extends between the laterally outward side plate and the laterally inward side plate of the left side rearward support member, the laterally outward side plate and the laterally inward side plate of the left side rearward support member being spaced apart to permit passage of the left side actuator therebetween and allow the left side actuator to engage and be supported by the left side floor member during attachment of the lower end portion of the left side actuator to the longitudinal left side beam with the second left side pivot pin, and a right side floor member extends between the laterally outward side plate and the laterally inward side plate of the right side rearward support member, the laterally outward side plate and the laterally inward side plate of the right side rearward support member being spaced apart to permit passage of the right side actuator therebetween and allow the right side actuator to engage and be supported by the right side floor member during attachment of the lower end portion of the right side actuator to the longitudinal right side beam with the second right side pivot pin.

19. The watercraft lift apparatus of claim 18, wherein the rearward end portion of the left side rearward support member being the portion of the longitudinal left side beam supported by the rearward lateral beam, and the rearward end portion of the right side rearward support member being the portion of the longitudinal right side beam supported by the rearward lateral beam.

20. The watercraft lift apparatus of claim 18, wherein a left side floor member extends between the laterally outward side plate and the laterally inward side plate of the left side rearward support member, the laterally outward side plate and the laterally inward side plate of the left side rearward support member being spaced apart to permit passage of the left side actuator therebetween and allow the left side actuator to engage and be supported by the left side floor member during attachment of the lower end portion of the left side actuator to the longitudinal left side beam with the second left side pivot pin, and a right side floor member extends between the laterally outward side plate and the laterally inward side plate of the right side rearward support member, the laterally outward side plate and the laterally inward side plate of the right side rearward support member being spaced apart to permit passage of the right side actuator therebetween and allow the right side actuator to engage and be supported by the right side floor member during attachment of the lower end portion of the right side actuator to the longitudinal right side beam with the second right side pivot pin.

21. A watercraft lift apparatus for lifting and lowering a watercraft, comprising:

a rearward lateral beam;

a forward lateral beam;

a longitudinal left side beam having a rearward end portion and a forward end portion, the rearward end portion being supported by the rearward lateral beam and the forward end portion being supported by the forward lateral beam;

a longitudinal right side beam having a rearward end portion and a forward end portion, the rearward end portion being supported by the rearward lateral beam and the forward end portion being supported by the forward lateral beam;

a left side rearward lifting arm having a lower end portion pivotally attached to the rearward end portion of the longitudinal left side beam and an upper end portion, the left side rearward lifting arm being rotatable about the longitudinal left side beam in a first left side plane;

a right side rearward lifting arm having a lower end portion pivotally attached to the rearward end portion of the longitudinal right side beam and an upper end portion, the right side rearward lifting arm being rotatable about the longitudinal right side beam in a first right side plane;

a left side forward lifting arm having a lower end portion pivotally attached to the forward end portion of the longitudinal left side beam and an upper end portion;

a right side forward lifting arm having a lower end portion pivotally attached to the forward end portion of the longitudinal right side beam and an upper end portion;

a left side watercraft support having a rearward end portion pivotally connected to the upper end portion of the left side rearward lifting arm, and a forward end portion pivotally connected to the upper end portion of the left side forward lifting arm;

a right side watercraft support having a rearward end portion pivotally connected to the upper end portion of the right side rearward lifting arm, and a forward end portion pivotally connected to the upper end portion of the right side forward lifting arm;

a left side actuator having a lower end portion pivotally attached to the rearward end portion of the longitudinal left side beam and an upper end portion pivotally attached to the left side rearward lifting arm, the left side actuator being rotatable about the longitudinal left side beam in a second left side plane, the first and second left side planes being substantially coplanar; and a right side actuator having a lower end portion pivotally attached to the rearward end portion of the longitudinal right side beam and an upper end portion pivotally attached to the right side rearward lifting arm, the right side actuator being rotatable about the longitudinal right side beam in a second right side plane, the first and second right side planes being substantially coplanar;

wherein the longitudinal left side beam comprises a left side forward beam portion and a left side rearward support member having a forward end portion and a rearward end portion, the left side rearward support member having an upright, laterally outward side plate and an upright, laterally inward side plate, in spaced apart relation, with a first left side pivot pin by which the lower end portion of the left side rearward lifting arm is pivotally attached to the rearward end portion of the longitudinal left side beam and a second left side pivot pin by which the lower end portion of the left side actuator is pivotally attached to the rearward end portion of the longitudinal left side beam, and the longitudinal right side beam comprises a right side forward beam portion and a right side rearward support member having a forward end portion and a rearward end portion, the right side rearward support member having an upright, laterally outward side plate and an upright, laterally inward side plate, in spaced apart relation, with a first right side pivot pin by which the lower end portion of the right side rearward lifting arm is pivotally attached to the rearward end portion of the longitudinal right side beam and a second right side pivot pin by which the lower end portion of the right side actuator is pivotally attached to the rearward end portion of the longitudinal right side beam; and wherein the laterally outward side plate and the laterally inward side plate of the left side rearward support member flare outward in the direction toward the rearward lateral beam to receive the left side actuator therebetween as the left side actuator rotates downward and toward the rearward lateral beam during operation of the watercraft lift apparatus, and the laterally outward side plate and the laterally inward side plate of the right side rearward support member flare outward in the direction toward the rearward lateral beam to receive the right side actuator therebetween as the right side actuator rotates downward and toward the rearward lateral beam during operation of the watercraft lift apparatus.

* * * * *